US007690638B2

(12) United States Patent
Kikuchi

(10) Patent No.: US 7,690,638 B2
(45) Date of Patent: Apr. 6, 2010

(54) PRINTING SYSTEM, JOB PROCESSING METHOD, AND STORAGE MEDIUM

(75) Inventor: Hiroshi Kikuchi, Musashino (JP)

(73) Assignee: Canon Kabushiki Kaisha, Tokyo (JP)

( * ) Notice: Subject to any disclaimer, the term of this patent is extended or adjusted under 35 U.S.C. 154(b) by 71 days.

(21) Appl. No.: 11/951,079

(22) Filed: Dec. 5, 2007

(65) Prior Publication Data

US 2008/0154426 A1 Jun. 26, 2008

(30) Foreign Application Priority Data

Dec. 20, 2006 (JP) ..... 2006-342820

(51) Int. Cl.

| | |
|---|---|
| ***B65H 33/04*** | (2006.01) |
| ***B65H 39/00*** | (2006.01) |
| ***B42B 2/00*** | (2006.01) |
| ***B42B 2/02*** | (2006.01) |

(52) U.S. Cl. ..... 270/58.16; 270/58.17; 270/58.07; 270/58.11; 270/58.12; 270/58.27

(58) Field of Classification Search ..... 270/58.11, 270/58.12, 58.17, 58.27, 58.31, 58.32
See application file for complete search history.

(56) References Cited

U.S. PATENT DOCUMENTS

| | | | | |
|---|---|---|---|---|
| 4,730,822 | A * | 3/1988 | Wagner | 270/58.31 |
| 5,722,650 | A * | 3/1998 | Yamamoto et al. | 270/58.02 |
| 2007/0045929 | A1 * | 3/2007 | Fujii et al. | 270/58.14 |
| 2008/0099972 | A1 * | 5/2008 | Hayashi | 270/18 |

* cited by examiner

*Primary Examiner*—Gene Crawford
*Assistant Examiner*—Yolanda Cumbess
(74) *Attorney, Agent, or Firm*—Canon USA Inc IP Div

(57) ABSTRACT

A printing system is configured to be able to use a plurality of types of stacking units. The printing system comprises a first controller configured to execute operations to stack printed material which is printed by a printing unit to a stacking unit such that the printed material is stacked in a state shifted a defined amount as to other printed material stacked on the stacking unit. The printing system further includes a second controller configured to inhibit the operations based on information relating to a specified type of the stacking unit in the plurality of types of stacking units.

14 Claims, 28 Drawing Sheets

10000

FIG. 13A
FIG. 13B
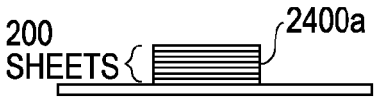
FIG. 13C
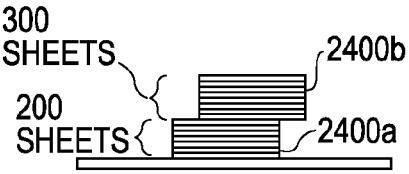
LOADING PATTERN 1
FIG. 14A
FIG. 14B
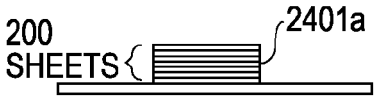
FIG. 14C
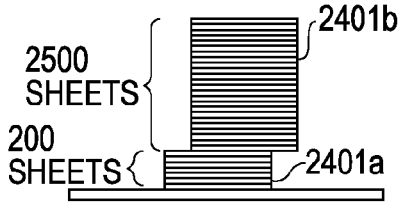
LOADING PATTERN 2

FIG. 15A
FIG. 15B
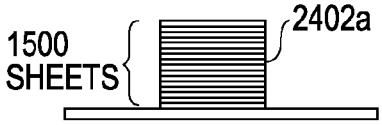
FIG. 15C
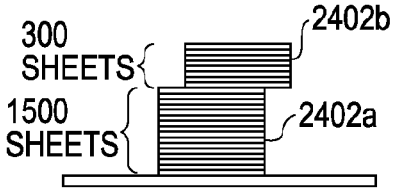
LOADING PATTERN 3
FIG. 16A
FIG. 16B
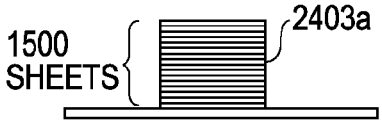
FIG. 16C
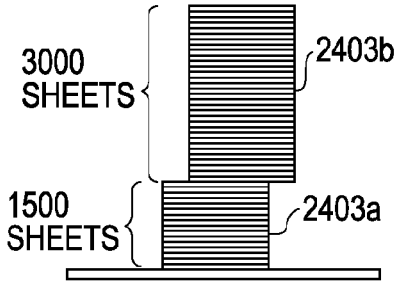
LOADING PATTERN 4

FIG. 17

| TYPE OF INLINE FINISHER | SADDLE-STITCH BINDING APPARATUS | LARGE CAPACITY STACKER | - - - | INLINE FINISHER N |
|---|---|---|---|---|
| RESTRICTION 1 (RESTRICTION RELATING TO LARGEST-CAPACITY PERMISSIBLE NUMBER OF SHEETS) | ALLOW MAXIMUM OF 4000 SHEETS TO LOAD ON STACKING TRAY. IN THE CASE OF MORE SHEETS, SWITCH DESTINATION TO ANOTHER OUTPUT DESTINATION. | ALLOW MAXIMUM OF 5000 SHEETS TO LOAD ON STACKING TRAY. IN THE CASE OF MORE SHEETS, SWITCH DESTINATION TO ANOTHER OUTPUT DESTINATION. | | |
| RESTRICTION 2 (RESTRICTION RELATING TO SHIFTING DISCHARGE PROCESSING) | IF WITHIN RANGE OF MAXIMUM NUMBER OF SHEETS, ALLOW FOLLOWING SHEET BUNDLE TO LOAD ON TOP OF ADVANCE SHEET BUNDLE IN A STATE OF BEING SHIFTED 10 mm FROM ADVANCE SHEET BUNDLE SERVING AS LOADING OBJECT ON STACKING TRAY FOR SADDLE-STITCH BINDER, WITHOUT DEPENDING ON THE NUMBER OF SHEETS INCLUDED IN THE SHEET BUNDLE OF ADVANCE JOB OR NUMBER OF SHEETS INCLUDED IN THE SHEET BUNDLE OF FOLLOWING JOB. | ALLOW FOLLOWING SHEET BUNDLE TO LOAD ON TOP OF ADVANCE SHEET BUNDLE IN A STATE OF FOLLOWING SHEET BUNDLE BEING SHIFTED 10 mm FROM ADVANCE SHEET BUNDLE, IN THE CASE OF THE MAXIMUM NUMBER OF SHEETS WITHIN RANGE AND THE NUMBER OF SHEETS INCLUDED IN SHEET BUNDLE OF ADVANCE JOB IS LESS THAN 10. | | |
| | | ALLOW FOLLOWING SHEET BUNDLE TO LOAD ON TOP OF ADVANCE SHEET BUNDLE IN A STATE OF FOLLOWING SHEET BUNDLE BEING SHIFTED 10 mm FROM ADVANCE SHEET BUNDLE, IN THE CASE OF THE MAXIMUM NUMBER OF SHEETS WITHIN RANGE AND THE NUMBER OF SHEETS INCLUDED IN SHEET BUNDLE OF ADVANCE JOB IS 10 OR MORE AND LESS THAN 300, AND THE NUMBER OF SHEETS INCLUDED IN THE SHEET BUNDLE OF THE FOLLOWING JOB IS LESS THAN 1000. | | |
| | | INHIBIT FOLLOWING SHEET BUNDLE FROM LOADING ON TOP OF ADVANCE SHEET BUNDLE IN A STATE OF FOLLOWING SHEET BUNDLE BEING SHIFTED 10 mm FROM ADVANCE SHEET BUNDLE, IN THE CASE OF THE MAXIMUM NUMBER OF SHEETS WITHIN RANGE AND THE NUMBER OF SHEETS INCLUDED IN SHEET BUNDLE OF ADVANCE JOB IS 10 OR MORE AND LESS THAN 300, AND THE NUMBER OF SHEETS INCLUDED IN THE SHEET BUNDLE OF THE FOLLOWING JOB IS LESS THAN 1000 (ALLOW SHEET BUNDLE OF FOLLOWING JOB TO LOAD ON TOP OF SHEET BUNDLE OF ADVANCE JOB IN STATE OF NOT SHIFTING 10 mm FROM SHEET BUNDLE OF RELEVANT ADVANCE JOB). | | |
| | | ALLOW FOLLOWING SHEET BUNDLE TO LOAD ON TOP OF ADVANCE SHEET BUNDLE IN A STATE OF FOLLOWING SHEET BUNDLE BEING SHIFTED 10 mm FROM ADVANCE SHEET BUNDLE, IN THE CASE OF THE MAXIMUM NUMBER OF SHEETS WITHIN RANGE AND THE NUMBER OF SHEETS INCLUDED IN SHEET BUNDLE OF ADVANCE JOB IS 300 OR MORE AND THE NUMBER OF SHEETS INCLUDED IN THE SHEET BUNDLE OF THE FOLLOWING JOB IS LESS THAN 2000. | | |
| | | INHIBIT FOLLOWING SHEET BUNDLE FROM LOADING ON TOP OF ADVANCE SHEET BUNDLE IN A STATE OF FOLLOWING SHEET BUNDLE BEING SHIFTED 10 mm FROM ADVANCE SHEET BUNDLE, IN THE CASE OF THE MAXIMUM NUMBER OF SHEETS WITHIN RANGE AND THE NUMBER OF SHEETS INCLUDED IN SHEET BUNDLE OF ADVANCE JOB IS 300 OR MORE AND THE NUMBER OF SHEETS INCLUDED IN THE SHEET BUNDLE OF THE FOLLOWING JOB IS NOT LESS THAN 2000 (ALLOW SHEET BUNDLE OF FOLLOWING JOB TO LOAD ON TOP OF SHEET BUNDLE OF ADVANCE JOB IN STATE OF NOT SHIFTING 10 mm FROM SHEET BUNDLE OF RELEVANT ADVANCE JOB). | | |
| ⋮ | | | | |
| | | | | |
| RESTRICTION n | | | | |

| |
|---|
| FIG. 18A |
| FIG. 18B |

FIG. 20

| TYPE OF INLINE FINISHER | SADDLE-STITCH BINDING APPARATUS | LARGE CAPACITY STACKER | - - - | | INLINE FINISHER N |
|---|---|---|---|---|---|
| RESTRICTION 1 (RESTRICTION RELATING TO LARGEST-CAPACITY PERMISSIBLE NUMBER OF SHEETS) | ALLOW MAXIMUM OF 4000 SHEETS TO LOAD ON STACKING TRAY. IN THE CASE OF MORE SHEETS, SWITCH DESTINATION TO ANOTHER OUTPUT DESTINATION. | ALLOW MAXIMUM OF 5000 SHEETS TO LOAD ON STACKING TRAY. IN THE CASE OF MORE SHEETS, SWITCH DESTINATION TO ANOTHER OUTPUT DESTINATION. | | | |
| RESTRICTION 2 (RESTRICTION RELATING TO SHIFTING DISCHARGE PROCESSING) | IF WITHIN RANGE OF MAXIMUM NUMBER OF SHEETS, ALLOW SHEET BUNDLE OF FOLLOWING JOB TO LOAD ON TOP OF SHEET BUNDLE OF ADVANCE JOB IN A STATE OF BEING SHIFTED 10 mm FROM SHEET BUNDLE OF ADVANCE JOB SERVING AS LOADING OBJECT ON STACKING TRAY FOR SADDLE-STITCH BINDER, WITHOUT DEPENDING ON THE HEIGHT OF THE SHEET BUNDLE OF ADVANCE JOB OR HEIGHT OF THE SHEET BUNDLE OF FOLLOWING JOB. | ALLOW SHEET BUNDLE OF FOLLOWING JOB TO LOAD ON TOP OF SHEET BUNDLE OF RELEVANT ADVANCE JOB IN A STATE OF SHEET BUNDLE OF FOLLOWING JOB BEING SHIFTED 10 mm FROM SHEET BUNDLE OF ADVANCE JOB, IN THE CASE OF THE MAXIMUM NUMBER OF SHEETS WITHIN RANGE AND THE HEIGHT OF THE SHEET BUNDLE OF ADVANCE JOB IS LESS THAN 1 mm. | | | |
| | | ALLOW SHEET BUNDLE OF FOLLOWING JOB TO LOAD ON TOP OF SHEET BUNDLE OF ADVANCE JOB IN A STATE OF SHEET BUNDLE OF FOLLOWING JOB BEING SHIFTED 10 mm FROM SHEET BUNDLE OF ADVANCE JOB, IN THE CASE OF THE MAXIMUM NUMBER OF SHEETS WITHIN RANGE AND THE HEIGHT OF THE SHEET BUNDLE OF ADVANCE JOB IS 1 mm OR MORE AND LESS THAN 30 mm, AND THE HEIGHT OF THE SHEET BUNDLE OF THE FOLLOWING JOB IS LESS THAN 100 mm. | | | |
| | | INHIBIT SHEET BUNDLE OF FOLLOWING JOB FROM LOADING ON TOP OF SHEET BUNDLE OF ADVANCE JOB IN A STATE OF SHEET BUNDLE OF FOLLOWING JOB BEING SHIFTED 10 mm FROM SHEET BUNDLE OF ADVANCE JOB, IN THE CASE OF THE MAXIMUM NUMBER OF SHEETS WITHIN RANGE AND THE HEIGHT OF THE SHEET BUNDLE OF THE ADVANCE JOB IS 1 mm OR MORE AND LESS THAN 30 mm, AND THE HEIGHT OF THE SHEET BUNDLE OF THE FOLLOWING JOB IS LESS THAN 100 mm OR MORE (ALLOW SHEET BUNDLE OF FOLLOWING JOB TO LOAD ON TOP OF SHEET BUNDLE OF ADVANCE JOB IN STATE OF NOT SHIFTING 10 mm FROM SHEET BUNDLE OF RELEVANT ADVANCE JOB). | | | |
| | | ALLOW SHEET BUNDLE OF FOLLOWING JOB TO LOAD ON TOP OF SHEET BUNDLE OF ADVANCE JOB IN A STATE OF SHEET BUNDLE OF FOLLOWING JOB BEING SHIFTED 10 mm FROM SHEET BUNDLE OF ADVANCE JOB, IN THE CASE OF THE MAXIMUM NUMBER OF SHEETS WITHIN RANGE AND THE HEIGHT OF THE SHEET BUNDLE OF ADVANCE JOB IS 30 mm OR MORE AND THE HEIGHT OF THE SHEET BUNDLE OF THE FOLLOWING JOB IS LESS THAN 200 mm. | | | |
| | | INHIBIT SHEET BUNDLE OF FOLLOWING JOB FROM LOADING ON TOP OF SHEET BUNDLE OF ADVANCE JOB IN A STATE OF SHEET BUNDLE OF FOLLOWING JOB BEING SHIFTED 10 mm FROM SHEET BUNDLE OF ADVANCE JOB, IN THE CASE OF THE MAXIMUM NUMBER OF SHEETS WITHIN RANGE AND THE HEIGHT OF THE SHEET BUNDLE OF ADVANCE JOB IS 30 mm OR MORE AND THE HEIGHT OF THE SHEET BUNDLE OF THE FOLLOWING JOB IS NOT LESS THAN 200 mm (ALLOW SHEET BUNDLE OF FOLLOWING JOB TO LOAD ON TOP OF SHEET BUNDLE OF ADVANCE JOB IN STATE OF NOT SHIFTING 10 mm FROM SHEET BUNDLE OF RELEVANT ADVANCE JOB). | | | |
| ⋮ | | | | | |
| | | | | | |
| RESTRICTION n | | | | | |

FIG. 22

JOB STATUS

| ✓ | TYPE | JOB NAME | | SHEET SIZE | PAGES | STATUS |
|---|---|---|---|---|---|---|
| 1 | | JOB A | SADDLE-STITCH BINDING | A4 | 200 | EXECUTING |
| 2 | | JOB B | STACKER | A4 | 800 | AWAITING PRINTING |
| 3 | | JOB C | SADDLE-STITCH BINDING | A4 | 800 | AWAITING PRINTING |

CLOSE

SYSTEM STATUS/CANCEL

FIG. 23

JOB STATUS

| ✓ | TYPE | JOB NAME | | SHEET SIZE | PAGES | STATUS |
|---|---|---|---|---|---|---|
| 1 | | JOB A | SADDLE-STITCH BINDING | A4 | 200 | EXECUTING |
| 2 | | JOB B | STACKER | A4 | 800 | AWAITING PRINTING |
| 3 | | JOB C | SADDLE-STITCH BINDING | A4 | 800 | AWAITING PRINTING |
| 4 | | JOB D | STACKER | A4 | 5000 | AWAITING PRINTING |

CLOSE

SYSTEM STATUS/CANCEL

FIG. 24

WARNING

IF SHIFTING DISCHARGE IS PERFORMED
IN CURRENT STATE, BUNDLE MAY FALL
WHEN CONVEYING BY CART.
DISCHARGE WITHOUT SHIFTING?

YES NO

FIG. 25

WARNING

IF SHIFTING DISCHARGE IS PERFORMED
IN CURRENT STATE, BUNDLE MAY FALL
WHEN CONVEYING BY CART.

REMOVE SHEETS FROM STACKER
AFTER REMOVING SHEETS FROM STACKER,
PRESS OK BUTTON.

OK

FIG. 26
JOB STATUS
| ✓ | TYPE | JOB NAME | SHEET SIZE | PAGES | STATUS |
|---|---|---|---|---|---|
| 1 | | JOB A STACKER | A4 | 200 | EXECUTING |
| 2 | | JOB B STACKER | A4 | | READING |
CLOSE
SYSTEM STATUS/CANCEL
FIG. 27A
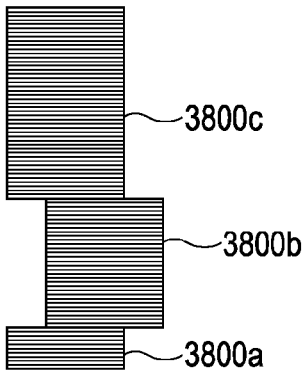
FIG. 27B
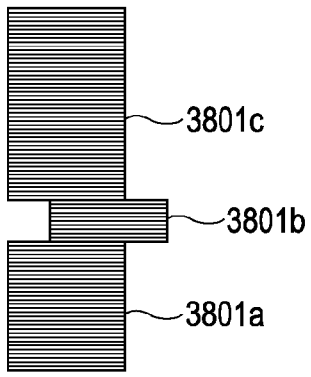

FIG. 29A
FIG. 29B
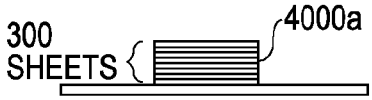
FIG. 29C
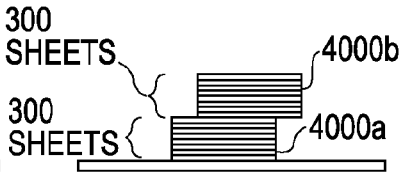
LOADING PATTERN 5
FIG. 30A
FIG. 30B
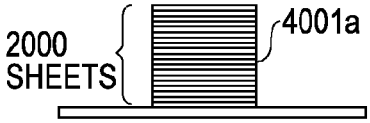
FIG. 30C
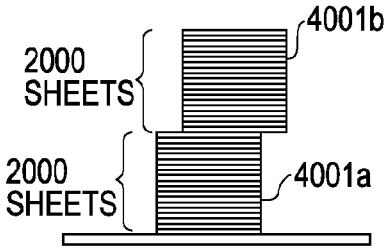
LOADING PATTERN 6

| |
|---|
| FIG. 31A |
| FIG. 31B |

FIG. 32

4200

| | SHIFT PROCESSING BETWEEN JOBS |
|---|---|
| NORMAL PAPER | INHIBIT SHEET BUNDLE OF FOLLOWING JOB FROM LOADING ON TOP OF SHEET BUNDLE OF ADVANCE JOB IN A STATE OF SHIFTING A SPECIFIED AMOUNT FROM SHEET BUNDLE OF JOB TO BE PROCESSED |
| COATED PAPER | INHIBIT SHEET BUNDLE OF FOLLOWING JOB FROM LOADING ON TOP OF SHEET BUNDLE OF ADVANCE JOB IN A STATE OF SHIFTING A SPECIFIED AMOUNT FROM SHEET BUNDLE OF JOB TO BE PROCESSED |
| GLOSSY PAPER | ALLOW SHEET BUNDLE OF FOLLOWING JOB TO LOAD ON TOP OF SHEET BUNDLE OF ADVANCE JOB IN A STATE OF SHIFTING A SPECIFIED AMOUNT FROM SHEET BUNDLE OF JOB TO BE PROCESSED |
| OHP | ALLOW SHEET BUNDLE OF FOLLOWING JOB TO LOAD ON TOP OF SHEET BUNDLE OF ADVANCE JOB IN A STATE OF SHIFTING A SPECIFIED AMOUNT FROM SHEET BUNDLE OF JOB TO BE PROCESSED |

PRINTING SYSTEM, JOB PROCESSING METHOD, AND STORAGE MEDIUM

BACKGROUND OF THE INVENTION

1. Field of the Invention

The present invention relates to a printing system capable of stacking printed material from a printing apparatus to a stacking portion of a post-processing apparatus, and a job processing method and storage medium for the printing system.

2. Description of the Related Art

Traditionally, there have been cases wherein an operator of a POD (Print on Demand) system performs large amounts of printing employing a printing apparatus. In the case of performing large amounts of printing employing a printing apparatus, stacking the printed sheets at a specified discharge destination in large amounts is desirable. Therefore, with the POD system, a large-capacity stacker may be employed which can stack the sheets printed with the printing apparatus in large amounts.

Also, with a POD system, post-processing operations such as binding, trimming, and folding are typically necessary, such post-processing operations may be performed at a sheet processing apparatus corresponding to the respective post-processing. However, with a POD system, the printing apparatus and sheet processing apparatus may be in separate locations. In such a case, the operator needs to transport the sheets printed with the printing apparatus to the sheet processing apparatus.

Thus, with a POD system, a cart may be provided within a large-capacity stacker serving as the discharge destination of the sheets subjected to printing at the printing apparatus, and the printing apparatus stacks the sheets subjected to printing upon the cart. After this, an operator transports the printed sheets stacked on the cart, along with the cart. With this method, moving the sheets from the large-capacity stacker or transporting the sheets to the sheet processing apparatuses can be performed smoothly.

On the other hand, in the event of discharging the sheets subjected to printing to the sheet processing apparatuses, processing is performed to cause the discharge positions of the sheets subjected to printing to be in a state shifted as to one another in increments of a fixed unit (for example, by each job or each copy). Thus, the operator can easily recognize the division of the sheet bundles by job or by copy.

This processing is an effective function for a large-capacity stacker, but as described above, in the case of a large-capacity stacker, transporting with a cart is assumed, wherein stability of the stacked sheets is particularly important. The reason thereof is that if the stacked sheets fall over from shaking during transporting or shock due to uneven flooring or the like, this places a burden on the operator responsible for picking up the scattered sheets.

SUMMARY OF THE INVENTION

According to an embodiment of the present invention, stacked (loaded) printed material is prevented from easily falling over by being stacked in a state of multiple printed materials in a shifted state, for example.

According to an aspect of the present invention, an embodiment is directed to a printing system configured to be able to use a plurality of types of stacking units. The printing system includes a first controller configured to execute operations to stack printed material which is printed by a printing unit to a stacking unit such that the printed material is stacked in a state shifted a defined amount as to other printed material stacked on the stacking unit, and a second controller configured to inhibit the operations based on information relating to the type of the stacking unit.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention and, together with the description, serve to explain the principle of the invention.

FIG. 13 is a diagram to describe control relating to shifting processing according to an embodiment.

FIG. 14 is a diagram to describe control relating to shifting processing according to an embodiment.

FIG. 15 is a diagram to describe control relating to shifting processing according to an embodiment.

FIG. 16 is a diagram to describe control relating to shifting processing according to an embodiment.

FIG. 17 is a diagram to describe a management table employed for the control by an embodiment.

FIG. 20 is a diagram to describe the management table employed for control by an embodiment.

FIG. 22 is a diagram to describe a display control example as to a UI portion which is subject to control by an embodiment.

FIG. 23 is a diagram to describe a display control example as to a UI portion which is subject to control by an embodiment.

FIG. 24 is a diagram to describe a display control example as to a UI portion which is subject to control by an embodiment.

FIG. 25 is a diagram to describe a display control example as to a UI portion which is subject to control by an embodiment.

FIG. 26 is a diagram to describe a display control example as to a UI portion which is subject to control by an embodiment.

FIG. 27 is a diagram to describe control relating to shifting processing of an embodiment.

FIG. 29 is a diagram to describe control relating to shifting processing of an embodiment.

FIG. 30 is a diagram to describe control relating to shifting processing of an embodiment.

FIG. 32 is a diagram to describe an example of an embodiment.

DESCRIPTION OF THE EMBODIMENTS

Embodiments of the present invention will be described in detail with reference to the appended diagrams.

First Embodiment

[Description of System Configuration of Entire Printing Environment 10000 Including Printing System 1000]

First, a printing environment 10000 including a printing system 1000 will be described. Note that according to an embodiment, the printing environment 10000 is applicable to a POD (Print on Demand) environment, accordingly the printing environment 10000 will also be referred to herein as "POD system 10000".

Figure 1:
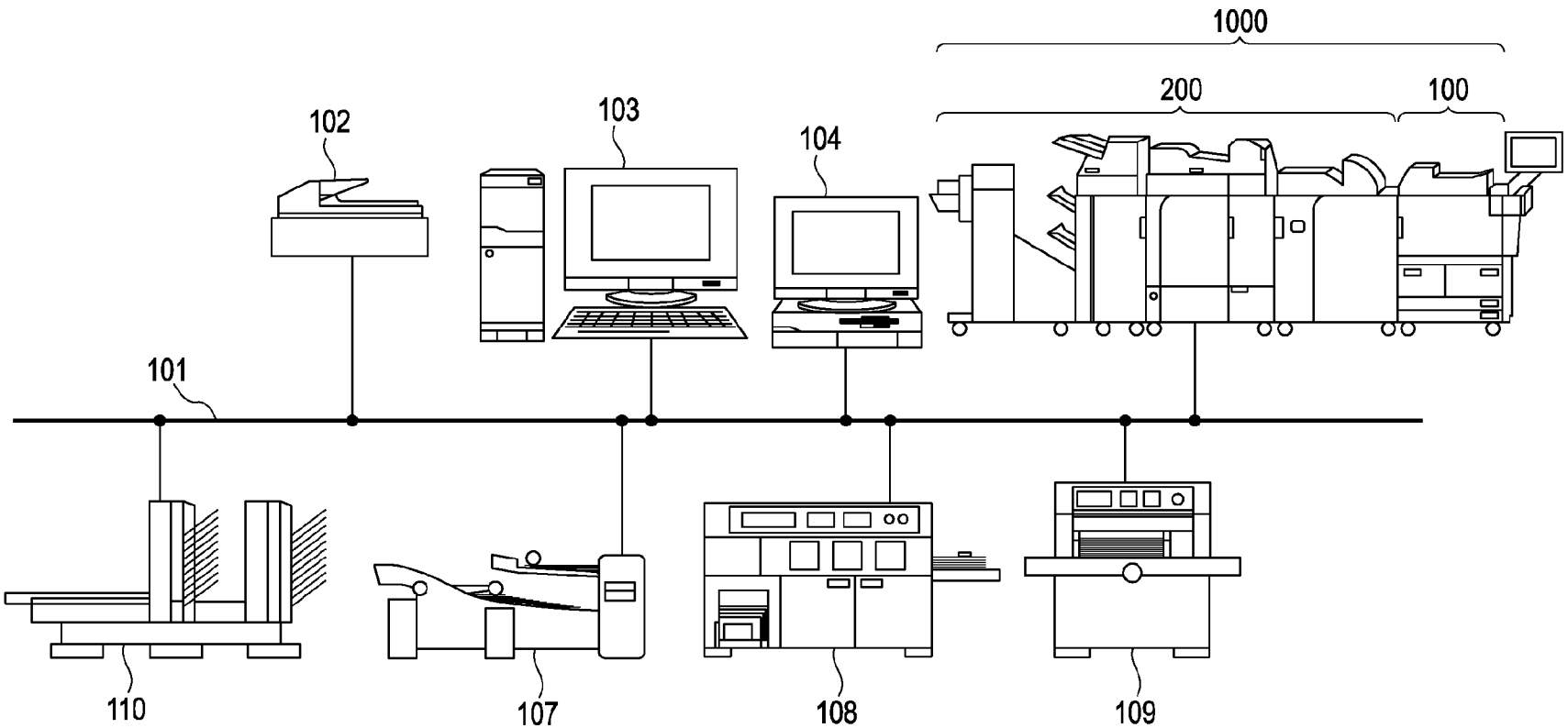
FIG. 1 is a diagram to describe an overall configuration example of a printing environment including a printing system which is subject to control by an embodiment of the present invention.

The POD system 10000 in FIG. 1 comprises the printing system 1000, a server computer 103 (hereafter, PC 103), and client computer 104 (hereafter, PC 104) of the present embodiment. Also, the POD system 10000 includes a paper-folding apparatus 107, case binding apparatus 108, trimming apparatus 109, saddle-stitching apparatus 110, scanner 102, and so forth.

The printing system 1000 includes a printing apparatus main unit 100 and sheet processing apparatus 200. Note that with the present embodiment, as one example of the printing apparatus 100, a multi-function apparatus having multiple functions such as a copy function and PC printing function or the like will be described as an example, but the printing apparatus 100 may be a printing apparatus with a single function of PC function only or a copy function only. Note that this multi-function apparatus is also called MFP (Multi Function Peripheral) in the description below.

Also, the paper-folding apparatus 107, case binding apparatus 108, trimming apparatus 109, and saddle-stitching apparatus 110 in FIG. 1 are apparatuses capable of executing sheet processing as to sheets subjected to printing with the printing apparatus 100, so are defined as sheet processing apparatuses, similar to the sheet processing apparatus 200 with the printing system 1000. For example, the paper-folding apparatus 107 executes folding processing of sheets subjected to printing with the printing apparatus 100. The case binding apparatus 108 executes case binding processing of sheets in a job printed with the printing apparatus 100. The trimming apparatus 109 executes trimming processing of the sheets subjected to printing with the printing apparatus 100. The saddle-stitching apparatus 110 executes saddle-stitching processing of sheets subjected to printing with the printing apparatus 100. However, in order to execute the various types of sheet processing with the sheet processing apparatuses, intervention operations by an operator are necessary after the printing processing with the printing apparatus 100. Specifically, the operator needs to remove the sheets subjected to printing with the printing apparatus 100 from the discharge unit of the printing apparatus 100, and also to work to set the sheets in a sheet processing apparatus to be subjected to desired sheet processing.

On the other hand, in the case of executing sheet processing employing the sheet processing apparatus 200, intervention operations by an operator are not necessary after executing the printing processing with the printing apparatus 100. This is because the sheet processing apparatus 200 is configured so as to directly receive sheets printed with the printing apparatus 100 via a sheet conveying path within the printing apparatus 100. Also, the present printing apparatus 100 and sheet processing apparatus 200 are configured so as to be able to be electrically mutually connected, can share a CPU, and can perform data communication mutually. Note that with the present embodiment, the sheet processing apparatuses are also called post-processing apparatuses or post-presses.

Also, the apparatuses other than the saddle-stitching apparatus 110 of the multiple apparatuses within the POD system 10000 in FIG. 1 are all connected to a network 101, and are configured so as to perform data communication mutually with other apparatuses.

For example, the printing apparatus 100 executes jobs transmitted from the information processing apparatuses such as the PC 103 and PC 104 via the network 101 (includes printing setting, printing data, and the like).

Also, the PC 103 executes the transmission/reception of data between other apparatuses via the network 101, thereby manages all jobs to be processed with the POD system 10000. In other words, the PC 103 performs overall management of the entire process of a string of workflow made up of multiple processes.

Such various sheet processing apparatuses in the POD system 10000 are defined in three types of categories in the [Definition 1] through [Definition 3] below.

[Definition 1]

The sheet processing apparatuses equivalent the apparatuses which fulfill both (Condition 1) and (Condition 2) below are defined as an "in-line finisher" (or in-line type sheet processing apparatus).

(Condition 1) A sheet conveying path is linked to the printing apparatus 100 so that the sheets conveyed from the printing apparatus 100 can be directly received without intervention from the operator.

(Condition 2) The sheet processing apparatus is electrically connected to other apparatuses via the network 101, for example, so as to perform data communication necessary for operating instructions with other apparatuses or status confirmation and so forth.

For example, the sheet processing apparatus 200 which the present printing system 1000 itself has applies to "in-line finisher" since it fulfills (Condition 1) and (Condition 2).

[Definition 2]

The sheet processing apparatus which does not fulfill (Condition 1) but fulfills (Condition 2) of the above-described (Condition 1) and (Condition 2) is defined as an "near-line finisher" (or near-line type sheet processing apparatus).

A near-line finisher does not have a sheet conveying path linked to the printing apparatus 100, thereby necessitating intervention operation by an operator such as transporting of the printed material. However, information such as operating instructions or status confirmation can be electrically transmitted/received via a communication unit such as the network 101.

For example, the paper-folding apparatus 107, case binding apparatus 108, trimming apparatus 109, and saddle-stitching apparatus 110 do not fulfill (Condition 1) but do fulfill (Condition 2), so apply to the "near-line finisher".

[Definition 3]

A sheet processing apparatus which does not fulfill either condition of (Condition 1) or (Condition 2) is defined as "off-line finisher" (or off-line type sheet processing apparatus). An off-line finisher also does not have the sheet conveying path linked to the printing apparatus 100, thereby necessitating intervention operation by an operator such as transporting of the printed material. Additionally, a communication unit necessary for operating instructions or status confirmation such as the network 101 is not provided thereto, and therefore data communication with other apparatuses cannot be performed. Therefore, the operator needs to manually perform transporting of printed material, setting the printed material, and instructions relating to processing of the printed material with the off-line finisher. For example, the saddle-stitching apparatus 110 in FIG. 1 applies to the "off-line finisher".

The operator can execute various sheet processing employing various sheet processing apparatuses which are categorized into three types such as the above "Definition 1] through [Definition 3].

[Internal Configuration of Printing System 1000 (Primarily Software Configuration)]

Next, the internal configuration of the printing system 1000 (primarily the software configuration) will be described with reference to the system block diagram in FIG. 2. With the present embodiment, of the various units, the units other than the sheet processing apparatus 200 are all provided internally to the printing apparatus 100. Also, the sheet processing apparatus 200 can be detachably attached to the printing apparatus 100.

The printing apparatus 100 has non-volatile memory such as a hard disk 209 (hereafter called HDD) which can store data of multiple jobs within the apparatus itself. The printing apparatus 100 has a copy function to print the data of a job received from the scanner unit 201 with a printer unit 203 via the HDD 209. Also, the printing apparatus 100 has a printing function to print the data of a job received from an information processing apparatus such as the PC 103 or PC 104, via the external interface unit 202 unit, with the printer unit 203 via the HDD 209.

Note that the printing apparatus 100 of the present embodiment may be any configuration as long as the various types of controls described with the present embodiment are executable therewith.

The printing apparatus 100 of the present embodiment include a scanner unit 201, external interface unit 202, printer unit 203, operating unit 204, control unit 205, ROM 207, RAM 208, HDD 209, and compression/decompression unit 210.

The scanner unit 201 reads a document image and subjects the read image data to image processing. The external interface unit 202 transmits/receives image data and the like between a facsimile, network connection apparatus, and external dedicated apparatus. The HDD 209 stores the image data of multiple jobs to be subjected to printing which are received from one of the scanner unit 201 and external interface unit 202. The printer unit 203 executes the printing processing of data of the jobs to be subjected to printing which are stored in the hard disk 209 as to a printing medium.

The operating unit 204 corresponds to an example of a user interface unit (also called UI unit) which receives operations or instructions from the user. Also the operating unit 204 has a display unit. As other examples of a user interface unit provided to the printing system 1000, there may be for example a display unit, keyboard, or mouse of the external apparatus of PC 103 or PC 104. The control unit 205 (also called controller unit or CPU) performs overall control of the processing or operations of the various types of units provided to the present printing system 1000.

The ROM 207 is memory dedicated to reading, and stores various types of control programs including a program for the purpose of executing various types of processing in a later-described flowchart. Also, the ROM 207 stores a display control program to perform various types of display on a display unit of the operating unit 204. The control unit 205 reads and executes the programs stored in the ROM 207, thereby causing the printing system 1000 to execute various types of operations described with the present embodiment.

The RAM 208 is readable and writable memory, and stores image data transmitted from the scanner unit 201 or external interface 202 via a memory controller 206 or various types of programs or setting information.

The HDD 209 is a large-capacity storage apparatus which stores variables for the purpose of employing job printing data for control. The control unit 205 stores the printing data of the job input via various types of input units such as the scanner unit 201 or external interface unit 202 in the HDD 209. Also, the control unit 205 performs control so as to print the printing data stored in the HDD 209 at the printer unit 203. Also, the control unit 205 performs control so as to transmit printing data stored in the HDD 209 to an external apparatus via the external interface 202.

The compression/decompression unit 210 performs compression/decompression operations of the image data of the like stored in the RAM 208 and HDD 209 with various types of compression methods such as JBIG or JPEG.

Note that the control unit 205 provided to the printing system 1000 also controls the operations of an in-line type of sheet processing apparatus 200. Also, the control unit 205 can output instructions as to near-line types of sheet processing apparatuses 200 such as the paper-folding apparatus 107, case binding apparatus 108, trimming apparatus 109 via the network 101.

[Apparatus Configuration of Present Printing System 1000 (Primarily Mechanical Configuration)]

Next, the configuration (primarily mechanical configuration) of the present printing system 1000 will be described with reference to the cross-sectional diagram in FIG. 3.

Figure 2:
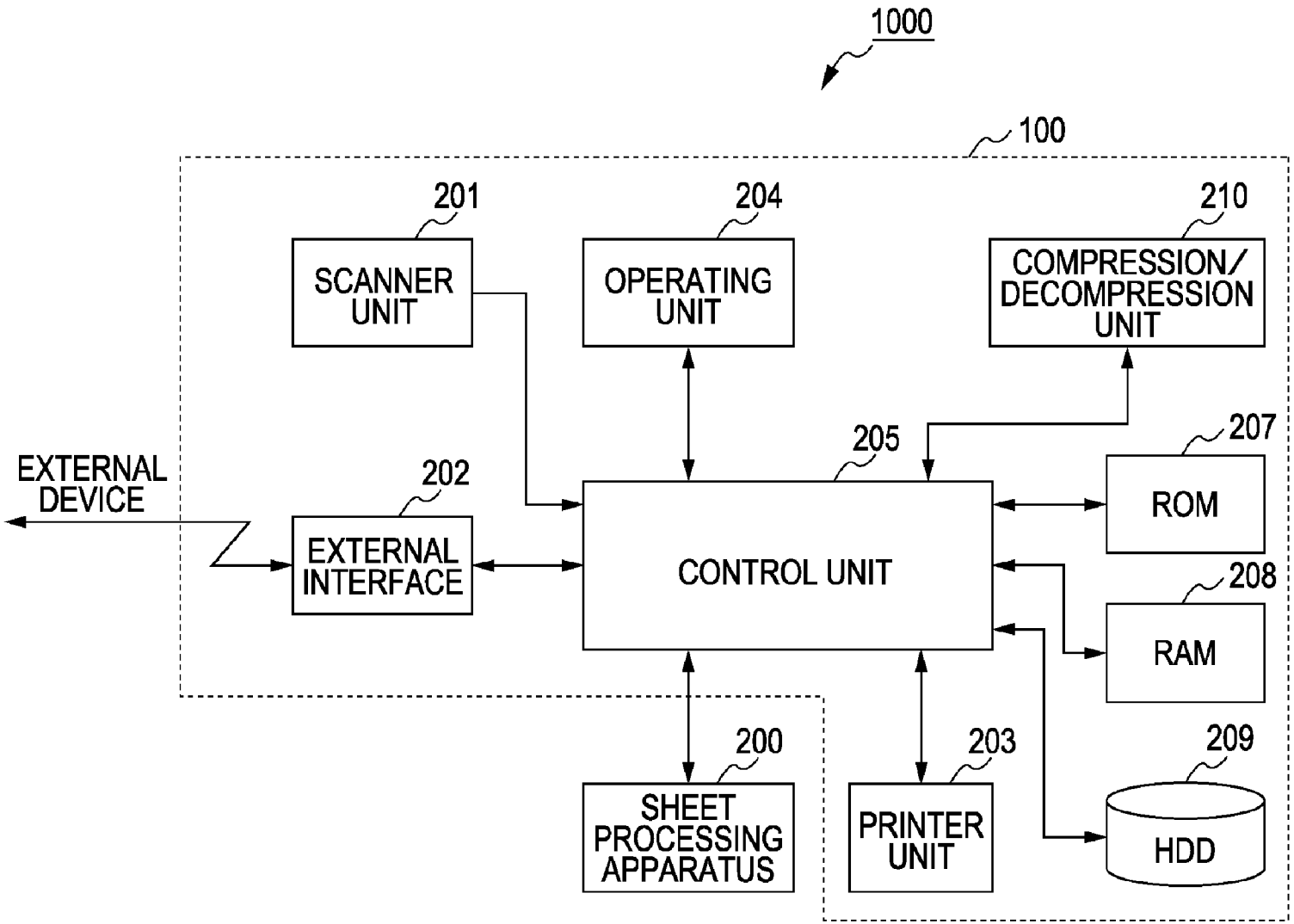
FIG. 2 is a diagram to describe a configuration example of the printing system which is subject to control by an embodiment.

Note that with the printing system 1000, multiple in-line type sheet processing apparatuses 200 can be connected to the printing apparatus 100, as in FIG. 2. Also, the in-line type sheet processing apparatus which is connectable to the printing apparatus 100 can be connected to an arbitrary number of apparatuses under specified control such as connection sequence or the like.

Figure 3:
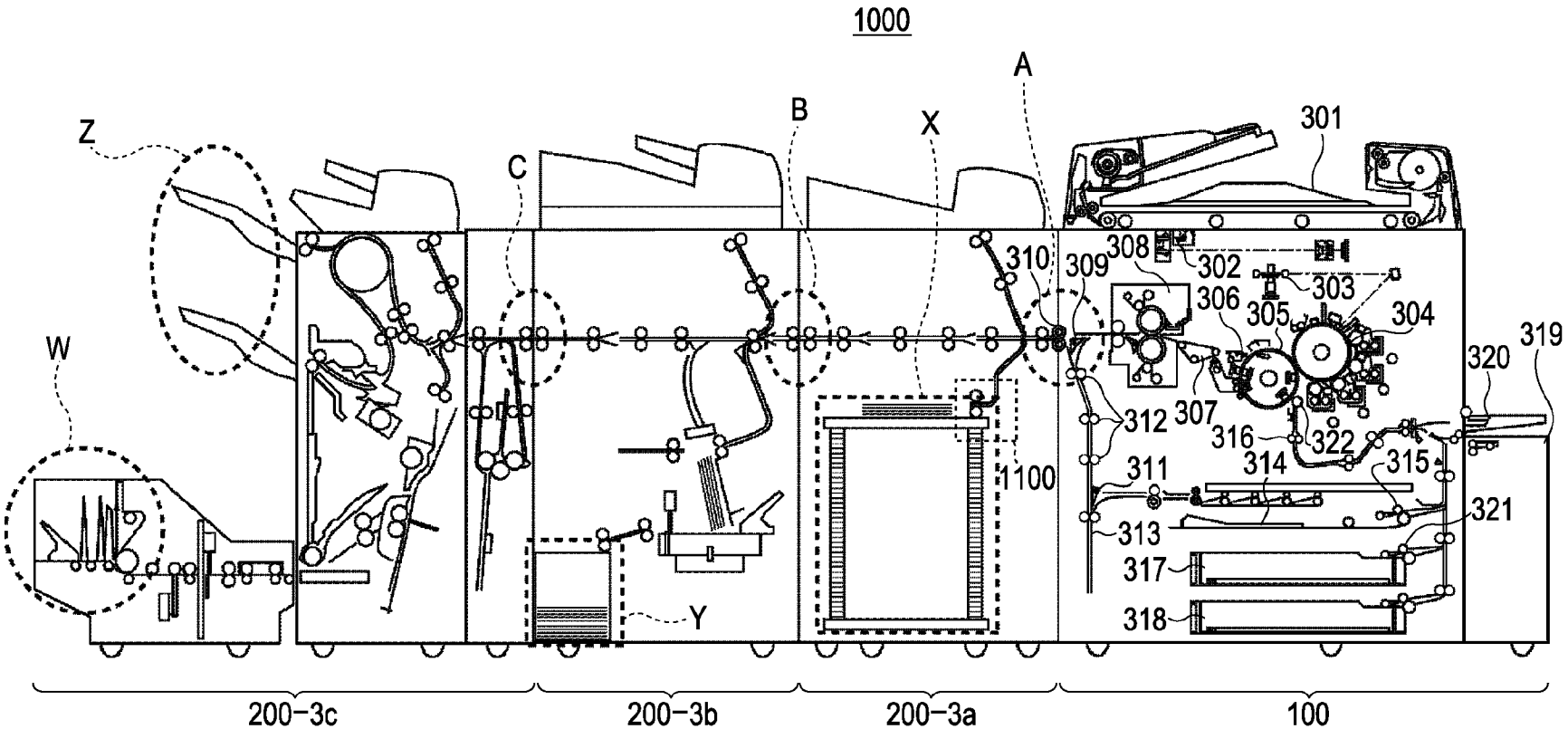
FIG. 3 is a diagram to describe a configuration example of the printing system which is subject to control by an embodiment.

According to an embodiment, as shown in FIG. 3, three sheet processing apparatuses 200 are connected to the printing apparatus 100. The illustrated apparatuses 200 are labeled sheet processing apparatuses 200-3*a*, 200-3*b*, 200-3*c* in sequence from the first sheet processing apparatus.

First, of the configuration of the printing system 1000, the configuration of the printing apparatus 100 will be described. Note that of the reference numerals 301 through 322 shown in FIG. 3, 301 applies to the scanner unit 201 shown in FIG. 2. Also, the reference numerals 302 through 322 apply to the printer unit 203 shown in FIG. 2. Note that with an embodiment, a case is described wherein the printing apparatus 100 is a 1D type of color MFP. Note that the printing apparatus 100 is not limited to this, and may be a 4D type of color MFP or a monochrome MFP.

An automatic document conveying apparatus (ADF) 301 in FIG. 3 separates the bundle of documents set on the loading (or stacking) face of the document tray from the first page in page order, and conveys these to a platen glass. The scanner 302 reads the image on the document conveyed to the platen glass, and converts this to image data with a CCD. A rotatable polygon mirror 303 causes light rays such as a laser light for example, which is modulated according to the image data, and irradiates this into a photosensitive drum 304 as reflective scanning light via a reflecting mirror. A latent image formed on the photosensitive drum 304 by the laser light is developed by toner, and the toner image is transferred to a sheet pasted on a transfer drum 305. A full-color image is formed by sequentially executing this string of image forming processes as to the toner for yellow (Y), magenta (M), cyan (C), and black (K). Following the four image-forming processes, the sheet material on the transfer drum 305 whereupon the full-color image is formed is separated with a separating claw 306 and are conveyed to a fusing unit 308 by a pre-fusing conveying unit 307.

The fusing unit 308 is made up of a combination of rollers and belts, has an internal heat source such as a halogen heater which causes the toner on the sheet material whereupon a toner image is formed to melt by heat and pressure, and thus fuse. A discharge flapper 309 is configured so as to be swingable around a swinging axis, and determines the conveying direction of the sheets. When the discharge flapper 309 is swinging in the clockwise direction in the diagram, the sheet material is conveyed in a straight manner and is discharged externally by a discharge roller 310. On the other hand, in the event of forming an image on both sides of the sheet, the discharge flapper 209 swings in the counter-clockwise direction in the diagram, and the sheet material is subjected to changing the advancing path thereof in the lower direction and is conveyed to a duplex conveying unit. The duplex conveying unit is made up of a reverse flapper 311, reverse roller 312, reverse guide 313, and duplex tray 314.

The reverse flapper 311 is configured so as to be swingable around a swinging axis, and determines the conveying direction of the sheets. In the case that a duplex printing job is to be processed, the control unit 205 performs control so that the reverse flapper 311 swings in the counter-clockwise direction in the diagram and a sheet having been subjected to printing on the first face at the printer unit 203 is conveyed to the reverse guide 313 via the reverse roller 312. In a state wherein the trailing edge of the sheet material is gripped by the reverse roller 312, the reverse roller 312 is temporarily stopped, following which the reverse flapper 311 swings in the clockwise direction in the diagram. Additionally, the reverse roller 312 is rotated in the reverse direction. Thus, the sheet is conveyed in a switch-back manner, and control is performed to guide the sheet to the duplex tray 314 while the sheet is in a state of the trailing edge and the leading edge having switched positions.

The sheet is temporarily stacked on the duplex tray 314, following which the sheet is conveyed again to the register roller 316 with a resupply roller 315. At this time the sheet is conveyed with the face on the opposite side from the first face transfer process facing the photosensitive drum. Similar to the above-described process, the second face image is formed on the second face of the sheet. An image is thus formed on both faces of the sheet, following which the sheet is subjected to the fusing process and is discharged externally from the printing apparatus main unit, via the discharge roller 310. The control unit 205 executes a string of duplex printing sequence such as that described above, whereby duplex printing is executed as to both faces of the first face and second face of the sheet with the printing apparatus 100.

A supply sheet conveying unit may be a supply sheet cassette 317 or 318 serving as a paper supply unit storing sheet necessary for printing processing (each with a 500-sheet storage capacity), a paper deck 319 (having a 5000-sheet storage capacity), a manual feed tray 320, or the like. Also, as units to supply the sheets stored in these paper supply units, there may be a supply sheet roller 321, register roller 316, and so forth. The supply sheet cassettes 317 and 318 and the paper deck 319 are configured so as to distinguish the sheets by various size and material for each paper supply unit, and sheets can be set therein.

Next, the configuration of an in-line type sheet processing apparatus 200 provided to the printing system 1000 will be described. The sheets subjected to printing with the printing apparatus 100 and discharged via the discharge roller 310 are conveyed through a sheet conveying path to a large-capacity stacker 200-3*a*, an adhesive binding apparatus 200-3*b*, or a saddle-stitching apparatus 200-3*c*.

The large-capacity stacker 200-3*a* receives the sheets subjected to printing with the printing apparatus 100 via a sheet conveying path, and stacks the received sheets in large amounts on a cart provided to the large-capacity stacker 200-3*a*. Note that the detailed configuration of the large-capacity stacker 200-3*a* will be described later.

The adhesive binding apparatus 200-3*b* receives the sheets subjected to printing with the printing apparatus 100 from the large-capacity stacker 200-3*a* via a sheet conveying path, and performs adhesive binding processing as to the received sheets.

The saddle-stitching apparatus 200-3*c* receives the sheets subjected to printing with the printing apparatus 100 from the adhesive binding apparatus 200-3*b* via a sheet conveying path, and performs saddle-stitch binding processing as to the received sheets.

Note that the various sheet processing apparatuses described above have individual discharge units. The operator can remove the sheets subjected to sheet processing by the various sheet processing apparatuses from the individually provided discharge units. Also, the connection order of the above-described sheet processing apparatuses is changeable in an arbitrary order with the condition that the sheet conveying path is linked.

[Configuration of Operating Unit 204 of Printing System 1000]

The operating unit 204 which is provided to the printing system 1000 will be described with reference to FIG. 4. The operating unit 204 has a key input unit 402 configured with hard keys and a touch panel unit 401 configured with soft keys (display keys). The operating unit 204 can receive instructions from the user with the key input unit 402 or the touch panel unit 401.

First, the key input unit 402 will be described. The key input unit 402 has a power switch 501, stop key 502, start key 503, and so forth. The power key 501 is a key for switching between ON and OFF of the power source. The start key 503 is a key for receiving instructions from the user to start the job processing such as copying or data transmission or the like with the printing apparatus 100. The stop key 502 is a key for receiving instructions from the user for the printing apparatus 100 to interrupt the received job processing. The ten key 506 is a key for receiving settings such as number of copies to be printed or various numerical values regarding the copy job from the user. A user mode key 505 is a key for displaying a system setting screen for each user on a touch panel unit 401.

Next, the touch panel unit (hereafter also called display unit) 401 shown in FIG. 4 will be described. The touch panel unit 401 is made up of an LCD (Liquid Crystal Display) and a transparent electrode adhered thereupon. The operator can perform various types of settings as to a job, via the touch panel unit 401.

For example, the touch panel unit 401 performs display to receive settings from the user for the sheet processing by the in-line type sheet processing apparatus 200, as settings for a job to be processed.

Figure 5:
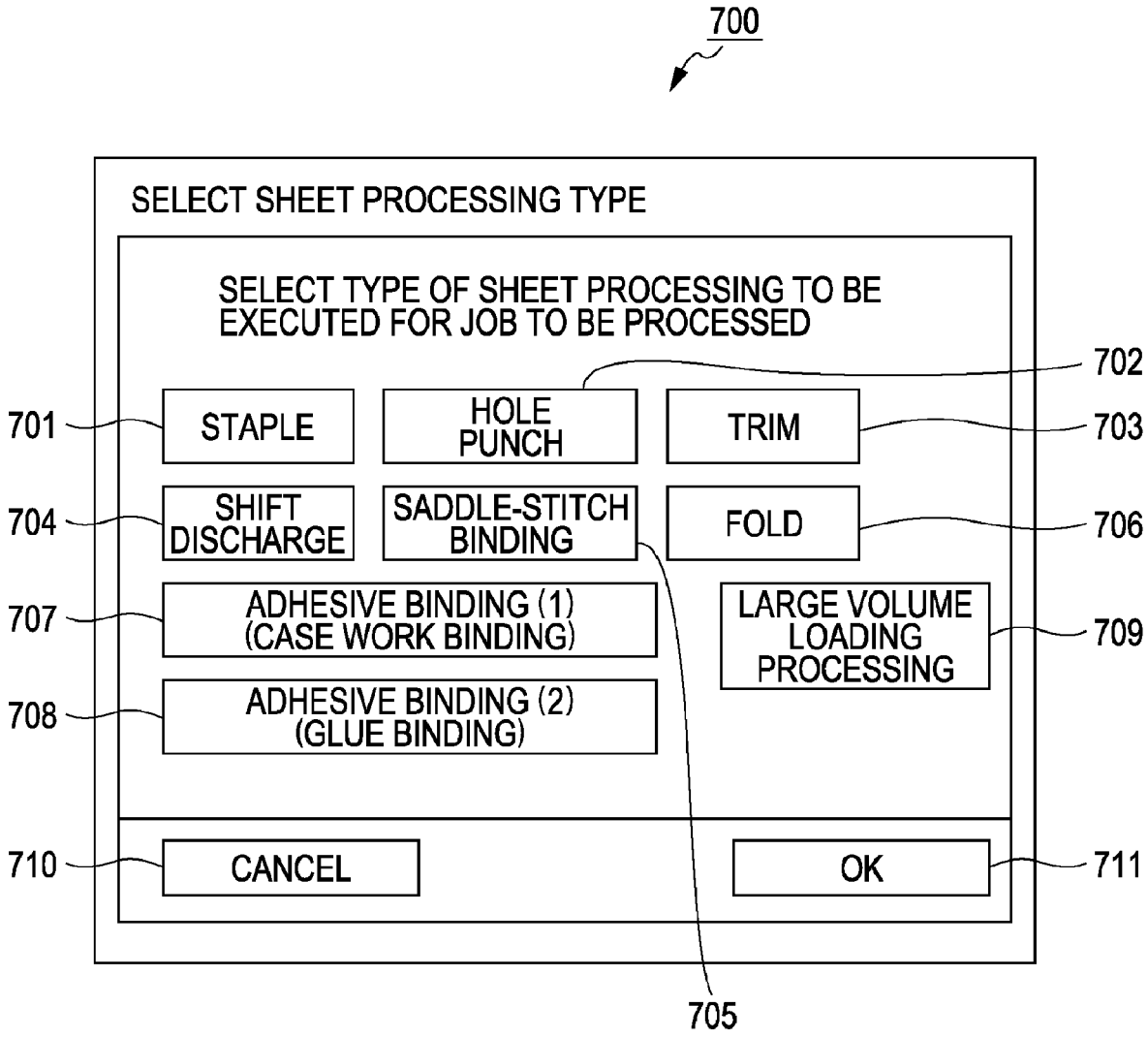
FIG. 5 is a diagram to describe one example of a UI portion of the printing system which is subject to control by an embodiment.

For example, with the present example, in response to a sheet processing setting key 609 being pressed by a user, the control unit 205 displays the screen in FIG. 5 on the touch panel unit 401. The control unit 205 receives the settings for the sheet processing to be executed by the in-line type sheet processing apparatus 200, via the display 700 in FIG. 5.

In the case of the start key 503 being pressed in a state wherein a staple key 701 is selected via the screen in FIG. 5, the control unit 205 performs control so that the saddle-stitching apparatus executes staple processing of the sheets subjected to printing at the printing apparatus 100.

In the case of the start key 503 being pressed in a state wherein a staple key 702 is selected via the screen in FIG. 5, the control unit 205 performs control so that the saddle-stitching apparatus executes hole punch process of the sheets subjected to printing at the printing apparatus 100.

In the case of the start key 503 being pressed in a state wherein a staple key 703 is selected via the screen in FIG. 5, the control unit 205 performs control so that the saddle-stitching apparatus executes trimming process of the sheets subjected to printing at the printing apparatus 100.

In the case of the start key 503 being pressed in a state wherein a staple key 704 is selected via the screen in FIG. 5, the control unit 205 performs control so that the large-capacity stacker or the saddle-stitching apparatus executes shift discharge process of the sheets subjected to printing at the printing apparatus 100.

In the case of the start key 503 being pressed in a state wherein a staple key 705 is selected via the screen in FIG. 5, the control unit 205 performs control so that the saddle-stitching apparatus executes saddle-stitch binding process of the sheets subjected to printing at the printing apparatus 100.

In the case of the start key 503 being pressed in a state wherein a staple key 706 is selected via the screen in FIG. 5, the control unit 205 performs control so that the saddle-stitching apparatus executes folding process of the sheets subjected to printing at the printing apparatus 100.

In the case of the start key 503 being pressed in a state wherein a staple key 707 is selected via the screen in FIG. 5, the control unit 205 performs control so that the adhesive binding apparatus executes case work binding process of the sheets subjected to printing at the printing apparatus 100.

In the case of the start key 503 being pressed in a state wherein a staple key 708 is selected via the screen in FIG. 5, the control unit 205 performs control so that the adhesive binding apparatus executes glue binding process of the sheets subjected to printing at the printing apparatus 100.

In the case of the start key 503 being pressed in a state wherein a large-amount stacking processing key 709 is selected via the screen in FIG. 5, the control unit 205 performs control so that the large-capacity stacker executes large-amount stacking processing of the sheets subjected to printing at the printing apparatus 100.

However, of the keys 701 through 709 which are shown in FIG. 5, depending on the configuration of the printing system 1000, some sheet processing may not be executable. The control unit 205 displays only the keys showing executable sheet processing in a state of being selectable by the operator, based on the configuration of the printing system 1000.

Note that the printing system 1000 can receive executing requests for a job from an information processing apparatus external to the PC 103, PC 104, and so forth, and can receive executing requests for the sheet processing to be performed for the jobs. Thus, in the case of inputting jobs from the external information processing apparatus, the control unit of the information processing apparatus executes display similar to the display in FIG. 5 on the display unit of the information processing apparatus.

[Internal Configuration of Large-Capacity Stacker]

Next, the configuration of the large-capacity stacker 200-3*a* will be described with reference to the cross-sectional diagram in FIG. 6 and the external perspective view in FIG. 7. As shown in FIG. 7, the large-capacity stacker 200-3*a* has a front door 2002 and a switch 2001 for opening the front door 2002. The large-capacity stacker 200-3*a* has a control unit whereby the front door 2002 is opened when the switch 2001 is pressed by the operator. Thus, the operator can remove the printed material which is stacked on the stacking stray within the large-capacity stacker 200-3*a*. Also, the control unit of the large-capacity stacker 200-3*a* controls the following sheets from being discharged into the stacking tray of the large-capacity stacker 200-3*a* during the time that printed material is being removed. Note that these controls may be performed by the control unit 205 of the printing apparatus 100.

Figure 6:
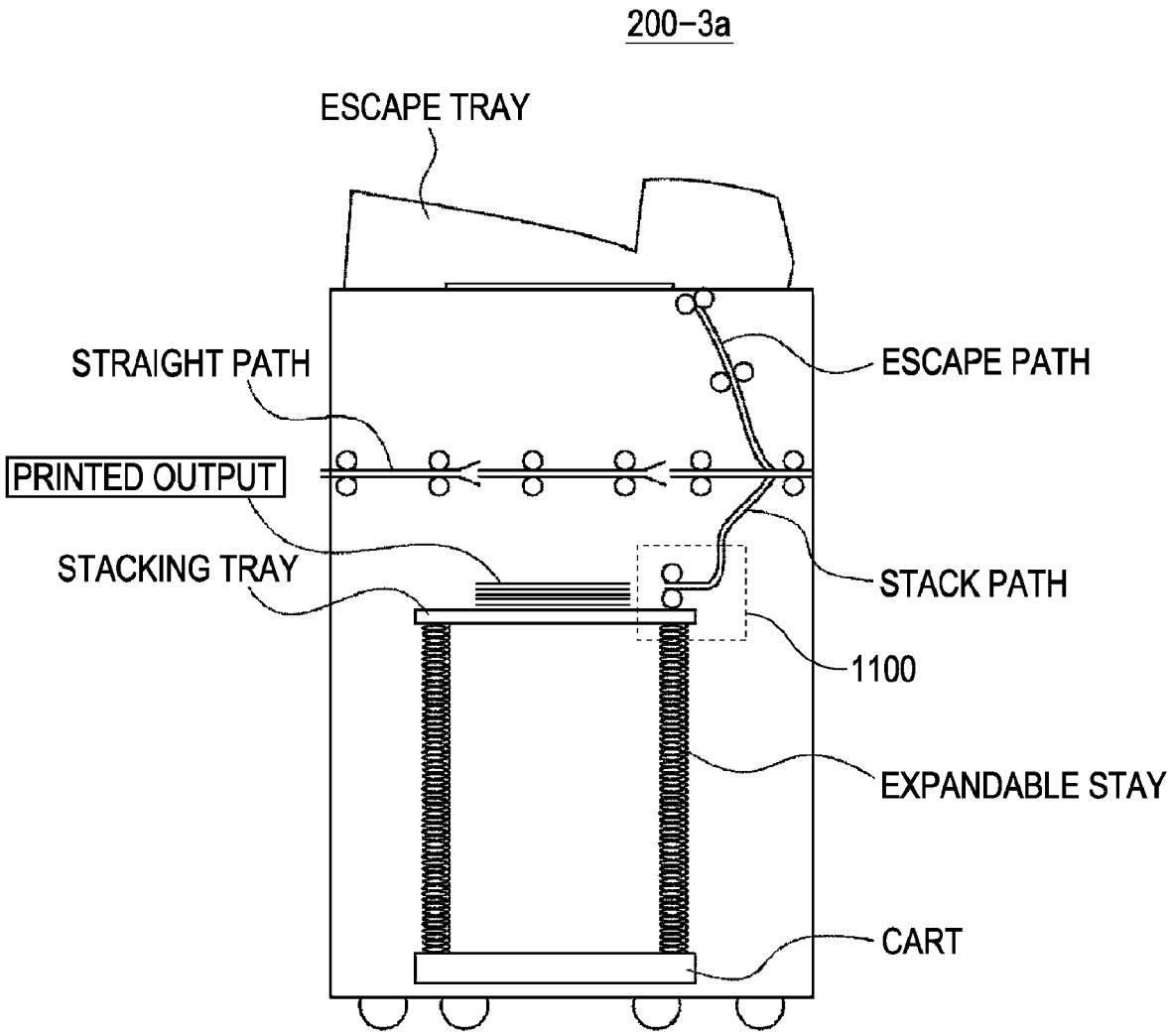
FIG. 6 is a diagram to describe a configuration relating to a large-capacity stacker which is subject to control by an embodiment.
Figure 7:
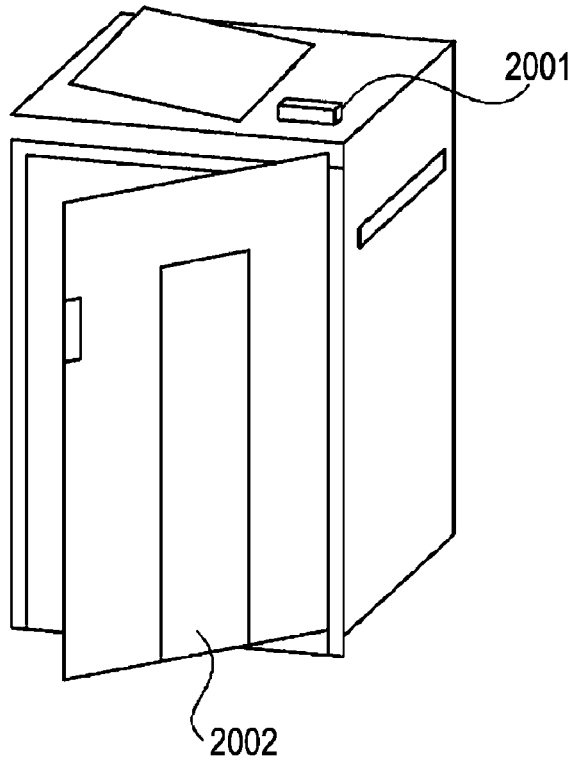
FIG. 7 is a diagram to describe a configuration relating to the large-capacity stacker of an embodiment.
Figure 8:
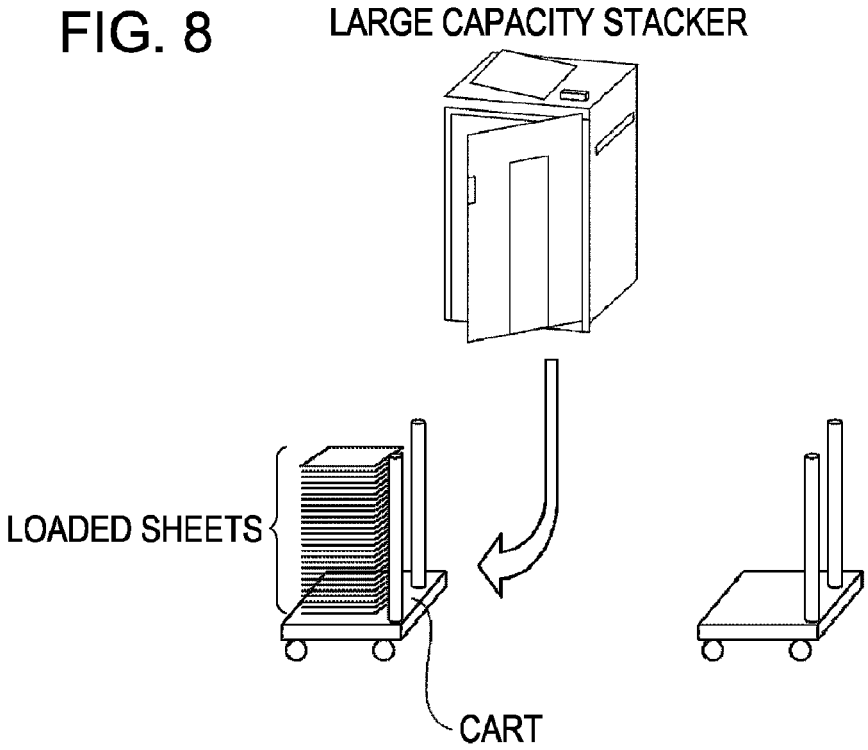
FIG. 8 is a diagram to describe a configuration relating to the large-capacity stacker of an embodiment.

Also, the large-capacity stacker 200-3*a* internally has three sheet conveying paths as sheet conveying paths from the printing apparatus 100, as shown in FIG. 6. One is a straight path, one is an escape path, and one is a stacking path.

The straight path is a sheet conveying path for conveying the sheets of a job not requiring large-amount stacking processing for sheets by the stacking unit provided to the large capacity stacker 200-3*a* to a later-stage sheet processing apparatus. The escape path is employed in the case when outputting the sheets without stacking to the stacking unit is desirable. For example, the escape path may be employed as a discharge destination in the case of performing confirmation of printed materials. The stacking path is a sheet conveying path employed for stacking the sheets to the stacking unit provided to the large-capacity stacker 200-3*a*.

For example, in a case that instructions are performed for the job to be executed in a state wherein the key 709 shown in FIG. 5 is selected, the control unit 205 performs control so as to convey the sheets conveyed from the printing apparatus 100 to a stacking path. The sheets conveyed to the stacking path are discharged to the stacking tray.

The stacking tray in FIG. 6 is a stacking unit which is mounted on a compressible stay or the like. The control unit 205 causes the large-capacity stacker to execute large-amount stacking processing by stacking the sheets subjected to printing on the stacking tray. Under the compressible stay is a cart, and by attaching an unshown handle thereto, making this a cart, the sheets stacked on the stacking tray can be conveyed to a separate on-line finisher or the like.

Also, when the front door 2002 of the stacking unit is closed, the control unit 205 raises the position of the stacking tray to a position where the sheets conveyed thereto via the stacking path can be easily stacked by a compressible stay. On the other hand, when the front door is opened by the operator (or if opening instructions are given by the operator), the control unit 205 lowers the stacking tray.

Also, the sheets to be stacked on the stacking tray can be stacked with two types of stacking methods by the control unit 205, which are flat stacking and shifted stacking. The flat stacking is a stacking method to stack the sheets continually in the same position. Shifted stacking is a stacking method for shifting the sheets for every predetermined unit (in increments of copies, or in increments of jobs) in the rear or front directions. In the case of shifted stacking, the sheets to be stacked are stacked while divided by predetermined units, whereby there is the advantage of ease of separating the stacked sheets.

Also, the control unit 205 executes bundle discharge processing or between-job shifting processing which is to be exemplified below, for example, with the configuration shown in FIGS. 9 and 10 of the large-capacity stacker. Note that the stack control mechanism 1100 shown in FIG. 9 corresponds to the stack control mechanism 1100 shown in FIG. 6. Also, FIG. 10 is a diagram viewing the configuration of the stack control mechanism 1100 shown in FIG. 6 or FIG. 9 from another perspective.

For example, the control unit 205 performs controls described below by employing the configuration shown in FIG. 9. The control unit 205 executes a job, and conveys the sheets subjected to printing with the printing apparatus 100 to a stacking path 2101 within the large-capacity stacker 200-3*a*. Following this, the control unit 205 temporarily stacks the sheets subjected to printing on a processing tray 2102 within the large-capacity stacker.

Upon stacking all of the sheets discharged by executing the job on the processing tray 2102, the control unit 205 discharges the sheet bundle of the stacked job onto the stacking tray of the large-capacity stacker. Thus, the discharge processing to be performed in increments of sheet bundles made up of multiple sheets is called bundle discharge processing.

An example of a case wherein a total of four sheets is employed to complete the printing of a certain job will be described below. In this case, upon executing the job, following the control unit 205 discharging a total of four sheets of the sheets P1 through P4 to the processing tray, these sheets are discharged onto the stacking tray of the large-capacity stacker as a sheet bundle.

This control will be described in greater detail. First, the control unit 205 causes the printer unit 203 of the printing apparatus 100 to print the first sheet (P1), second sheet (P2), third sheet (P3), and fourth sheet (P4) of the sheet bundle of the job to be executed in this order. The control unit 205 then guides each sheet having been subjected to printing into the path 2101. The control unit 205 stacks the sheets P1 through P4 of the sheet bundle of the job on the processing tray 2102 in sequence from the first page, in a state wherein the side of the sheet whereupon an image is formed is placed face-down. In accordance with the fourth sheet P4 equating to the final sheet of the job being stacked on the processing tray 2102, the control unit 205 executes matching processing with a matching unit 2104 in order to neatly align the edges of the sheet bundle of the job. Thus, the sheets P1 through P4 included in the sheet bundle of the job becomes a single output bundle. Upon executing the matching processing by the matching unit 2104, the control unit 205 discharges the sheets P1 through P4 of the job, in the state of a single output bundle, onto the stacking tray of the large-capacity stacker by a push-out unit 2103. The control unit 205 executes bundle discharge processing with a procedure such as that described above.

Note that the control unit 205 can move the stacking tray of the large-capacity stacker in the vertical direction. Also, the control unit 205 lowers the stacking tray each time a predetermined number of sheets is stacked, and on the other hand, raises the stacking tray when sheets are removed from the stacking tray by the user. By performing such control, the control unit 205 can maintain a fixed distance between the discharge opening of the path 2101 of the large-capacity stacker and the stacking face of the sheets on the stacking tray. Thus, an unfavorable situation in which the stacking tray of the large-capacity stacker is at a height too high to stack sheets discharged from the path 2101 can be prevented. Also, an unfavorable situation in which the stacking tray is at a height so low that the sheets discharged from the path 2101 become unstable can be prevented.

Also, in the case of executing the bundle discharge processing of a second sheet bundle following the bundle discharge processing of the first sheet bundle, as processing to divide the first sheet bundle and second sheet bundle, between-job shifting processing is executed. In other words, the control unit 205 performs control to discharge the first sheet bundle which is the printed material of a certain job and the second sheet bundle which is printed material of a job different from this job in a discharge position shifted from one another, on the stacking tray, as the aforementioned dividing processing. By the control unit 250 causing the large-capacity stacker to execute the between-job shifting processing, the operator can easily remove the discharged sheets by job.

This between-job shifting processing will be described with reference to FIG. 10, which is a configuration shown in the stack control mechanism 1100 in FIG. 9, as viewed from another perspective. The control unit 205 causes the between-job shifting processing to be performed employing the configuration shown in FIG. 10. Note that the processing tray 2102 exists on a sheet conveying path on the large-capacity stacker as shown in FIG. 10. The processing tray 2102 is shown with a dotted line to indicate that the processing tray 2102 exists within the apparatus in FIG. 10.

Also, the FIG. 10 shows the status during the processing of the job. Specifically, in a different job, this is the status after the sheet bundles of jobs whereupon printing processing have been executed in advance (hereafter called advance jobs) are stacked on the stacking tray of the large-capacity stacker by the control unit 205. The status is shown wherein the control unit 205 executes the job following the advance job (hereafter called following job), and the sheets of the following job is stacked on the processing tray 2102. Also, FIG. 10 shows the state of the control unit 205 executing the between-job shifting processing of the sheets of the following job with the processing tray 2102.

Figure 10:
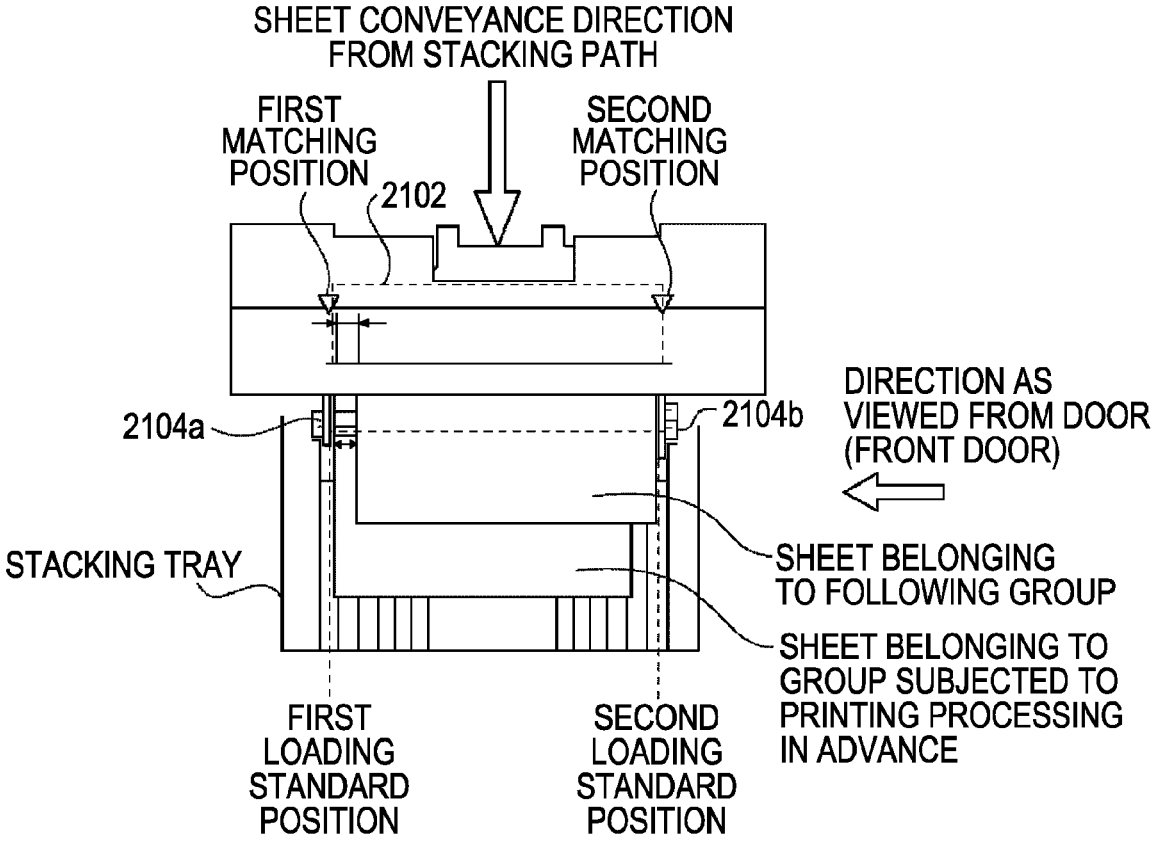
FIG. 10 is a diagram to describe the stack control mechanism of FIG. 9 as viewed from another perspective according to an embodiment.
Figure 11:
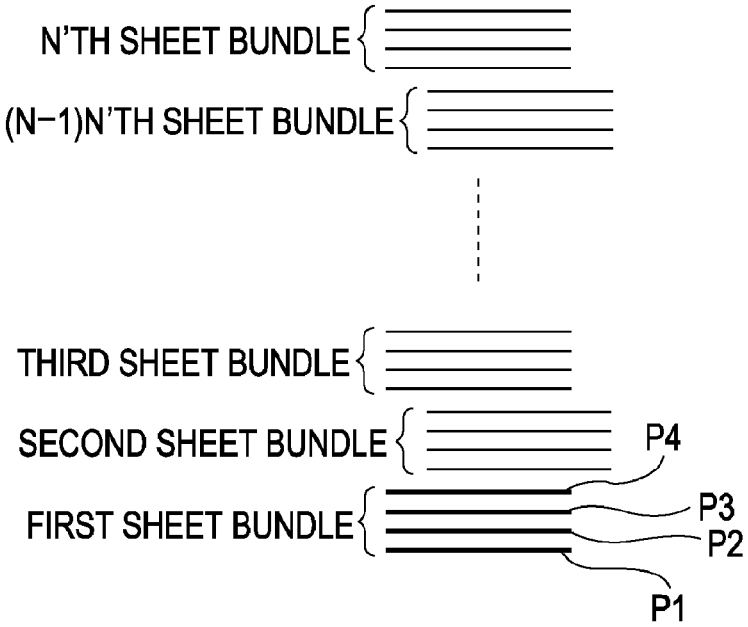
FIG. 11 is a diagram to describe an example of stacking sheet bundles according to an embodiment.

For example, let us say that the sheet bundle already stacked on the stacking tray of the large-capacity stacker shown in FIG. 10 is the first bundle of the sheet bundles shown in FIG. 11. In this case, the sheets stacked on the processing tray 2102 shown in FIG. 10 equate to the sheets of the second bundle in FIG. 11.

Figure 9:
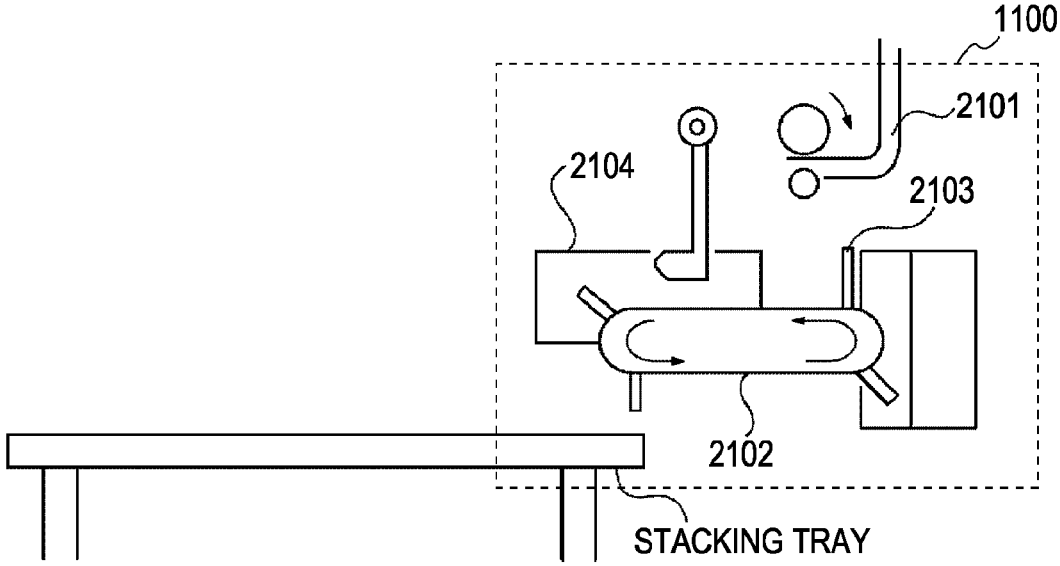
FIG. 9 is a diagram to describe an example of a stack control mechanism according to an embodiment.

The matching units 2104*a* and 2104*b* in FIG. 10 correspond to the matching unit in FIG. 9. The matching unit 2104*a* and 2104*b* can be moved in the perpendicular direction as to the sheet conveying direction shown in FIG. 10, and the control unit 205 can selectively move each of the matching units.

For example, the control unit 205 causes the first sheet bundle shown in FIG. 11 to match on the processing tray 2102 with the matching units 2104*a* and 2104*b*, so that the upper edge portion of the sheets of the sheet bundle align with the first matching position in FIG. 10. Let us say that the control unit 205 stacks the first sheet bundle subjected to matching processing on the processing tray 2102 with the first stacking position on the stacking tray as a standard position. In this case, the control unit 205 processes the second sheet bundle as follows.

First, the control unit 205 causes the matching operations for the sheets in the second bundle to be executed by the matching unit 2104 so that the lower edge portion of the sheets align with a second matching position. For example, the control unit 205 fixes the matching unit 2104*b* at the position shown in FIG. 10. The control unit 205 moves the matching unit 2104*a* to the matching unit 2104*b* side while maintaining this state, so that the lower edge portion of the second sheet bundle abuts against the matching unit 2104*b*. Thus, as shown in FIG. 10, the control unit 205 shifts the lower edge portion of the sheet bundle of the following job to the second matching position.

The control unit 205 then executes discharge of the sheet bundle from the processing tray 2102 to the stacking tray of the large-capacity stacker. Thus, the second sheet bundle can be stacked on the stacking tray while in the state of the lower edges of the sheets being aligned with the second stacking standard position.

By performing such processing, the control unit 205 can stack the second sheet bundle on the stacking tray in a state wherein the first sheet bundle and second sheet bundle are shifted a specified amount in the orthogonal direction as to the sheet conveying direction. If we say that this specified amount is, for example, 10 mm, the control unit 205 can stack the second sheet bundle on top of the first sheet bundle in a state wherein the first sheet bundle and second sheet bundle are shifted by 10 mm as to each other. Description has been given here regarding processing wherein the control unit 205 shifts the lower edge of the sheets of the second sheet bundle to the second matching position as to the first sheet bundle wherein the upper edge of the sheets are in the first matching position, whereby the first sheet bundle and second sheet bundle are in a state of being shifted by 10 mm. However, the processing to shift the second sheet bundle is not limited to this. For example, an arrangement may be made wherein the control unit 205 can perform control to stack the second sheet bundle which is stacked on the processing tray in a state of being shifted 5 mm from the first sheet bundle, by the matching units 2104*a* and 2104*b*. Also, an arrangement may be made wherein the control unit 205 can perform control to stack the second sheet bundle which is stacked on the processing tray in a state of being shifted 3 mm from the first sheet bundle, by the matching units 2104*a* and 2104*b*. Thus, as long as the control unit 205 can arrange the sheet bundle of the advance job and the sheet bundle of the following job to be dividable after stacking, the specifying amount is not limited to 10 mm or 5 mm or 3 mm.

In the case of processing a third sheet bundle equating to sheets of a job to be processed immediately following the second sheet bundle which is stacked with the second stacking standard position as the standard thereof, the control unit 205 executes the same bundle discharge processing as the processing performed for the first sheet bundle. That is to say, the control unit 205 controls the operations of the large-capacity stacker so that sheets are stacked on the stacking tray with the first stacking standard position as the standard thereof.

In the case of processing a fourth sheet bundle equating to sheets of a group to be processed immediately following the third sheet bundle which is stacked with the first stacking standard position as the standard thereof, the control unit 205 executes the same bundle discharge processing as the processing performed for the second sheet bundle. That is to say, the control unit 205 controls the operations of the large-capacity stacker so that sheets are stacked on the stacking tray in a position shifted toward the second stacking standard position only a specified amount from the second stacking standard position or first stacking standard position.

Thus, the control unit 205 performs between-job shifting processing by controlling the stacking position of sheets on the stacking tray back and forth for each processing of one job worth of sheet bundle.

Figure 12:
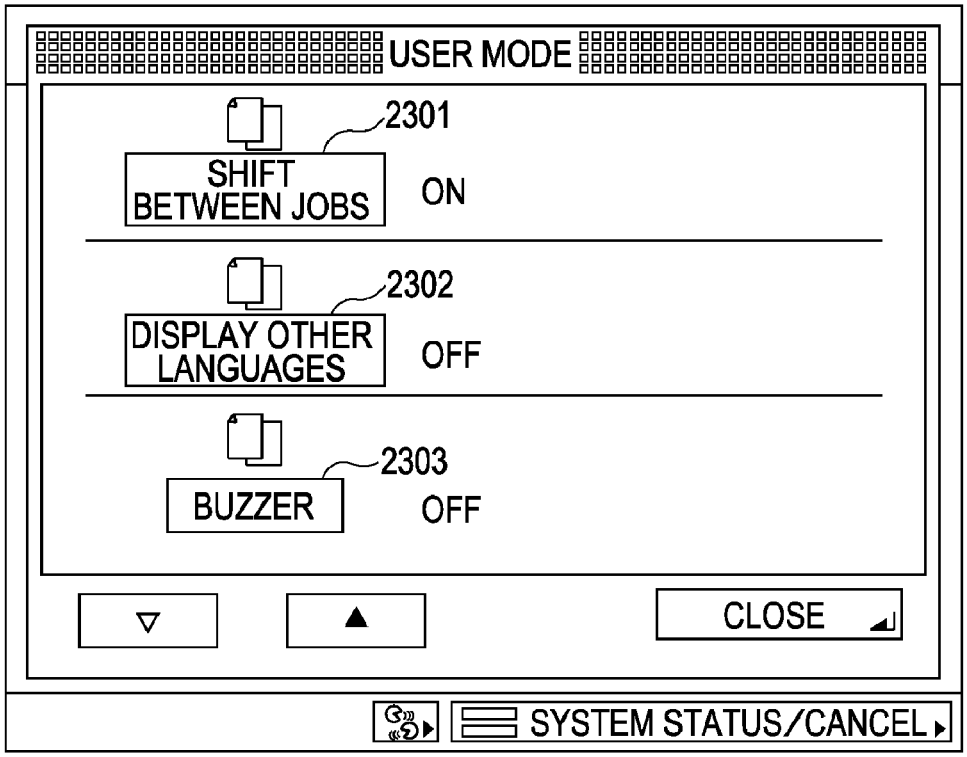
FIG. 12 is a diagram to describe a display control example as to a UI portion which is subject to control by an embodiment.

The operator can specify to execute the between-job shifting processing via the user mode screen. For example, if the operator presses the user mode key 505, the control unit 205 displays the user mode screen shown in FIG. 12 on the touch panel portion 401. By switching between ON/OFF of the between-job shifting button 2301 shown in FIG. 12, the operator can set whether or not the above-described between-job shifting processing is to be performed. By switching between ON/OFF of the display other languages button 2302 shown in FIG. 12, the operator can change a displayed language to another language. By switching between ON/OFF of the display other languages button 2303 shown in FIG. 12, the operator can set whether or not a buzzer sounds when error occurs. Note that the between-job shifting processing is set to be "ON" in a default state, i.e. the between-job shifting processing is set to be performed.

The saddle-stitch binding shown in FIG. 3 also has an arrangement to perform between-job shifting processing such as that described above, near the discharge opening where paper discharge is performed to the discharge portion of the saddle-stitch binding apparatus. In the event that the control unit 205 is set to perform between-job shifting processing by the between-job shifting button 2301, between-job shifting processing is also performed in the case of discharging sheets to the discharge portion of the saddle-stitch binding apparatus.

The control unit 205 has been described with an example to perform "between-job shifting processing" which shifts the sheet bundle for every job. However, the process is not limited to this, and the control unit 205 can also perform "between-copy shifting processing" to perform control of the stacking position of the sheets on the stacking tray for every copy. With the description hereafter, "between-job shifting processing" and "between-copy shifting processing" will be all called "shifting processing".

Next, stacking patterns for stacking sheet by performing between-job shifting processing will be described with reference to FIG. 13.

(Stacking Pattern 1)

The control unit 205 stacks a sheet bundle 2400*a* made up of 200 sheets such as that shown in FIG. 13B on the stacking tray of the large-capacity stacker or the stacking tray of the saddle-stitch binding apparatus, such as that shown in FIG. 13A. Following this, the control unit 205 stacks a sheet bundle 2400*b* made up of 300 sheets on top of the sheet bundle 2400*a* in a state shifted from the stacking position of the sheets in the sheet bundle 2400*a*, as shown in FIG. 13C.

(Stacking Pattern 2)

The control unit 205 stacks a sheet bundle 2401*a* made up of 200 sheets such as that shown in FIG. 14B on the stacking tray of the large-capacity stacker or the stacking tray of the saddle-stitch binding apparatus, such as that shown in FIG. 14A. Following this, the control unit 205 stacks a sheet bundle 2401*b* made up of 2500 sheets on top of the sheet bundle 2401*a* in a state shifted from the stacking position of the sheets in the sheet bundle 2401*a*, as shown in FIG. 14C.

(Stacking Pattern 3)

The control unit 205 stacks a sheet bundle 2402*a* made up of 1500 sheets such as that shown in FIG. 15B on the stacking tray of the large-capacity stacker or the stacking tray of the saddle-stitch binding apparatus, such as that shown in FIG. 15A. Following this, the control unit 205 stacks a sheet bundle 2402*b* made up of 300 sheets on top of the sheet bundle 2402*a* in a state shifted from the stacking position of the sheets in the sheet bundle 2402*a*, as shown in FIG. 15C.

(Stacking Pattern 4)

The control unit 205 stacks a sheet bundle 2403*a* made up of 1500 sheets such as that shown in FIG. 16B on the stacking tray of the large-capacity stacker or the stacking tray of the saddle-stitch binding apparatus, such as that shown in FIG. 16A. Following this, the control unit 205 stacks a sheet bundle 2403*b* made up of 3000 sheets on top of the sheet bundle 2403*a* in a state shifted from the stacking position of the sheets in the sheet bundle 2403*a*, as shown in FIG. 16C.

Note that the reference numerals 2400*a* through 2403*a* and 2400*b* through 2403*b* in FIG. 13 through FIG. 16, each denote a sheet bundle for one job. In the case of stacking sheet bundles in the discharge portion Z of the saddle-stitch binding apparatus, there is a low probability of the stacked sheets falling over, regardless of which stacking pattern of the above stacking patterns 1 through 4 are used to stack the sheets. The reason for this is that in the case of stacking the sheets onto the stacking tray of the discharge destination Z, the control unit 205 performs shifting within a range of sheets stackable on the stacking tray and also with a shift width in an amount so as not to lose the stability of the stacked sheets.

On the other hand, the large-capacity stacking tray differs from the stacking tray of the saddle-stitch binding apparatus as shown by the discharge destination Z with the following point.

In the case of sheets stacked on the stacking tray of the large-capacity stacker, a case may be assumed wherein the operator transports the sheets employing a cart. In this case, the sheets stacked on the stacking tray on the card can conceivably be subjected to wobbling or shock while transporting. Accordingly, in the case of stacking sheets onto a stacking tray on the large-capacity stacker, depending on the stacking pattern, the sheets stacked on the stacking tray may easily fall over from wobbling or shock in the event of being transported by cart.

For example, of the stacking patterns shown in FIG. 13C, FIG. 14C, FIG. 15C, and FIG. 16C, in the case of the stacking patterns shown in FIG. 14C and FIG. 16C, these are thought that the stacked sheets will more easily fall over from wobbling or shock in the event of being transported by cart.

Therefore, the control unit 205 which is an example of the control unit according to the present embodiment executes control to be described below with the printing system 1000 such as that above. Thus, in the event of the operator transporting the sheets stacked on the stacking tray with a cart, the possibility for the stacked sheets to be in an unstable state is diminished.

Therefore, the control unit 205 which is an example of the control unit according to the present embodiment performs control such as the following in the event that between-job shifting processing has been set with the above-described between-job shifting button 2301, for example.

The control unit 205 performs control relating to sheet discharge, based on a management table as shown in FIG. 17, which is stored in the HDD 209. For example, the control unit 205 performs control so that the maximum capacity number of sheets at the discharge destination is not exceeded, based on the maximum capacity number of sheets shown in the restriction item 1 in FIG. 17.

For example, in the case that the saddle-stitch binding apparatus is specified as the discharge destination serving as the discharge destination for the job to be processed, the control unit 205 performs the following control. Upon stacking sheets to be discharged on the stacking tray of the saddle-stitch binding apparatus in the event of executing a job, the control unit 205 determines whether or not the maximum stack capacity number of sheets on the stacking tray of the saddle-stitch binding apparatus is exceeded or not by referencing the restriction item 1 column of the saddle-stitch binding apparatus in FIG. 17.

Thus, in the case that the control unit 205 obtains information that the maximum stack capacity number of sheets of the saddle-stitch binding apparatus is 4000 sheets, the control unit 205 determines whether or not the sheets stacked on the stacking tray of the saddle-stitch binding apparatus exceeds 4000 sheets in the event of the sheet bundle of the job to be processed being stacked. Upon determining that the stacked sheets are less than 4000 sheets, the control unit 205 discharges the sheets of the job onto the stacking tray of the saddle-stitching apparatus, as specified by the operator. On the other hand, upon determining that the stacked sheets exceed 4000 sheets, the control unit 205 switches the discharge destination of the sheets of the job to a discharge destination which is different that the stacking tray of the saddle-stitch binding apparatus.

In the case that the discharge destination of the sheets is the large-capacity stacker, the control unit 205 obtains information that the maximum stack capacity number of sheets of the large-capacity stacker is 5000 sheets. As a result of discharging the sheets of the job to be discharged, the control unit 205 determines whether or not the sheets stacked on the stacking tray of the large-capacity stacker exceeds 5000 sheets. In the case of determining that the stacked sheets are less than 5000 sheets, the control unit 205 discharges the sheets of the job onto the stacking tray of the large-capacity stacker, as specified by the operator. On the other hand, upon determining that the stacked sheets exceed 5000 sheets, the control unit 205 switches the output destination of the sheets of the job to an output destination which is different that the stacking tray of the large-capacity stacker.

Also, the control unit 205 performs control to prevent in advance the stacked sheets from becoming in an unstable state, based on the restriction item 2 in the management table in FIG. 17.

Figures 18, 18A:
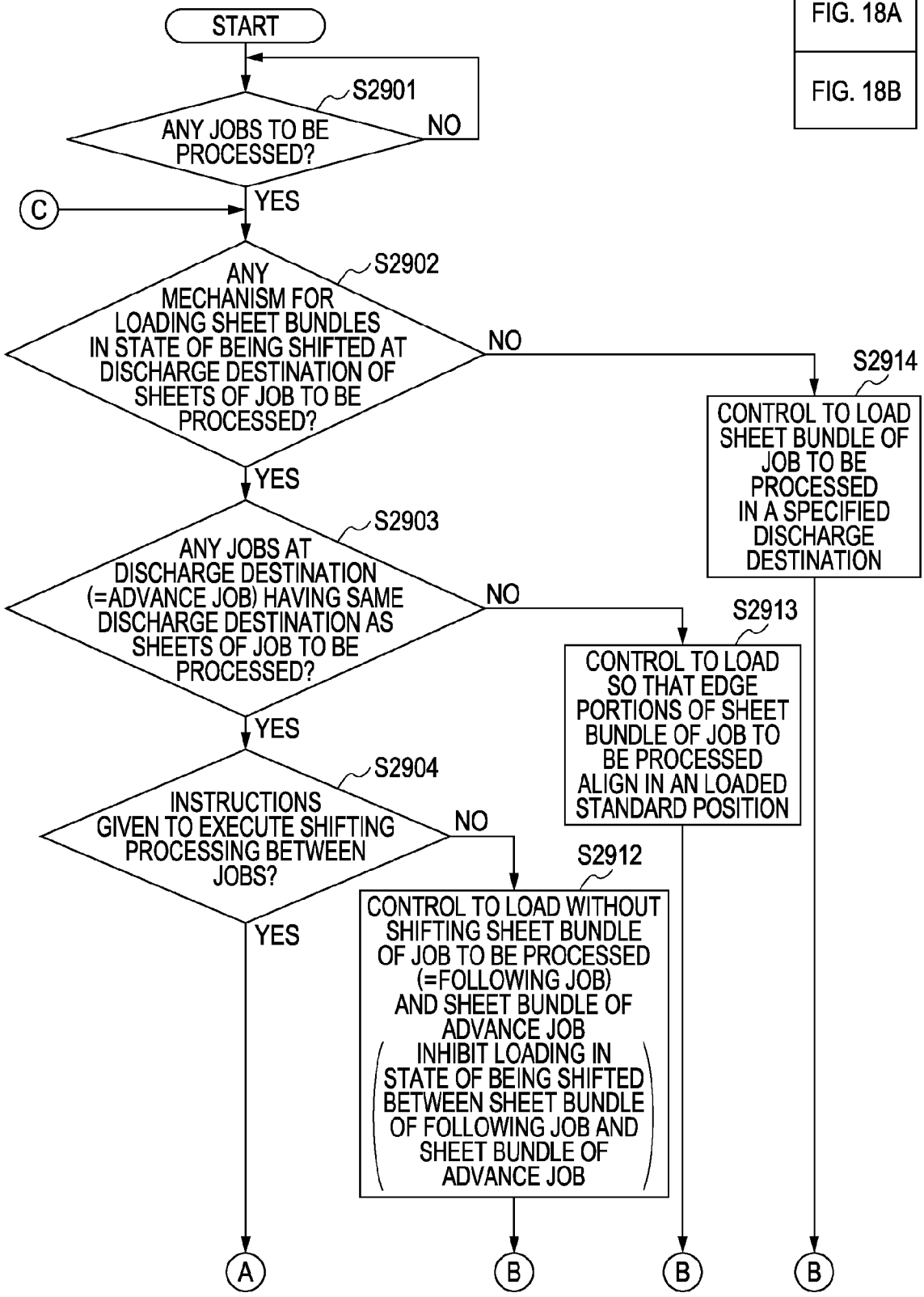
FIG. 18 is a flowchart to describe control relating to the shifting processing of an embodiment.
Figure 18B:
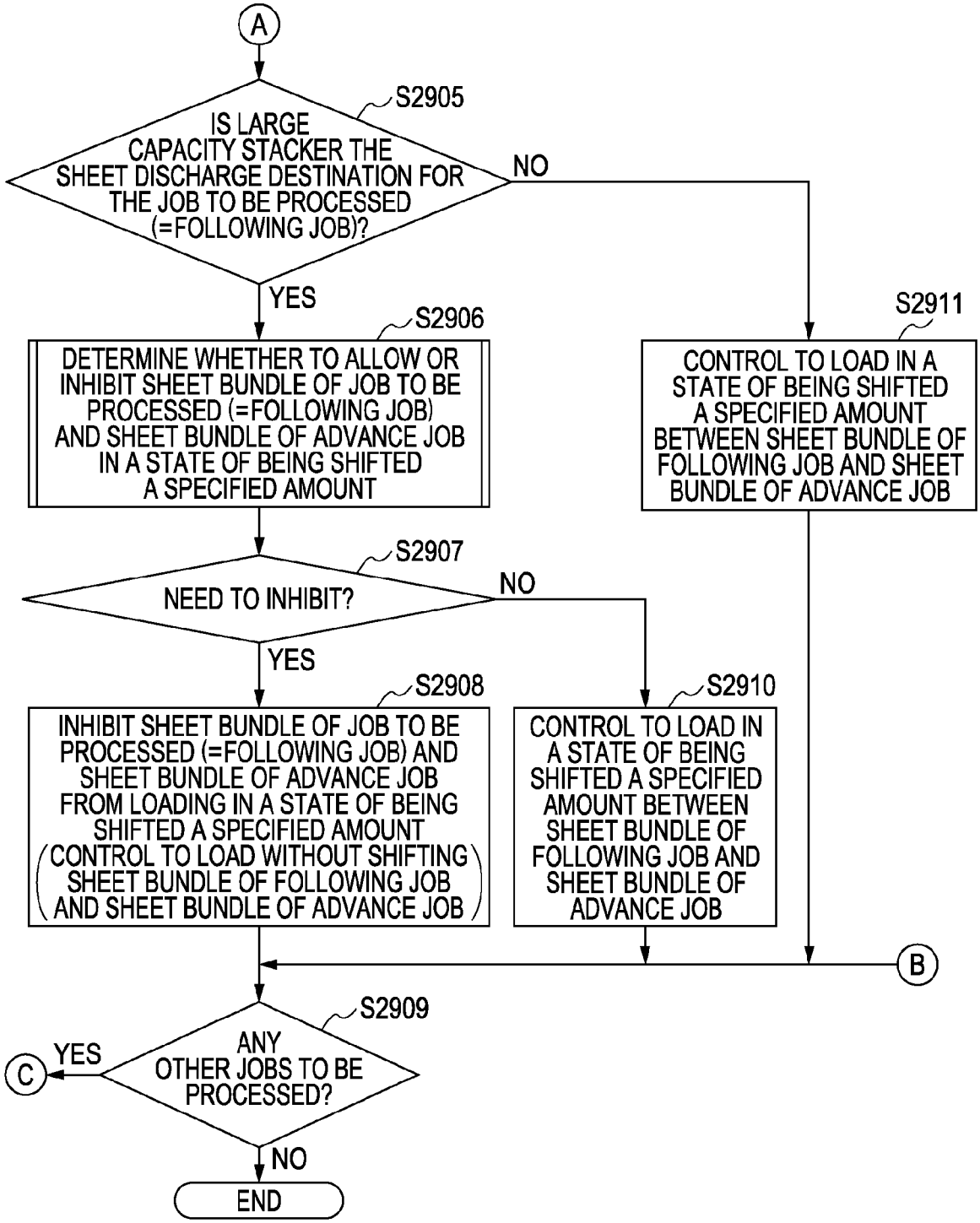

FIG. 18 is a flowchart showing an example of control to prevent in advance the stacked sheets from becoming in an unstable state with a printing system relating to the present invention.

After power has been turned on, or in the case that the printing apparatus 100 receives a job with a printing executing request, the control unit 205 starts the control shown in the flowchart in FIG. 18.

First, in step S2901 in FIG. 18, the control unit 205 determines whether or not a job to be processed exists. A job to be processed is a job wherein a printing request is made by the operating unit 204 or an external information processing apparatus, and is awaiting executing while stored in the HDD 209. Also, the control unit 205 also receives processing condition data of the job which is set via the operating unit 204 or an external information processing apparatus along with the printing request, and stores this in the HDD 209 in correlation to the printing data. This processing condition data includes number of pages, printing size enlarging/reduction and printing layout, types of sheets, size of sheets, single side/duplex printing settings, and so forth. Also, the processing condition data includes information relating to types of sheet processing to be executed and information relating to the discharge destination of sheets to be subjected to printing. Note that the information relating to a discharge destination may be directly set by the user for each job, or may be set by the control unit 205 as to the types of the sheet processing set for the job by the operator.

On the other hand, in the case that the job subjected to a printing request does not exist within the HDD 209, the control unit 205 determines that a job to be processed does not exist, and repeats the processing in step S2901. Following this, in the case that the job subjected to a printing executing request is received, the control unit 205 determines that a job to be processed exists, and advances to step S2902.

In step S2902, the control unit 205 determines whether or not the discharge destination of the job to be processed is a discharge destination having a mechanism for stacking the sheet bundles in a shifted state. Specifically, the control unit 205 determines the processing condition data stored in the HDD 209 referencing the discharge destination information of the job to be processed. In the event the discharge destination information is determined to be the stacking tray of the saddle-stitch binding apparatus or the stacking tray of the large-capacity stacker, the control unit 205 determines that the discharge destination of the job to be processed is a discharge destination having a mechanism for stacking the sheet bundles in a shifted state.

As a result of the determination, in the event that the control unit 205 determines that the discharge destination of the job to be processed is not a discharge destination having this mechanism, the flow is advanced to step S2914, and stacking is performed on the specified discharge destination without performing processing to cause a state of the sheet bundles of the jobs to be processed in a shifted state. As an example of a discharge destination without the mechanism, there is an escape tray of the large-capacity stacker shown in FIG. 6.

On the other hand, in the event the control unit 205 determines in step S2902 that the discharge destination of the job to be processed has a mechanism for stacking with the sheet bundles in a shifted state, the flow is advanced to step S2903.

The control unit 205 determines in step S2903 whether or not a job (advance job) with the same discharge destination as the discharge destination specified as the discharge destination of a job to be processed. The (advance job) according to the present embodiment indicates a job in the two states shown below in the (advance job 1) and (advance job 2), for example.

(Advance Job 1)

(Advance job 1) is a job awaiting execution, which is stored in the HDD 209 and planned to be executed before the job to be processed.

(Advance Job 2)

(Advance job 2) is a job already executed, and is in the state of the sheet bundle of the job being stacked on the large-capacity stacker. Determining the presence/absence of the (advance job 1) and determining the presence/absence of the (advance job 2) have different determining processes and accordingly will be described separately below.

First, a determining method in the case of the control unit 205 determining whether or not an advance job in the state shown in (advance job 1) exists will be described.

First, the control unit 205 obtains the discharge destination of the sheets set as to the job in the state of awaiting execution from the processing condition data of the job. The control unit 205 then compares the discharge destination of the job in the state of awaiting execution and the discharge destination of the sheets of the job to be processed, and determines whether or not there are jobs with the same discharge destination. The control unit 205 determines that an (advance job 1) exists in the case that determination is made that there are jobs with the same discharge destination.

Next, a determining method in the case of the control unit 205 determining whether or not an advance job in the state shown in (advance job 2) exists will be described.

First, the control unit 205 obtains the discharge destination of the sheets of the job to be processed from the processing condition data. The control unit 205 then detects whether or not there are any sheets already discharged in the discharge destination of the job to be processed, for example, by a signal received from a presence/absence detecting sensor provided at the discharge destination. In the case that detection is made that there are discharged sheets in the same discharge destination as the job to be processed, the control unit 205 determines that an (advance job 2) exists.

In step S2903, the control unit 205 determines the presence/absence of an (advance job 1) and determines the presence/absence of an (advance job 2) such as that above, and in the case that neither (advance job 1) nor (advance job 2) exists, determination is made that an advance job does not exist. In this case, the flow is advanced to step S2913.

In step S2913, the control unit 205 stacks the sheets so that the edge portion of the printed material of the job to be processed aligns with a stacking standard position. For example, in the case that the discharge destination of the job to be processed is the stacking tray of the large-capacity stacker, the control unit 205 performs control to stack aligning with the stacking standard position shown in FIG. 10 (for example, the first stacking standard position). Following this, the control unit 205 advances the flow to step S2909.

On the other hand, in the case that determination is made in step S2903 that an (advance job 1) or (advance job 2) exists, the control unit 205 determines that an advance job exists, and advances the flow to the processing in step S2904. Note that with the description of the processing in steps S2904 through S2912, the job to be processed is called "following job" as to the advance job.

In step S2904, the control unit 205 determines whether or not instructions are given to perform between-job processing as to the job to be processed by the between-job shifting button 2301, for example, as a setting of the printing system 1000.

In the case that the control unit 205 determines that instructions are not given to execute between-job processing, the flow is advanced to step S2912, and the control unit 205 performs control to stack without shifting between the sheet bundles of the following job and the sheet bundles of the advance job. In other words, in step S3011 the control unit 205 inhibits the sheet bundles of the following job and the sheet bundles of the advance job to be stacked in a shifted state. Following this, the control unit 205 advances the flow to step S2909.

On the other hand, in the case that the control unit 205 determines in step S2904 that instructions are given to execute the between-job shifting processing as a setting of the printing system 1000, the flow is advanced to step S2905, and the control unit 205 determines whether or not the discharge destination of the following job is the large-capacity stacker.

In step S2905, the control unit 205 obtains the discharge destination information of the following job from the processing condition data of the following job, and in the event determination is made that the discharge destination of the following job is not the large-capacity stacker, the flow is advanced to step S2911.

In step S2911, the control unit 205 controls stacking so that the sheet bundles of the following job and the sheet bundle of the advance job are stacked in a state of being shifted a specified amount (hereafter, the specified amount will be 10 mm) at the discharge destination specified by the discharge destination information. For example, in the case that the discharge destination of the sheets of the following job is the saddle-stitch binding apparatus, the control unit 205 references the restriction item for the saddle-stitch binding apparatus in the management table shown in FIG. 17, and performs control according to the restriction item thereof. Specifically, as a result of stacking the sheet bundle of the following job on top of the sheet bundle of the advance job according to the restriction item 1 of the management table, determination is made as to whether or not the maximum stack capacity number of sheets of the discharge destination is exceeded. In the event that determination is made that the sheets are within the range of the maximum stack capacity number of sheets, the control unit 205 performs the next control according to the restriction item 2 in the management table. The control unit 205 controls the stacking of the sheet bundle of the following job and sheet bundle of the advance job in a state of being shifted a specified amount on the stacking tray of the saddle-stitch binding apparatus, regardless of the stacked amount of sheet bundles. Following this, the control unit 205 advances the flow to step S2909.

On the other hand, in the case that the control unit 205 determines in step S2905 that the discharge destination of the following job is the large-capacity stacker, the flow is advanced to step S2906.

In step S2906, the control unit 205 determines whether to allow or inhibit the sheet bundle of the following job and the sheet bundle of the advance job stacked in a state of being shifted a specified amount, based on the number of sheets included in the sheet bundle or the height of the sheet bundles for each job, for example. The control unit 205 performs this determining according to the restriction item 2 of the large-capacity stacker in the management table. The procedures thereof will be described in detail later. Upon performing the determining in step S2906, the control unit 205 advances the flow to step S2907.

In the event that determination is made in step S2907 to allow the sheet bundle of the following job and the sheet bundle of the advance job to be stacked in a state of being shifted a specified amount, as a result of the determining in step S2906, the flow is advanced to step S2910. The control unit 205 performs control to stack the sheet bundle of the following job and the sheet bundle of the advance job in a state of being shifted a specified amount.

On the other hand, as a result of the determining in step S2906, in the event that determination is made that it is necessary to inhibit the sheet bundle of the following job and the sheet bundle of the advance job from being stacked in a state of being shifted a specified amount, the flow is advanced to step S2908.

In step S2908, the control unit 205 inhibits the sheet bundle of the following job and the sheet bundle of the advance job from being stacked in a state of being shifted a specified amount. In this case, the control unit 205 permits the sheet bundle of the following job to be stacked on top of the sheet bundle of the advance job without shifting the sheet bundle of the following job and the sheet bundle of the advance job. Also, the control unit 205 may be arranged to allow controlling of the stacking of the sheet bundle of the following job and sheet bundles of the advance job in a state of being shifted only a smaller amount (for example, 5 mm) than the specified amount. Thus, the control unit 205 can facilitate dividing the sheet bundle of the advance job and the sheet bundle of the following job after stacking, while suppressing the danger of a falling stack, by stacking the sheets in a state shifted a smaller amount than the specified amount. The control unit 205 then advances the flow to step S2909.

The control unit 205 determines in step S2909 whether or not any other jobs to be processed exist. In the case that other jobs to be processed do not exist, the processing is ended. On the other hand, in the case that determination is made in step S2909 that other jobs to be processed which are stored in the HDD 209 exist, the flow is returned to step S2902 and the processing repeated.

Note that upon ending the processing, in the case that a new job is received, the control unit 205 starts the control of the flowchart again.

Next, in step S2906, the determining processing wherein the control unit 205 references the management table shown in FIG. 17 to determine whether or not it is necessary to inhibit stacking of the sheet bundles of the following job and the sheet bundle of the advance job in a state being shifted a specified amount will be described with reference to FIGS. 19 and 20.

Note that in the event of the control unit 205 performing the determining, there is a case of determining based on the number of sheets of the sheet bundle and a case of determining based on the height of the sheet bundle.

<Case of Determining Based on Number of Sheets>

First, the case wherein the control unit 205 makes a determination based on the number of sheets in the sheet bundle of the advance job and the number of sheets in the sheet bundle of the following job will be described with reference to the flowchart in FIG. 19.

In step S3001, the control unit 205 first obtains information about the advance job in order to compute the number of sheets in the sheet bundle of the advance job.

As described above, with the advance jobs, there is a case of a job stored in the HDD 209 in a state waiting to be executed (advance job 1) and a case of a job which is already executed and the sheet bundle thereof is stacked on the large-capacity stacker (advance job 2). The method for obtaining the information about each advance job will be described below.

<Case wherein Advance Job is Advance Job 1>

(Information Obtaining Method 1)

In the case that the advance job is the advance job 1, the control unit 205 can obtain the information of the advance job by referencing the processing condition data stored in the HDD 209 associated with the printing data of the job.

The information which the control unit 205 can obtain with this method includes information relating to the number of pages, printing size enlarging/reduction and printing layout, types of sheets, size of sheets, single side/duplex printing settings, and so forth, information relating to the type of sheet processing, and information relating to the discharge destination of the sheets, and so forth of this advance job.

<Case wherein Advance Job is Advance Job 2>

(Information Obtaining Method 2)

In the case of executing the advance job, the control unit 205 stores the content included in the above-described processing condition data in a job history information storage unit within the HDD 209 so as to associate with the advance job. Thus, the control unit 205 can obtain necessary information by referencing the job history information storage unit within the HDD 209. The information stored in the job history information storage unit may be all of the processing condition data of the job, or may be a portion thereof.

(Information Obtaining Method 3)

In the event of executing printing for an advance job, the control unit 205 counts the number of sheets needed for printing with an unshown counter, and stores the number of sheets counted in a printed sheet information storage unit of the HDD 209. Following this, the control unit 205 can obtain the counted value information about the number of sheets discharged by executing the advance job, by referencing the printed sheet information storage unit of the HDD 209.

Note that the counter may be any counter without being restricted to a software counter or hardware counter, as long as the number of discharged sheets can be counted. Also, the control unit 205 resets the information which is stored employing the job history information storage unit or printed sheet information storage unit, in the case that detection is made by a sheet presence/absence detecting sensor provided on the discharge portion that sheets have been removed. Thus, the control unit 205 can accurately obtain the information about the sheets existing in the discharge unit, from the information stored in the job history information storage unit or printed sheet information storage unit.

In step S3001, the control unit 205 can obtain the information about a sheet bundle of the advance job stacked within the large-capacity stacker, by one of the methods such as those described above. Following this, the flow goes to step S3002.

(Information Obtaining Method of Following Job)

In step S3002, the control unit 205 obtains the information of the following job. Upon receiving the following job, the control unit 205 references the processing condition data which is stored so as to be associated with the printing data of the following job in the HDD 209, and obtains the information of the following job. The information which the control unit 205 can obtain with this method includes information relating to the number of pages, printing size enlarging/reduction and printing layout, size of sheets and single side/duplex printing settings, and so forth, information relating to the type of sheet processing, and information relating to the discharge destination of the sheets, and so forth of the following job.

Upon obtaining the information of the sheet bundle of the following job in step S3002, the flow goes to step S3003.

(Computing Method for Number of Sheets Included in Sheet Bundle of Advance Job)

In step S3003, the control unit 205 computes the number sheets included in the sheet bundle of the advance job based on the information obtained with the above-described (information obtaining method 1) or (information obtaining method 2).

The control unit 205 calculates the number of sheets included in the sheet bundle of the advance job as follows, employing the information relating to number of pages, printing layout, and single/duplex printing settings, from the information obtainable at step S3001.

Example 1

(Setting of advance job is 1000 pages and 2 in 1) Number of sheets to be discharged: 1000/2=500 (sheets)

Example 2

(Setting of advance job is 2000 pages and duplex) Number of sheets to be discharged: 2000/2=1000 (sheets)

In other words, the control unit 205 can obtain the number of sheets included in one sheet bundle discharged when the job is executed, by dividing the total number of pages of the job by the number of pages printed for one sheet.

Also, separate from this method, the control unit 205 can obtain the number of sheets in a sheet bundle of the advance job with (information obtaining method 3) without performing the above calculations, in the case that the advance job is an advance job 3.

In step S3003, upon obtaining the number of sheets included in the sheet bundle of the advance job with a method such as that exemplified above, the control unit 205 advances the flow to step S3004.

(Compute Number of Sheets Included in Sheet Bundle of Following Job)

In step S3004, the control unit 205 computes the number sheets included in the sheet bundle of the following job.

In step S3004, the control unit 205 computes the number sheets included in the sheet bundle of the following job with the same procedure as the method for computing the number sheets included in the sheet bundle of the advance job as described above, based on the information obtained with the (information obtaining method for following job).

After this, the control 205 determines whether or not it is necessary to inhibit the sheet bundle for the following job and the sheet bundle of the advance job to be stacked in a state of being shifted a specified amount, based on the number of sheets of each job which is computed in steps S3003 and S3004. The control unit 205 performs determining such as shown in steps S3005 through S3013, based on the management table in FIG. 17.

Specifically, the control unit 205 determines whether or not it is necessary to inhibit the sheet bundle for the following job and the sheet bundle of the advance job to be stacked in a state of being shifted a specified amount, based on the restriction item 2 in the management table shown in FIG. 17 stored in the HDD 209. Note that the condition values employed in the management table are only examples, and are not limited to the values shown here. Also, an arrangement may be made regarding the condition values, wherein the values set in advance at time of manufacturing are stored in the ROM 207, which the control unit 205 references as necessary, or setting and changes may be made later by an operator.

Before describing the flow of the processing shown in steps S3005 through S3013, the conditions set in the management table will be described. The control unit 205 determining in step S2906 that it is necessary to inhibit the sheet bundle of a following job and a sheet bundle of an advance job from being stacked in a state shifted a specified amount (for example, 10 mm) is in the following situation, for example.

First, there is a case wherein the control unit 205 determines that the number of sheets included in the sheet bundle of the advance job is less than 300 sheets, and the number of sheets included in the sheet bundle of the following job is 1000 or more sheets. In this case, the number of sheets in the sheet bundle of the advance job which serves as a foundation is less, and the number of sheets stacked thereupon is greater. Therefore, the situation is such that the center of gravity is in a higher location, enabling influence of wobbling or shock during transport when the sheets are transported with a cart. In other words, the stacked sheets are in a state of readily falling over. For example, the stacking pattern shown in FIG. 14C applies to this situation. In such a case, the control unit 205 inhibits the sheet bundle of the following job and the sheet bundle of the advance job from being stacked in a state shifted 10 mm from one another.

However, as an exception, in the case that the number of sheets included in the sheet bundle of the advance job serving as the foundation is extremely small (in the case of the number of sheets being less than S1 sheets) such as one or two sheets, the following job to be stacked on top of the advance job has little danger of wobbling. In this case, the sheet bundle of the advance job can be ignored. In the case that the control unit 205 determines that the number of sheets included in the sheet bundle of the advance job is less than 10 sheets, the management table is set so as to ignore the sheet bundle of the advance job.

Also, even in a case wherein the number of sheets included in the sheet bundle of the advance job is 300 or more sheets, the control unit 205 performs the following control in the case that the number of sheets included in the sheet bundle of the following job stacked thereupon is 2000 sheets or more. The control unit 205 determines that there is a need to inhibit the sheet bundle of the following job and the sheet bundle of the advance job from being stacked in a shifted state. The stacking patter shown n FIG. 16C applies to this situation, and shows that the center of gravity of the stacked sheets is in a higher location. In such a case also, the control unit 205 inhibits the sheet bundle of the following job and the sheet bundle of the advance job from being stacked in a state shifted 10 mm from one another.

Based on the condition values shown in such a management table, the control unit 205 performs the controls shown in steps S3005 through S3013.

First, the control unit 205 determines in step S3005 whether or not the number of sheets included in the sheet bundle of the advance job is less than S1 sheets (10 sheets), based on the management table. In the case determination is made that the number of sheets is less than S1 sheets (10 sheets), the flow goes to step S3013, and the control unit 205 allows the sheet bundle of the following job and the sheet bundle of the advance job to be stacked in a state of being shifted a specified amount (for example 10 mm).

On the other hand, in the case determination is made in step S3005 that the number of sheets included in the sheet bundle of the advance job is S1 sheets (10 sheets) or greater, the flow goes to step S3005, and determination is made as to whether the number of sheets included in the sheet bundle of the advance job is less than S2 sheets (300 sheets). In the case determination is made that the number of sheets included in the sheet bundle of the advance job is less than S2 sheets (300 sheets), the flow goes to step S3007.

In step S3007, the control unit 205 determines whether or not the number of sheets included in the sheet bundle of the following job is T1 sheets (1000 sheets) or greater, based on the management table, and in the case determination is made that the number of sheets is T1 sheets (1000 sheets) or greater, the following processing is performed. The control unit 205 determines in step S3008 that it is necessary to inhibit the sheet bundle of the following job and the sheet bundle of the advance job from being stacked in a state shifted a specified amount (10 mm).

On the other hand, in the case determination is made that the number of sheets included in the sheet bundle of the following job is less than T1 sheets (1000 sheets), the control unit 205 allows the sheet bundle of the following job and the sheet bundle of the advance job from being stacked in a state shifted a specified amount (10 mm) from one another in step S3109. On the other hand, in the case determination is made in step S3006 that the number of sheets included in the sheet bundle of the advance job is S2 sheets (300 sheets) or greater, the flow goes to step S3010.

In step S3010, the control unit 205 determines whether the number of sheets included in the sheet bundle of the following job is T2 sheets (2000 sheets) or greater. In the case the number of sheets is T2 sheets (2000 sheets) or greater, determination is made in step S3011 that it is necessary to inhibit the sheet bundle of the following job and the sheet bundle of the advance job from being stacked in a state shifted a specified amount (10 mm) from one another.

On the other hand, in the case determination is made that the number of sheets is less than T2 sheets (2000 sheets), the control unit 205 allows the sheet bundle of the following job and the sheet bundle of the advance job to be stacked in a state shifted a specified amount (10 mm).

As shown above, according to the situation, the control unit 205 determines whether to allow or inhibit the sheet bundle of the following job and the sheet bundle of the advance job from being stacked in a state shifted a specified amount (10 mm) from one another. Thus, the stacked sheets can be prevented in advance from becoming unstable. With the above-described description, S1 is exemplified as 10 sheets, S2 as 300 sheets, T1 as 1000 sheets, and T2 as 2000 sheets, but the values of S1, S2, T1, and T2 should not be limited to these. However, S1 is to be a value smaller than that of S2.

Also, separate from this control, the control unit 205 can also determine whether to allow or inhibit between-job shifting processing, based on the ratio of number of sheets included in the sheet bundle of the advance job and the number of sheets included in the sheet bundle of the following job. For example, the control unit 205 divides the number of sheets in the sheet bundle of the following job by the number of sheets in the sheet bundle of the advance job, and in the case that the divided value is at or greater than the condition value determined beforehand, determines that it is necessary to inhibit the sheet bundle of the advance job and the sheet bundle of the following job from being stacked in a shifted state. Thus, the control unit 205 can perform control in advance to prevent the stacked sheets from becoming unstable, based on the ratio of number of sheets included in the sheet bundle of the advance job and the number of sheets included in the sheet bundle of the following job.

<Case of Determining Based on Height>

Next, the case of the control unit 205 performing determination in step S2906 shown in FIG. 18 based on the height of the sheet bundle of the advance job and on the height of the sheet bundle of the following job will be described employing the flowchart in FIG. 21.

Figure 19:
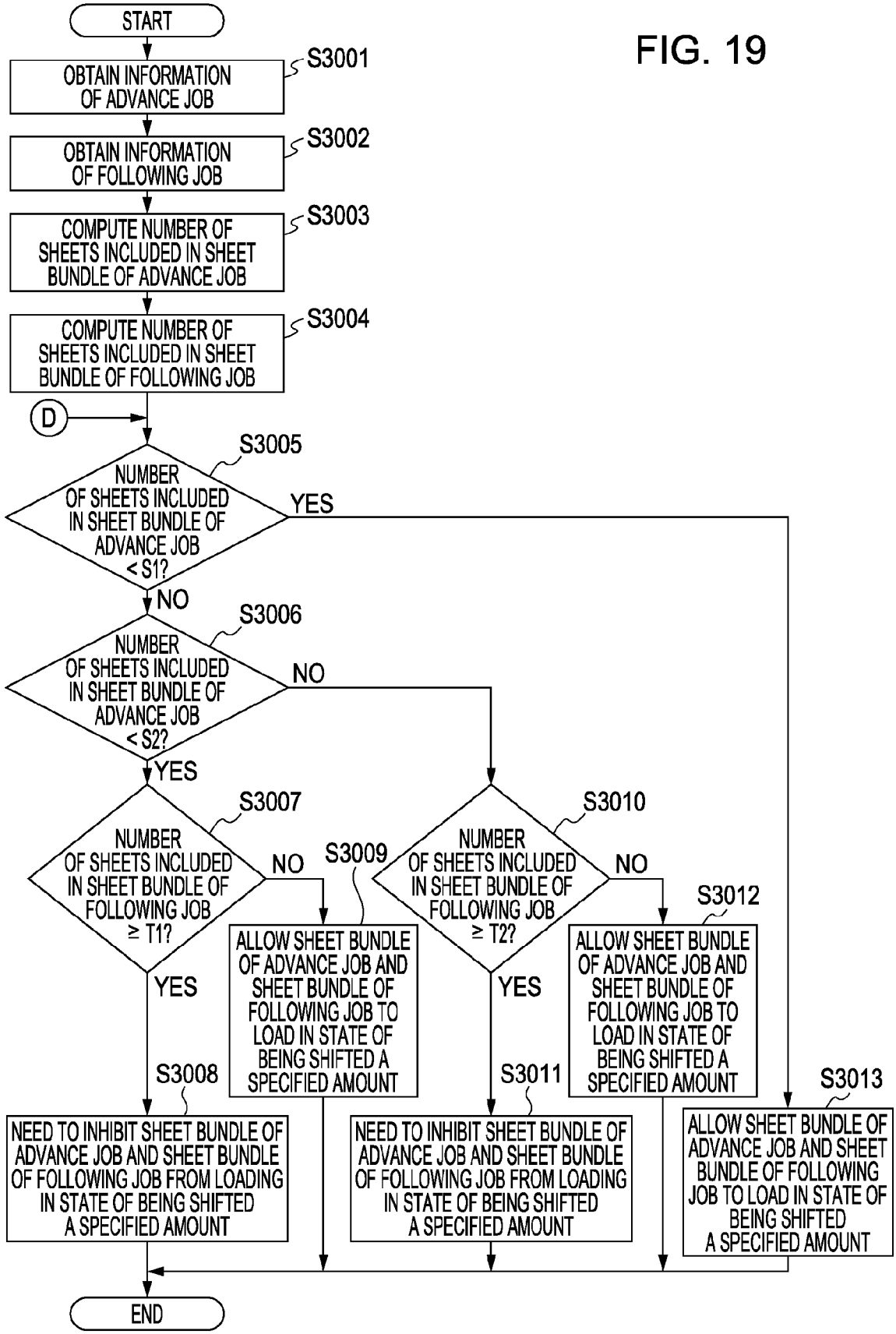
FIG. 19 is a flowchart to describe control relating to the shifting processing of an embodiment.
Figure 21:
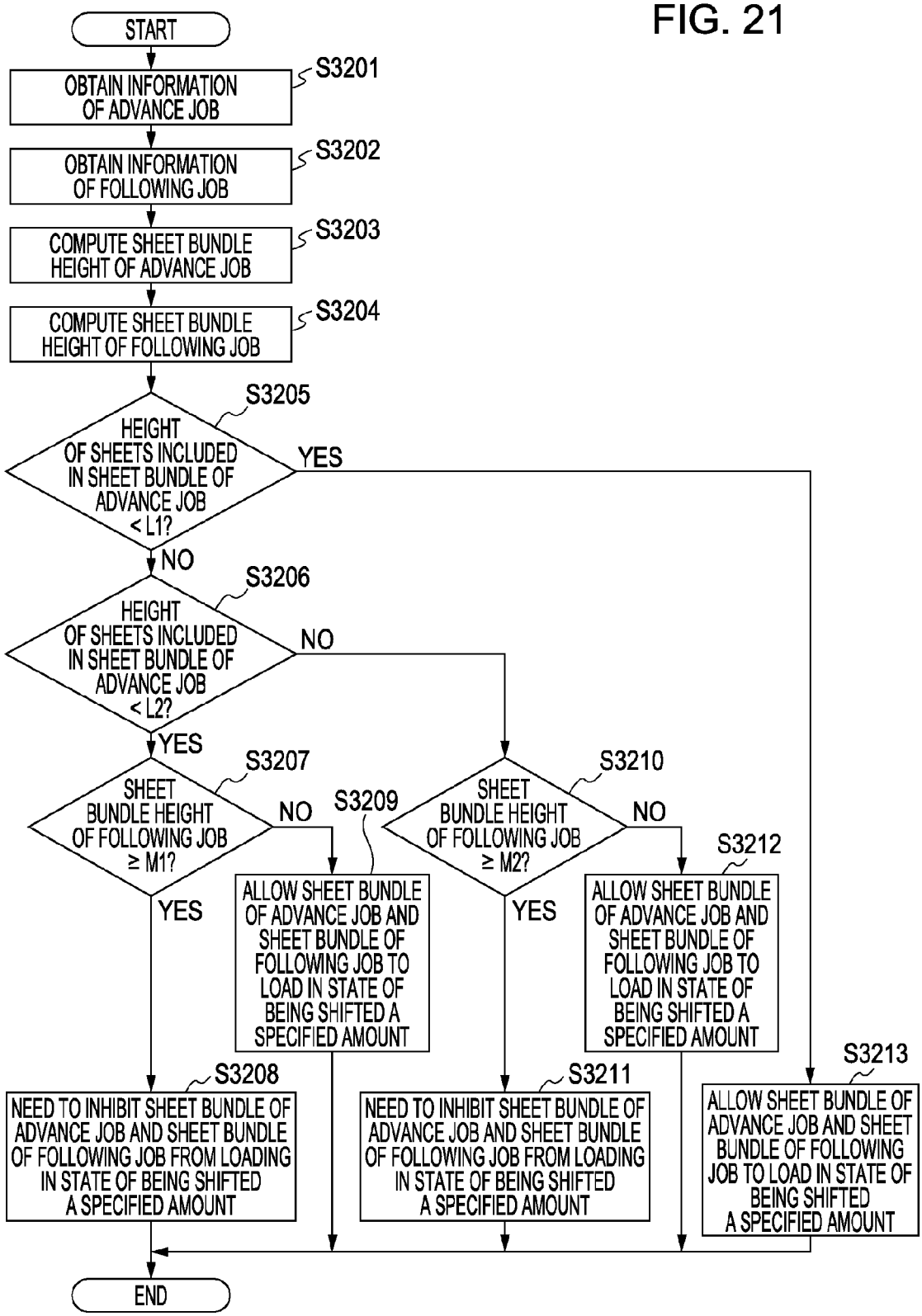
FIG. 21 is a flowchart to describe control relating to the shifting processing of an embodiment.

First, in steps S3201 and S3202 in FIG. 21, the control unit 205 obtains the information of the advance job and the information of the following job with the same method as the methods described in steps S3001 and S3002 in FIG. 19. Following this, the flow is advanced to step S3203.

In step S3203, first, the control unit 205 finds the number of sheets included in the sheet bundle of the advance job from the advance job information obtained in step S3201 with the above-described method. The control unit 205 finds the height of the sheet bundle of the advance job by taking the product of the number of sheets of the advance job and the thickness of one sheet.

The thickness of one sheet is stored in the HDD 209 in advance associated with the type of sheet. The control unit 205 obtains the type of sheet needed for printing from the processing condition data and references the thickness of the sheet corresponding to the type of sheet, thereby obtaining the thickness of the sheet.

A method for computing the height of the sheets will be described with an example. For example, the thickness of a normal copy sheet is stored in the HDD 209 in advance as 0.1 mm. In the case of stacking 500 of these copy sheets, the control unit 205 computes that the height thereof is 0.1 mm×500 sheets so is 50 mm. Upon thus computing the height of the sheet bundle of the advance job in step S3203, the control unit 205 advances the flow to step S3204.

In step S3204, the control unit 205 computes the height of the sheet bundle of the following job with the same method that the height of the sheet bundle of the advance job has been computed, and advances the flow to step S3205.

Note that in the case that the advance job is a job having already been executed, the control unit 205 may obtain the height of the sheet bundle of the advance job stacked on the large-capacity stacker with a signal received from an unshown height detecting sensor provided within the large-capacity stacker.

Based on the height of the sheet bundle thus obtained, the control unit 205 determines whether it is necessary to inhibit stacking the sheet bundle of the following job and the sheet bundle of the advance job in a shifted state with the processing in steps S3205 through S3213 shown in FIG. 21. The control unit 205 makes the determination based on the management table shown in FIG. 20.

Note that the condition values of the height shown on the management table may by arranged such that the values set beforehand at time of manufacturing are stored in the ROM 207 and the control unit 205 references these as needed, or may be set and changed later by an operator.

Before describing the flow of the processing shown in steps S3005 through S3013, the conditions set in the management table will be described.

First, the control unit 205 determining in step S2906 that it is necessary to inhibit the sheet bundle of a following job and a sheet bundle of an advance job from being stacked in a state shifted a specified amount is in the following situation. This is a case wherein the control unit 205 determines that the height of the sheet bundle of the advance job is less than 30 mm, and the height of the sheet bundle of the following job is 100 mm or greater. For example, the stacking pattern shown in FIG. 14C applies to this situation. In such a case, the control unit 205 inhibits the sheet bundle of the following job and the sheet bundle of the advance job from being stacked in a state shifted 10 mm from one another.

However, as an exception, in the case that the height of the sheet bundle of the advance job is extremely small (for example, in the case of the height being less than 1 mm), the height of the sheet bundle of the advance job can be ignored. Accordingly, with such a case, the control unit 205 does not need to inhibit the sheet bundle of the following job and the sheet bundle of the advance job from being stacked in a state shifted 10 mm from one another.

Also, even in a case wherein the height of the sheet bundle of the advance job is 30 mm or greater, the control unit 205 performs the following control in the case that the height of the sheet bundle of the following job stacked thereupon is 200 mm or greater, for example even in the case of a stacking pattern shown in FIG. 16C. The control unit 205 inhibits the sheet bundle of the following job and the sheet bundle of the advance job from being stacked in a state shifted a specified amount (10 mm) from one another.

The control unit 205 performs the determining according to the flowchart shown in FIG. 21. First, the control unit 205 determines in step S3205 whether the height of the sheet bundle of the advance job is less than L1 (1 mm). In the case determination is made that the height of the sheets is less than L1 (1 mm), the flow goes to step S3213, and the control unit 205 determines that it is not necessary to inhibit the sheet bundle of the following job and the sheet bundle of the advance job from being stacked in a state shifted a specified amount (10 mm) from one another.

On the other hand, in the case determination is made in step S3201 that the height of the sheets is L1 (1 mm) or greater, the control unit 205 advances the flow to step S3206, and determines whether the height of the sheet bundle of the advance job is less than L2 (30 mm). In the case determination is made that the height of the sheets is less than L2 (30 mm), the flow goes to step S3207.

In step S3207, the control unit 205 determines whether or not the height of the sheet bundle of the following job is M1 (100 mm) or greater, and if determination is made that the height of the sheet bundle is greater than M1 (100 mm), the flow is advanced to step S3208. In step S3208, the control unit 205 determines that it is necessary to inhibit the sheet bundle of the following job and the sheet bundle of the advance job from being stacked in a state shifted a specified amount (10 mm) from one another.

In the case determination is made that the height of the sheet bundle of the following job is less than M1 (100 mm), the control unit 205 allows the sheet bundle of the following job and the sheet bundle of the advance job to be stacked in a state shifted a specified amount (10 mm) from one another in step S3209.

On the other hand, in the case determination is made in step S3206 that the height of the sheet bundle of the advance job is L2 (30 mm) or greater, the flow goes to step S3210. In step S3210 the control unit 205 determines whether the height of the sheet bundle of the following job is M2 (200 mm) or greater. As a result, in the case determination is made that the height is M2 (200 mm) or greater, the control unit 205 determines in step S3211 that it is necessary to inhibit the sheet bundle of the following job and the sheet bundle of the advance job from being stacked in a state shifted a specified amount (10 mm) from one another. Also, in the case determination is made that the height of the sheet bundle of the following job is less than M2 (200 mm), the control unit 205 allows the sheet bundle of the following job and the sheet bundle of the advance job to be stacked in a state shifted a specified amount (10 mm) from one another in step S3212.

With the above-described description, L1 is exemplified as 1 mm, L2 as 30 mm, M1 as 100 mm, and M2 as 200 mm, but the values of L1, L2, M1, and M2 should not be limited to these. However, L1 is to be a value smaller than that of L2.

With such control, according to the situation, the control unit 205 determines whether to allow or inhibit the sheet bundle of the following job and the sheet bundle of the advance job from being stacked in a state shifted a specified amount (10 mm) from one another, whereby the stacked sheets can be prevented in advance from becoming unstable.

Also, separate from this control, the control unit 205 can also determine whether or not it is necessary to inhibit between-job shifting processing, based on the ratio of the height of the sheet bundle of the advance job and the height of the sheet bundle of the following job. For example, the control unit 205 divides the height of the sheet bundle of the following job by the height of the sheet bundle of the advance job, and in the case that the divided value is at or greater than the condition value determined beforehand, determination may be made that it is necessary to inhibit the sheet bundle of the advance job and the sheet bundle of the following job from being stacked in a shifted state. Thus, the control unit 205 can perform control in advance to prevent the stacked sheets from becoming unstable, based on the ratio of the height of the sheets included in the sheet bundle of the advance job and the height of the sheets included in the sheet bundle of the following job.

Specific Example

Of the multiple methods described above, a method for inhibiting the sheet bundle of the advance job and the sheet bundle of the following job from being stacked in a shifted state based on the number of sheets will be described using a specific example.

The control unit 205 displays the job having received a printing request on a display unit 401, as a job list as shown in FIG. 22 for example, until the job has completed execution.

Upon accepting job A, the control unit 205 stores the printing data of job A in the HDD 209. Also, in the event of accepting job A, the processing condition data of job A is also accepted, and the processing condition data is associated to job A and stored in the HDD 209.

The control unit 205 displays the received job name (Job A) and a portion of the processing condition data associated with job A stored in the HDD 209 (job name, paper size, number of pages, and so forth) in the job list.

Upon accepting job B and job C, similar to job A, the control unit 205 displays the job list shown in FIG. 22 on the display unit 401.

The control unit 205 performs control for the flowchart shown in FIG. 18 for job A, job B, and job C, respectively. Specifically, in the case of accepting job A, the control unit 205 determines that a job having a printing request is received in step S2901 in FIG. 18, and starts determining processing to determine whether or not to inhibit the sheet bundle of the following job and the sheet bundle of the advance job from being stacked in a shifted state.

First, the processing when the control unit 205 accepts job A will be described. Note that description will be given with the assumption that the large-capacity stacker at this time is in a state of no sheets stacked.

First the control unit 205 determines in step S2901 shown in the flowchart in the FIG. 18 that the job A having a printing request is accepted, and the flow is advanced to step S2902.

In step S2902, the control unit 205 determines whether or not the discharge destination of job A has a mechanism to stack sheet bundles in a shifted state. First, the control unit 205 obtains the discharge destination of job A by referencing the processing condition data stored associated to the printing data of job A. Job A is a job specified to perform saddle-stitch binding processing and is a job with the discharge destination of the stacking try of the saddle-stitch binding apparatus. Therefore, the control unit 205 determines that the discharge destination of job A has a mechanism to stack sheet bundles in a shifted state, and the flow is advanced to step S2903.

Following this, in step S2903, the control unit 205 determines whether or not any jobs (advance job) exist at the same discharge destination as the discharge destination of job A. Since no jobs exist at the same discharge destination as job A, the flow is advanced to step S2913. In step S2913, the control unit 205 controls the stacking so that the edge portion of the sheet bundle of the job to be processed aligns with the first stacking standard position shown in FIG. 10, for example, and the flow is advanced to step S2909. Also, since a printing job planned to be executed before job A does not exist within HDD 209, the printing apparatus 100 starts executing the printing process of job A. At this time, the first sheet subjected to printing is discharged in the first stacking standard position shown in FIG. 10.

Next, in step S2909, the control unit 205 determines whether or not other jobs to be processed exist. Let us say that the control unit 205 is accepting job B. IN this case, the flow is advances to step S2902, and the following processing is performed as to job B.

In step S2902, the control unit 205 determines whether or not the discharge destination of job B has a mechanism to stack the sheet bundles in a shifted state. First the control unit 205 obtains the discharge destination information of job B by referencing the processing condition data which is stored associated to the printing data of job B. Job B is a job instructed to perform large-amount stacking processing, and the stacking tray of the large-capacity stacker is the discharge destination thereof. Therefore, the control unit 205 determines that the discharge destination of job B has a mechanism to stack sheet bundles in a shifted state, and the flow is advanced to step S2903.

Following this, in step S2903, the control unit 205 determines whether or not any jobs (advance job) exist at the same discharge destination as the discharge destination of job B. The control unit 205 references the processing condition data which is stored associated to the printing data of job A, and determines whether or not the discharge destination of job A is the stacking tray of the large-capacity stacker which is the discharge destination of job B. The discharge destination of job A is the stacking tray in the saddle-stitch binding apparatus, so the control unit 205 determines that no jobs exist at the same discharge destination as job B, and the flow is advanced to step S2913.

In step S2913, the control unit 205 controls to stack the sheets with the edge portion of the sheet bundle of the job to be processed to align at a stacking standard position, and advances the flow to step S2909. Note that the number of pages in job B is 800 pages, and while this is not displayed, let us say that duplex printing setting and 4 in 1 printing setting is used.

Next, in step S2909, the control unit 205 determines whether or not other jobs to be processed exist. In the event that the control unit 250 is accepting job C, the flow is advanced to step S2902, and the following processing is performed as to job C.

In step S2902, the control unit 205 determines whether or not the discharge destination of job C has a mechanism to stack sheet bundles in a shifted state. First, the control unit 205 obtains the discharge destination of job C by referencing the processing condition data which is stored associated to the printing data of job C. Job c is a job instructed to perform saddle-stitch binding processing, and since the stacking tray of the saddle-stitch binding apparatus is the discharge destination thereof, the control unit 205 determines that there is a mechanism to stack sheet bundles in a shifted state at the discharge destination of job C, and advances the flow to step S2903.

Following this, in step S2903, the control unit 205 determines whether or not any jobs (advance job) exist at the same discharge destination as the discharge destination of job C. The control unit 205 obtains the discharge destination of job C by referencing the processing condition data of job C, and compares this to the discharge destinations of job A and job B. As a result, the control unit 205 determines that a job A exists having the same stacking tray as the discharge destination thereof as the stacking tray of the saddle-stitch binding apparatus serving as the discharge destination of job C, and advances the flow to step S2904.

In step S2904, the control unit 205 determines whether or not instructions are given to perform between-job shifting processing to stack the sheet bundle of the following job and the sheet bundle of the advance job in a shifted state, as to the job C. The instructions for the between-job shifting processing are given by a between-job shifting button 213 indicated in FIG. 12. Let us say that an arrangement is made for settings such that the between-job shifting processing is performed by the between-job shifting button 2301. In this case, the control unit 205 determines that instructions are given to perform between-job shifting processing, and the flow is advanced to the processing in step S2905.

In step S2905, the control unit 205 determines whether or not the discharge destination of the job C is the large-capacity stacker. The control unit 205 references the processing condition data which is stored associated to the printing data of job C, and obtains the discharge destination information of job C. The discharge destination of job C is the stacking tray of the saddle-stitch binding apparatus, so the control unit 205 advances the flow to step S2911.

In step S2911, the control unit 205 performs control to stack the sheet bundle of the following job and the sheet bundle of the advance job in a shifted state, and advances the flow to step S2909.

There are no other jobs to be processed, so the control unit 205 ends the processing shown in the flowchart in FIG. 18.

In the case of such a situation, let us say that the control unit 205 accepts a job D. The control unit 205 determines that the control unit 205 having accepted the job D has accepted a job D having a printing request from step S2901 shown in the flowchart in FIG. 18, and advances the flow to step S2902.

In step S2902, the control unit 205 determines whether or not the discharge destination of job D has a mechanism to stack sheet bundles in a shifted state. First, the control unit 205 obtains the discharge destination of job D by referencing the processing condition data which is stored associated to the printing data of job D. Job D is a job instructed to perform large-amount stacking processing, and since the stacking tray of the large-capacity stacker is the discharge destination thereof, the control unit 205 determines that there is a mechanism to stack sheet bundles in a shifted state at the discharge destination of job D, and advances the flow to step S2903.

In step S2903, the control unit 205 determines whether or not any jobs exist having the same discharge destination as the discharge destination of job D. The discharge destination of job D is the stacking tray of the large-capacity stacker, and the control unit 205 determines whether or not there are any jobs having the same stacking tray of the large-capacity stacker as the discharge destination. The control unit 205 obtains information relating to the discharge destinations of job A through job C, determines that there is a job B having the stacking tray of the large-capacity stacker as the discharge destination, and advances the flow to step S2904.

Next, in step S2904, the control unit 205 determines whether or not instructions are given to perform between-job shifting processing as to job D. Let us say that an arrangement is made for settings such that the between-job shifting processing is performed by the between-job shifting button 2301. In this case, the control unit 205 determines that instructions are given to perform between-job shifting processing, and the flow is advanced to the processing in step S2905.

In step S2905, the control unit 205 determines whether or not the discharge destination of the job D is the large-capacity stacker. The control unit 205 references the processing condition data which is stored associated to the printing data of job D, and obtains the discharge destination information of job D. The discharge destination of job D is the stacking tray of the large-capacity stacker, so the control unit 205 advances the flow to step S2906.

In step S2906, the control unit 205 determines whether or not it is necessary to inhibit the sheet bundle of job D and the sheet bundle of job B from being stacked in a state of being shifted a specified amount. The specific processing thereof is shown in the flowchart shown in FIG. 19 and FIG. 21. The example of performing processing according to the flowchart in FIG. 19 will be described here.

In step S3001 in FIG. 19, the control unit 205 obtains the information of job B which is the advance job. Specifically, the control unit 205 obtains the number of pages and printing setting of job B from the processing condition data of job B. With this example, first the control unit 205 obtains information from the processing condition data which is stored associated to job B in the HDD, that the printing data of job B is 800 pages worth, and that settings are performed to print with duplex printing and 4 in 1 printing, and the flow is advanced to step S3002.

In step S3002, the control unit 205 obtains the information in job D. Similar to the case of obtaining the information in job B, the control unit 205 obtains the number of pages and printing settings of job D, and advances the flow to step S3003.

In step S3003, the control unit 205 computes the number of sheets included in the sheet bundle of job B from the information of job B obtained in step S3001, such as 800 pages/2 (duplex printing)/4(4 in 1)=100 sheets. The control unit 205 stores the computed values in a number-of-sheet storage region of the advance job in the HDD 209. The flow is then advanced to step S3004.

In step S3004, the control unit 205 calculates the number of sheets included in the sheet bundle of job D from the information of job D obtained in step S3002. In the event that the job D is 5000 pages, and settings are such as single-sided printing and 2 in 1 printing is set, the control unit 205 obtains such information in step S3002. The control unit 205 calculates the number of sheets included in the sheet bundle of job D, such as 5000 pages/2(2 in 1)=2500 sheets. The control unit 205 stores the value thereof in the number-of-sheets storage region of the following job in the HDD 209.

In the next step S3005 and thereafter, the control unit 205 determines whether or not it is necessary to inhibit the sheet bundle of the following job (job D) and the sheet bundle of the advance job (job B) from being stacked in a shifted state, based on the number of sheets included in the sheet bundles in job B and job D.

Note that in this example, the control unit 205 makes the determination based on the condition value defined in the management table in FIG. 17.

First, in step S3005, the control unit 205 compares the number of sheets included in the sheet bundle in job B stored in the number-of-sheet storage region of the advance job and S1 (10 sheets). The number of sheets included in the sheet bundle in job B is 100 sheets, and is not less than S2 (10 sheets), so the flow is advanced to step S3006. Next, in step S3006, the control unit 205 determines whether the number of sheets included in the sheet bundle of job B is less than T1 (300 sheets). The number of sheets of 100 sheets included in the sheet bundle in job B is less than T2 (300 sheets), so the flow is advanced to step S3007.

In step S3007, the control unit 205 determines whether or not the number of sheets included in the sheet bundle of job D is T1 (1000 sheets) or greater. The sheet bundle of job D is 2500 sheets so is greater than T1 (1000 sheets), so the flow is advanced to step S3008.

In step S3008, the control unit 205 determines that it is necessary to inhibit the sheet bundle of the following job (job D) and the sheet bundle of the advance job (job B) from being stacked in a shifted state.

The control unit 205 ends the processing to perform determination of whether to allow or inhibit the sheet bundle of the following job (job D) and the sheet bundle of the advance job (job B) from being stacked in a shifted state a specified amount, as described with reference to FIG. 39, and the flow is advanced to step S2907.

In step S2907, the control unit 205 determines that it is necessary to inhibit the sheet bundle of the following job (job D) and the sheet bundle of the advance job (job B) from being stacked in a shifted state a specified amount, and the flow is advanced to step S2908.

In step S2908, the control unit 205 inhibits the sheet bundle of the following job (job D) and the sheet bundle of the advance job (job B) from being stacked in a shifted state a specified amount, and the flow is advanced to step S2909.

In step S2909, the control unit 205 determines that no jobs to be processed exist, and ends the process.

If the sheet bundle of the following job and the sheet bundle of the advance job are stacked in a state shifted from one another with such control as above, the control unit 205 can determine a state wherein the stacked sheet bundles becomes unstable, by the various condition values. Thus, the control unit 205 can control so as to prevent in advance the sheets stacked on the large-capacity stacker from becoming unstable.

Also, in the case that determination is made that it is necessary to inhibit the sheet bundle of the following job and the sheet bundle of the advance job from being stacked in a shifted state, information indicating that stacking in a shifted state is inhibited is added to the processing condition data of the following job. In the case of executing a following job wherein stacking in a shifted state is inhibited, the control unit 205 can perform the controls described below in (control 1) through (control 3) instead.

(Control 1)

The control unit 205 stacks the sheet bundle of the following job as to the discharge location of the sheet bundle of the advance job without shifting. Also, in this event, the control unit 205 performs control so as to insert a dividing sheet between the sheet bundle of the advance job and the sheet bundle of the following job. Thus, the division between both jobs can be clarified without shifting the following job and advance job.

Note that by selecting the size of the dividing sheet to be a size greater than the size of the sheets before and after the dividing sheet, the dividing sheet can be easily viewed compared to the sheets before and after the dividing sheet. Also, settings may be made wherein a dividing sheet is not inserted between the sheet bundle of the advance job and the sheet bundle of the following job.

(Control 2)

At the time of executing the following job, the control unit 205 displays such as that shown in FIG. 24 on the display unit 401, and the operator causes a message to be displayed for instructing discharge without between-job shifting processing as to the sheet bundle of the following job. The control unit 205 also displays a button for instructing discharge without between-job shifting processing.

For example, in the case that the "YES" button shown in FIG. 24 is pressed by the operator, the control unit 205 recognizes that the "YES" has been pressed from a signal sent from the touch panel of the display unit 401. The control unit 205 receiving the signal causes the sheet bundle of the following job to be stacked without performing shifting processing. In other words, the control unit 205 causes the sheet bundle of the following job and the sheet bundle of the advance job without shifting as much as possible. In this event also, similar to the (control 1), a dividing sheet may be inserted between the sheet bundle of the following job and the sheet bundle of the advance job by the control unit 205, thereby clarifying the division between both jobs without shifting the following job and advance job.

On the other hand, in the event that the "NO" button is pressed by the operator, the control unit 205 recognizes that the "NO" has been pressed from a signal sent from the touch panel of the display unit 401. The control unit 205 receiving the signal causes the sheet bundle of the following job to be stacked with between-job shifting processing. In other words, the control unit 205 receiving this signal causes the sheet bundle of the following job and the sheet bundle of the advance job to be stacked in a shifted state. For example, in the case that the transport path distance by cart is short, and the possibility of the sheets falling over during transporting is low, the operator can stack the sheet bundle of the following job and the sheet bundle of the advance job in a shifted state by selecting the "NO" button. With such a configuration, the printing system 1000 can perform shifting processing according to the intentions of the operator.

(Control 3)

The control unit 205 performs the display such as that shown in FIG. 25 on the display unit 401, and prompts the operator to remove the sheets stacked on the large-capacity stacker. Following this, in the case that determination is made that the sheets are removed from the large-capacity stacker, this control unit 205 starts the discharge of the sheets of the following job.

Methods for the control unit 205 to determine that the sheets have been removed from the large-capacity stacker may include, for example, employing an unshown sheet detecting sensor provided on the large-capacity stacker, or an open/close sensor on the front door of the large-capacity stacker. Also, there is a method wherein the control unit 205 displays a message on the display unit 401 to prompt the operator to press the OK button after the sheets are removed from the large-capacity stacker. Following this, the control unit 205 determines that the sheets have been removed when a signal to notify that the OK button has been pressed is received from the touch panel 401.

In this event, regardless of whether the OK button is pressed, for example in the case that a signal is received from the sheet detecting sensor to indicate that there are sheets, it is desirable to not start discharge of the sheets of the following job, and to perform such a display as that shown in FIG. 18 again on the display unit 401. By performing controls such as above, the control unit 205 can maintain stability of the sheets stacked on the large-capacity stacker.

<Case wherein Following Job is Copy Job>

In the case of the above-described control, the control unit 205 needs to determine the stacking position of the sheet bundle to be discharged based on the number of sheets in the sheet bundle to be discharged or based on a certain height, before the point-in-time in which the first sheet of the sheet bundle is discharged.

However, in a case wherein the following job is a copy job made up of a document of multiple pages, and that reading of the multiple pages is not completed, there may be a situation wherein the control unit 205 cannot determine the number of sheets needed to complete the printing of the copy job at the point-in-time of discharge of the first sheet. It goes without saying that since this is a copy job, receiving processing condition data from the client PC is unlikely, so the control unit 205 cannot reference the number of pages of the job from the processing condition data. Such a situation occurs when the (condition 1) and (condition 2) described below are simultaneously fulfilled.

(Condition 1)

Reading of the copy document with multiple pages is not completed. Methods for the control unit 205 to determine the completion of reading of the copy document with multiple pages may include the following. The operator can employ a continuous reading mode for the copy document to cause the document with multiple pages to be read in as one job. Let us say that, upon an unshown "continuous reading button" being pressed, and until an unshown "complete" button is pressed which is to be pressed when the continuous reading is completed, the control unit 205 sets this to be the continuous reading mode, and the document read during that time is the data of one job. Thus, the control unit 205 determines the completion of the reading of the document by detecting that unshown "complete" button has been pressed. Accordingly, if during the continuous reading mode of the document, and the "complete" button has not been pressed, the control unit 205 determines that the reading of the copy document with multiple has not been completed.

Also, the operator can perform reading of a document with multiple pages by employing an automated document conveying apparatus (ADF) 301 provided on the printing system. The automated document conveying apparatus (ADF) 301 separates the document bundle set on the stacking face of the document tray in page order from the first page of the document, and conveys these to the document platen glass for document scanning by the scanner 302. In the case that determination is made that there is no more document bundle set on the stacking face of the document tray, determination is made that the reading of the document is completed. Accordingly, the control unit 205 determines that reading of the copy document with multiple pages is not completed in the case that the document is during conveying operations by the automated document conveying apparatus (ADF) 301, and determination is made that copy documents remain in the document tray.

(Condition 2)

Condition 2 is a situation wherein the received copy job is executable. For example, this is a case wherein no advance jobs during execution, or awaiting execution, exist before the copy job in the HDD 209, or in the case that the advance job execution is completed and the received job becomes executable.

In the case of simultaneously fulfilling (condition 1) and (condition 2), the control unit 205 cannot determine the number of sheets needed for printing the copy job in a situation of being able to start executing the copy job. Therefore, in such a case, determining whether or not it is necessary to inhibit the sheet discharge processing based on the stack amount such as the number of sheets or the height thereof is difficult for the control unit 205.

The control unit 205 can recognize how many sheets are needed for printing of the copy job if waiting to start printing the first sheet of the printing job until the reading of the entire document is completed. However, in this case, the time required until the first sheet is discharged, FCOT (first copy on time) is delayed, decreasing productivity.

Thus, by performing the control to be described below, the control unit 205 can solve such problems, and FCOT or entire job productivity can be improved.

First, an example wherein the control unit 205 displays a job list such as that shown in FIG. 26 on the display unit 401 will be described. Job A which is an advance job is a job having a request for large-amount stacking processing, and is a job during execution by the control unit 205. Also, concurrently therewith, the control unit 205 performs document reading of job B which is a following job. Job B is a copy job, and a situation is assumed wherein the control unit 205 has not detected reading completion of all of the pages of the copy document.

In this case, if reading is completed for all of the pages of the document with multiple pages of the following job B before completing execution of the advance job A, the control unit 205 can determine the total number of pages of job B, and can obtain the number of sheets needed for printing based on the total number of pages. However, in the case that reading is not completed for job B when the execution of job A is completed, the control unit 205 cannot find the total number of pages of job B, so cannot determine the number of sheets needed for printing. In this case, the control unit 205 performing the following control is effective.

For example, in the case that the number of sheets in a copy document is large, a user frequently reads in the copy document using the ADF 301 rather than reading in the copy document using a pressure plate. Accordingly, in the case that the copy document is read in via the ADF, we can assume that the number of sheets of the copy document is large. Conversely, in the case that the copy document is read in using the pressure plate, we can assume that the number of sheets in the copy document is small.

Accordingly, upon receiving a signal that the copying of job B is performed at the ADF 301, the control unit 205 determines that it is necessary to stack job A and job B in a shifted state, and starts the printing executing of the job B. In this case, the control unit 205 determines that the discharge location of the first sheet to be discharged in the event of executing job B is the same location as the stacking location of the sheet bundle of job A, and discharge is performed.

On the other hand, the control unit 205 receives a signal from an unshown pressure plate employing detecting sensor, whereupon in the case that the control unit 205 determines that copying is performed with the pressure plate for job B, an assumption can be made that the total number of pages of job B is small. Accordingly, in the case that the control unit 205 receives the signal that copying is performed with the pressure plate, the control unit 205 determines that it is not necessary to inhibit stacking the job A and job B in a shifted state, and starts executing printing of the job B. In this case, the control unit 205 determines that the discharge location of the first sheet to be discharged in the event of executing job B is a location shifted a specified amount from the stacking location of the sheet bundle of job A, and discharge is performed.

With the above control, even if the following job is a copy job, reading of the entire copy document does not need to be awaited, determination is made to allow or inhibit between-job shifting processing, and executing of the copy job can be started. Thus, the time needed until the first page is output can be shortened, and productivity of the entire job can be improved.

<Shifting Discharge Control when Discharge Destination Changes>

Also, a situation may occur wherein the control unit 205 changes the sheet discharge destination of the job. For example, if the stacking allowable number of sheets of the discharge destination of the job is exceeded when discharging the sheets of a certain job, a case of the control unit 205 making determination before starting printing processing applies to this situation. Also, in the case wherein the discharge destination of the sheets of the job being discharged becomes full during printing of the job also applies to this situation. Also, discharge destination changing instructions by the operator which is received from the display unit 401 may apply to this situation.

An example of a printing system 1000 with a system configuration having two large-capacity stacker including a first large-capacity stacker and second large-capacity stacker and a saddle-stitch binding apparatus for a total of three in-line finishers are connected, is described.

With such a system configuration, the control unit 205 performs discharge of the sheets to the stacking tray of the first large-capacity stacker. At this time, for example, the control unit 205 counts the number of sheets already stacked on the first large-capacity stacker by an unshown counter. Following this, the control unit 205 calculates the sum of the number of sheets already stacked on the first large-capacity stacker and the number of sheets to be discharged. In the event that the sum thereof is determined to exceed the stack allowable number of sheets of the large-capacity stacker, the control unit 205 changes the discharge destination of the sheet bundle of the job to another discharge destination.

As a candidate for a discharge destination after a change, either a second large-capacity stacker or the stacking tray of the saddle-stitch binding apparatus is selected as a new discharge destination.

In this event, if the control unit 205 selects another large-capacity stacker 200*b* as the new discharge destination, the control unit 205 stacks the sheet bundle of the job to be processed in the same position as the sheet bundle stacked before this.

On the other hand, if the control unit 205 selects the stacking tray of the saddle-stitch binding apparatus 200*c* as the new discharge destination, the sheet bundle of the job to be processed and the sheet bundle stacked before this are stacked in a state of being shifted a specified amount.

Note that with such settings, an arrangement may be made wherein the user determines beforehand for every discharge destination.

With such controls, settings are made for each discharge destination as to whether or not between-job shifting processing is to be performed, and even in the case of having multiple discharge destinations, between-job shifting processing can be performed according to the discharge destination.

<Control in Case of Stacking Sheet Bundles for Third Job and Thereafter>

Control of between-job shifting processing performed between sheet bundles of two jobs discharged to a discharge destination with no existing stacked sheets is described as above.

Next, control for the control unit 205 to determine whether to allow/inhibit the between-job shifting processing for a sheet bundle of a third job or thereafter will be described. Note that for each job after the third job, the same control is performed as the control as to the third job, and the same advantages are obtained.

The sheet bundle of the third job is stacked on top of the sheet bundle stacked on the stacker before this, whereby the stacking pattern of the stacked sheets becomes unstable during transporting by a cart is shown in FIGS. 27A and 27B. This is a case wherein the stack amount of the sheet bundle of the third job (the sheet bundle of the accepted job) is large, and wherein the sheet bundle of the third job is stacked on top of the sheet bundles of multiple advance jobs which are each stacked in a shifted state to one another.

In order to prevent sheets being stacked in such a state in advance, the control unit 205 performs control when discharging the third sheet bundle. This control will be described with reference to the flowchart in FIG. 18 and FIG. 28.

First, the control unit 205 performs control showing the flowchart in FIG. 18. With the flowchart shown in FIG. 18, of the controls performed by the control unit 205 as to the third job, the control which is different from the jobs up to the second job is step S2906. The processing performed in step S2906 by the control unit 205 will be described with reference to FIG. 28.

Note that the control unit 205 recognizes that the job to be processed is the third job, for example by the value of the job counter prepared for each discharge destination within the HDD 209. The value of the job counter is initialized in the event that determination is made by the presence/absence detecting sensor for the sheets provided at the discharge destinations that no sheets are stacked at the discharge destination. After this, the control unit 205 discharges the sheets for the job to the specified discharge destination when executing the job to be processed, and when discharge of the sheet of the job is completed, the value of the job counter corresponding to the discharge destination is increased by 1. After this, in step S3801 in FIG. 18, in the case that the control unit 205 has already determined that the value of the job counter is 2, the control unit 205 recognizes that the job to be processed is the third job.

Figure 28:
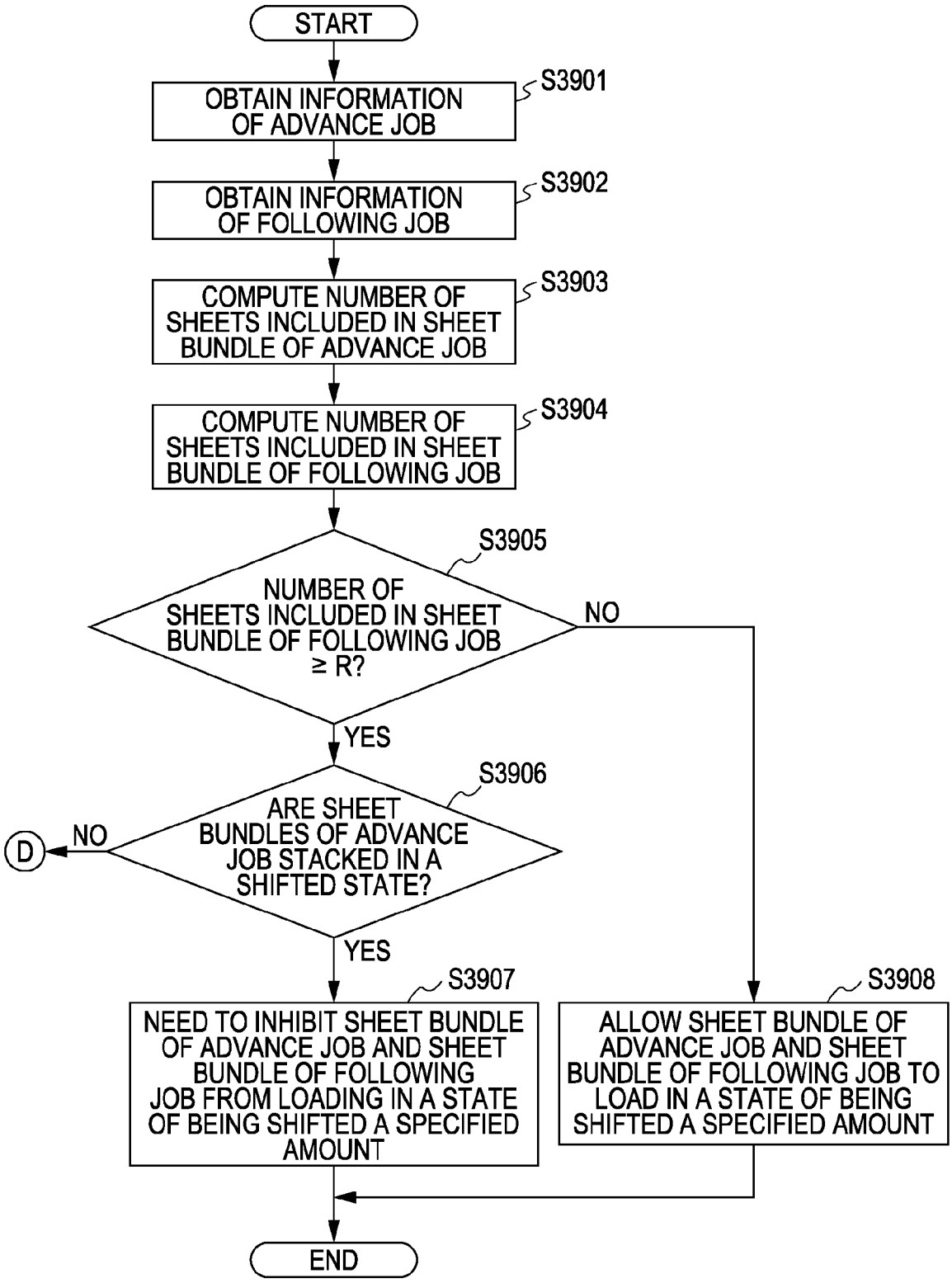
FIG. 28 is a flowchart to describe control relating to the shifting processing of an embodiment.

First, in step S3901 in FIG. 28, the control unit 205 obtains the information of the advances job, but since there are multiple advance jobs, the control unit 205 obtains the information of the multiple advance jobs. The job to be processed as to these advance jobs is called a following job. The third job is called a following job. The flow is then advanced to step S3902.

In step S3902, the control unit 205 obtains the information of the following job, and advances the flow to step S3903.

In step S3903, the control 205 computes the number of sheets included in each of the sheet bundles of the multiple advance jobs, based on the information of the advance jobs obtained in step S3901, and computes the total number of sheets included in the sheet bundles of the multiple advance jobs.

In step S3904, the control unit 205 computes the information of the number of sheets for the following job, based on the information of the following job obtained in step S3902.

The control unit 205 determines in step S3905 whether or not the number of sheets included in the sheet bundle of the following job is R sheets (for example, 500 sheets) or greater. In the case that number of sheets is not R sheets or greater, the flow goes to step S3908, and the control unit 205 allows the sheet bundle of the advance job and the sheet bundle of the following job to be stacked in a state shifted a predetermined amount from one another. In this case, if the number of sheets included in the sheet bundle of the following job is small, this is because there is a low probability of the stack falling over by wobbling or shock to the stacked sheets during transporting with a cart. In other words, this is processing for stacking in a state of the sheet bundle of the following job and the sheet bundle of the advance jobs being shifted as much as possible. On the other hand, if the number of sheets included in the sheet bundle of the following job is R or greater, the flow goes to step S3906.

Of the sheet bundles of the multiple advance jobs, the control unit 205 determines in step S3906 whether or not there are sheet bundles stacked in a shifted state from another job.

The method of determining here will be described. A shift discharge flag is prepared within the HDD 209. In an initial state (in the state with no sheets existing in the large-capacity stacker) the shift discharge flag is set to OFF. Following this, in the event that the following job is stacked as to the advance job in a shifted state, the control unit 205 turns the shift discharge flag as to the job ON in the HDD 209, for example, as is step S2910 in FIG. 18. Also, in step S2908, in the event that the control unit 205 performs control to stack the sheet bundle of the following job and the sheet bundle of the advance job in a state of being shifted a smaller amount than the specified amount (for example, 5 mm) and discharge is performed, the control unit 205 turns the shift discharge flag in the HDD 209 to ON.

In the event that the control unit 205 determines that the shift discharge flag within the HDD 209 is turned ON, the control unit 205 determines in step S3906 in FIG. 28 that the sheet bundles of the advance jobs are stacked in a shifted state to one another. Note that in the event that determination is made that sheets are removed from the large-capacity stacker, the control unit 205 turns the shift discharge flat in the HDD 209 to OFF. The method for determining that the sheets have been removed from the large-capacity stacker is as described above.

In the event determination is made that sheet bundles of the advance jobs are stacked in a shifted state to one another, the control unit 205 displays a warning such as that shown in FIG. 25 on the touch panel 401, and prompts the operator to remove the advance sheet bundles from the large-capacity stacker.

On the other hand, in the case determination is made in step S3906 that the sheet bundles of the multiple advance jobs are not stacked in a shifted state, the control unit 205 advances the flow to A. The control unit 205 then advances the flow to step S3005 shown in the flowchart in FIG. 19 with the sheet bundle of the accepted third job as the sheet bundle of the following job, and the sheet bundles of the flat-stacked of multiple jobs executed before this as the sheet bundles of the advances jobs. The processing at step S3005 and thereafter is as described with FIG. 19, so the description thereof will be omitted.

With such controls, the control unit 205 can prevent in advance the stacked sheets of the sheet bundles of the third job and thereafter from becoming unstable.

<Between-Job Shifting Instructed to Print Multiple Copies>

Figure 4:
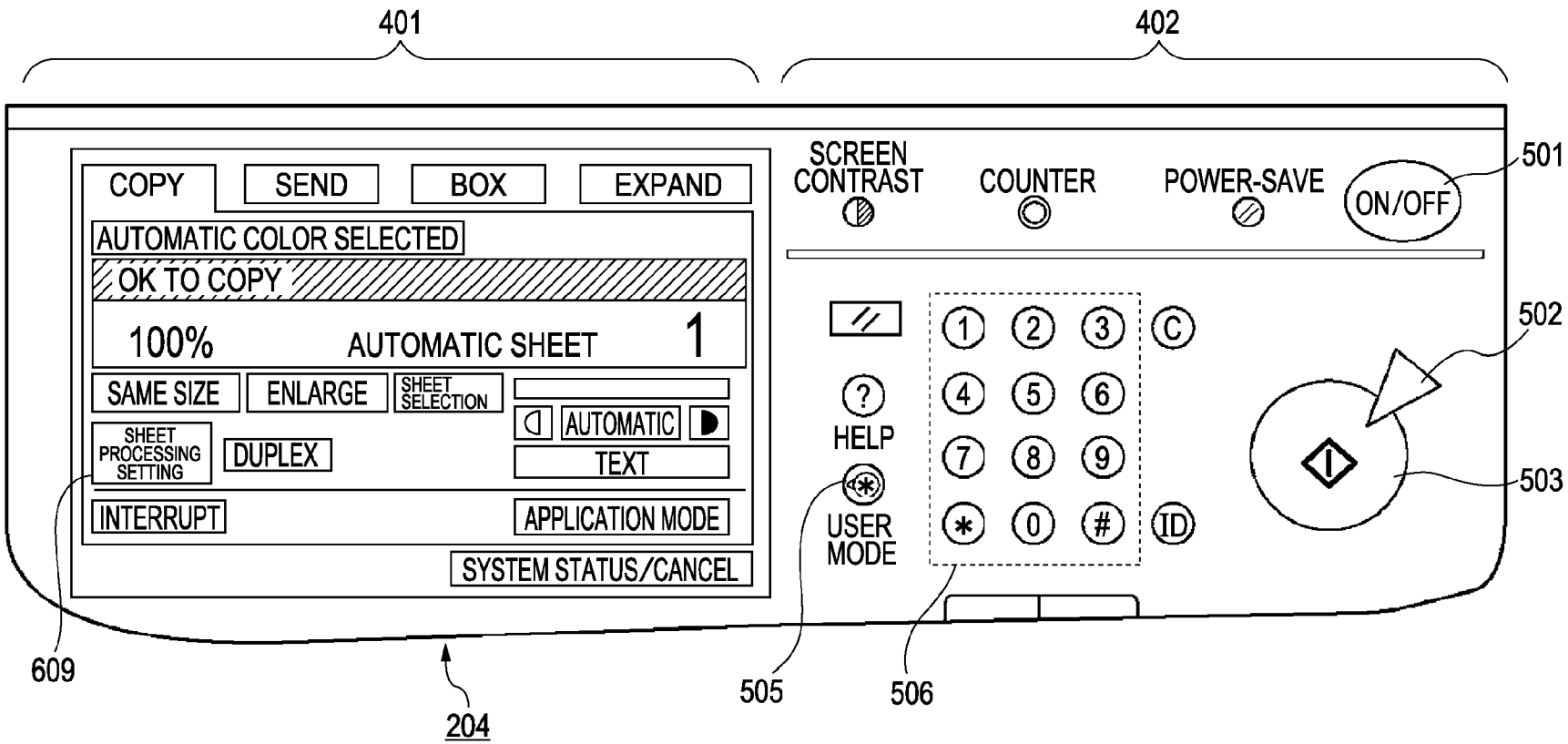
FIG. 4 is a diagram to describe one example of a UI portion of the printing system which is subject to control by an embodiment.

Also, with the present system 1000, for example, during display of the copy setting screen as shown in FIG. 4, the operator can employ a ten key 506 to set the number of copies of the read document to print. Also, a situation can be assumed wherein between-job shifting processing is performed by a between-job shifting button 213 shown in FIG. 33. In this case, upon accepting the copy job specified to perform printing of multiple copies, the control unit 205 stacks the discharging sheets in a state shifted for every copy. However, in this case also, if the sheet bundles for each copy are stacked in a state shifted from one another in the stacking tray of the large-capacity stacker, a situation may occur wherein the stacked sheets become unstable.

As to the stacking pattern of sheets, there are multiple stacking patterns depending on the number of sheets for each copy, but several of these stacking patterns will be described below with reference to FIGS. 29 and 30.

(Stacking Pattern 5)

The control unit 205 stacks a first copy sheet bundle 4000*a* made up of 300 sheets such as that shown in FIG. 29B on the stacking tray of the large-capacity stacker, such as that shown in FIG. 29A. Following this, the control unit 205 stacks a second copy sheet bundle 4000*b* made up of 300 sheets on top of the sheet bundle 4000*a* in a state shifted from the stacking position of the sheets in the sheet bundle 4000*a*, as shown in FIG. 29C.

(Stacking Pattern 6)

The control unit 205 stacks a first copy sheet bundle 4001*a* made up of 2000 sheets such as that shown in FIG. 30B on the stacking tray of the large-capacity stacker, such as that shown in FIG. 30A. Following this, the control unit 205 stacks a second copy sheet bundle 4001*b* made up of 2000 sheets on top of the sheet bundle 4001*a* in a state shifted from the stacking position of the sheets in the sheet bundle 4001*a*, as shown in FIG. 30C.

Note that the reference numerals 4000*a* through 4001*a* and 4000*b* through 4001*b* in FIGS. 29 and 30 denote sheet bundles made up of at least one sheet each. The sheet bundles expressed as 4000*a* through 4001*a* in the diagram shows the sheet bundles stacked in advance of the sheet bundles expressed as 4000*b* through 4001*b*, respectively, wherein each of the sheet bundles show a sheet bundle for one copy.

Of FIG. 29C and FIG. 30C, upon the control unit 205 stacking the sheets on the stacking tray of the large-capacity stacker with the stacking pattern shown in FIG. 30C, the stacked sheets become unstable in the event of transporting with a cart. That is to say, with the stacking pattern shown in FIG. 30C, the stacked sheets more readily fall down from wobbling during transporting with a cart or shock from level differences, as compared to the stacking pattern shown in FIG. 29C.

Thus, the control unit 205 which is one example of the control unit according to the present embodiment, executes the following control to prevent in advance the stacked sheets from becoming in a state to readily fall over when transporting the stacked sheets with a cart.

Figure 33:
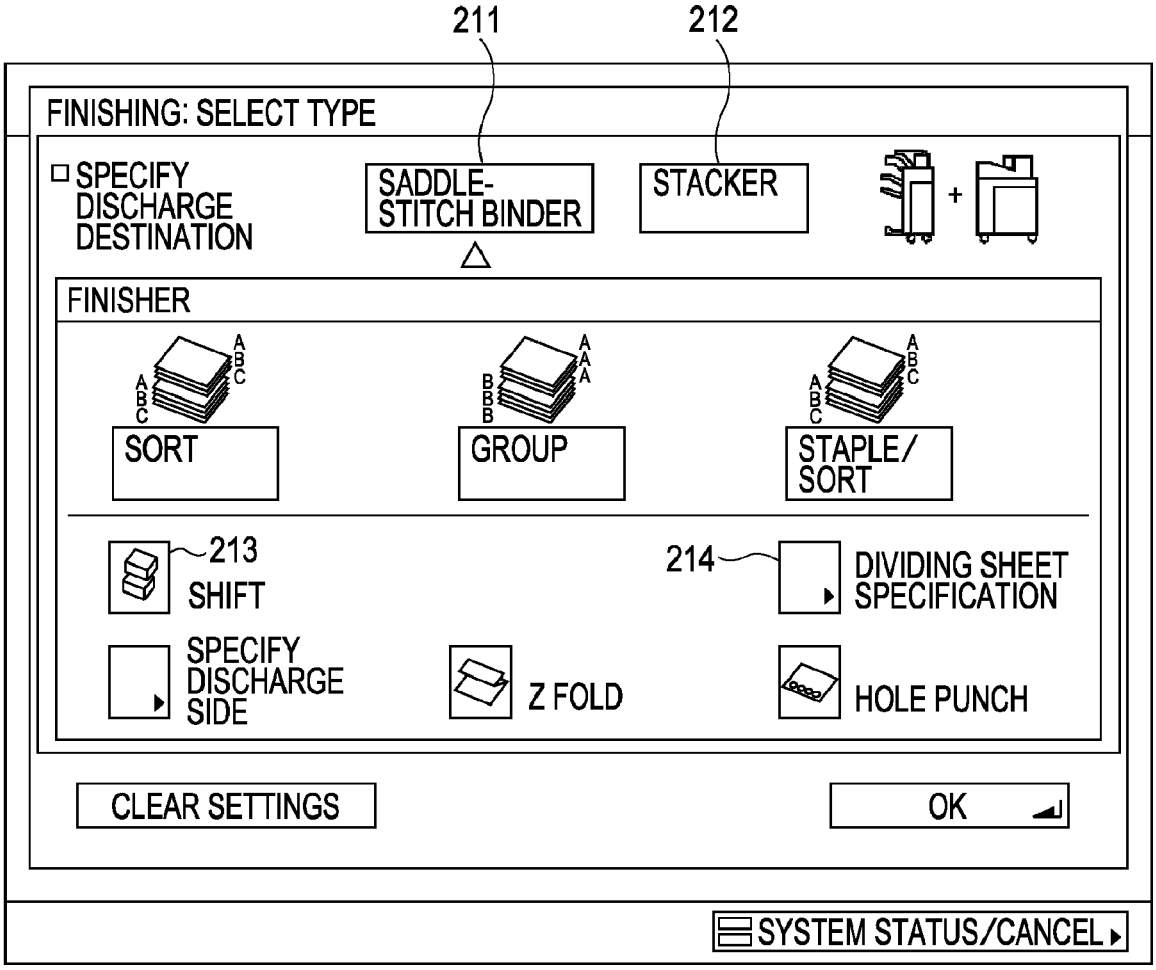
FIG. 33 is a diagram to describe a display control example as to a UI portion which is subject to control by an embodiment.

Upon the sheet processing setting button 609 on the display screen in FIG. 6 being pressed by an operator, the control unit 205 displays a UI such as that shown in FIG. 33 on the touch panel 401, for example. The operator can select as a discharge destination from the display screen shown in FIG. 33, one of the two types of discharge destinations of the saddle-stitch binding apparatus 211 and the stacker 212 (large-capacity stacker).

FIG. 33 shows an example of a screen for the control unit 205 to display on the touch panel in the case that the operator selects the saddle-stitch binding apparatus 211 as the discharge destination. At this time, the control unit 205 displays a between-copy shifting button 213 to select whether or not to perform between-copy shifting processing on the display unit 401. The default is set to perform between-copy shifting processing. Upon the between-copy shifting button 213 being pressed by the operator, the control unit 205 switches between executing and not executing between-copy shifting processing. Dividing sheet button 214 is a button for selecting a type of the dividing sheet. Operator can determine the type of the dividing sheet from a plurality of types of the dividing sheets by the dividing sheet specification button 214. Stacking unit button 216 is a button for selecting a stacking unit where a sheet is to be discharged, from a plurality of stacking units of the large-capacity stacker.

Figure 34:
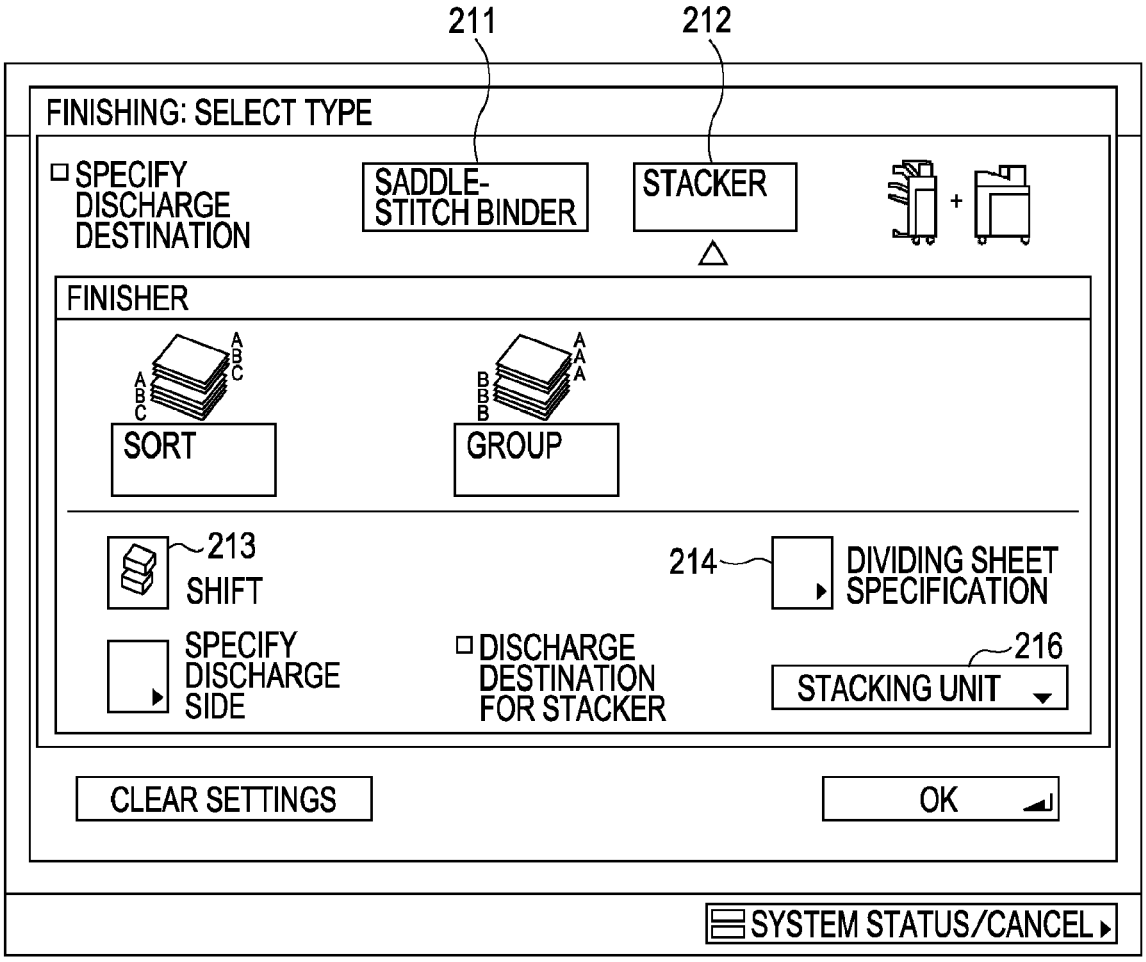
FIG. 34 is a diagram to describe a display control example as to a UI portion which is subject to control by an embodiment.

Also, in the event that the stacker 212 is selected by instructions from the operator instead of the saddle-stitch binding apparatus 211, the control unit 205 displays a display such as that shown in FIG. 34 on the touch panel 401. As shown in FIG. 34, the between-copy shifting button 213, which had been selectable in the event that the saddle-stitch binding apparatus is specified as a discharge destination, is controlled by the control unit 205 as to the display unit 401, so as not to be selectable in the case that the large-capacity stacker is specified as the discharge destination.

Thus, in the case that the stacker 212 is specified as the discharge destination, the control unit 205 performs control so that the operator cannot select the between-copy shifting button 213, and inhibits between-copy shifting processing as to the discharged sheets. With the above control, the control unit 205 can prevent between-copy shifting processing from occurring when discharging to the large-capacity stacker.

In the case that between-copy shifting processing is inhibited, the control unit 205 can stack the sheets without performing between-copy shifting processing, instead of performing between-copy shifting processing, for example. Thus, since the sheets stacked on the cart are stacked without performing between-copy shifting processing, stability of the stacked sheets is maintained when compared to the case of performing between-copy shifting processing, whereby the probability of the stacked sheets falling over can be decreased.

Figure 35:
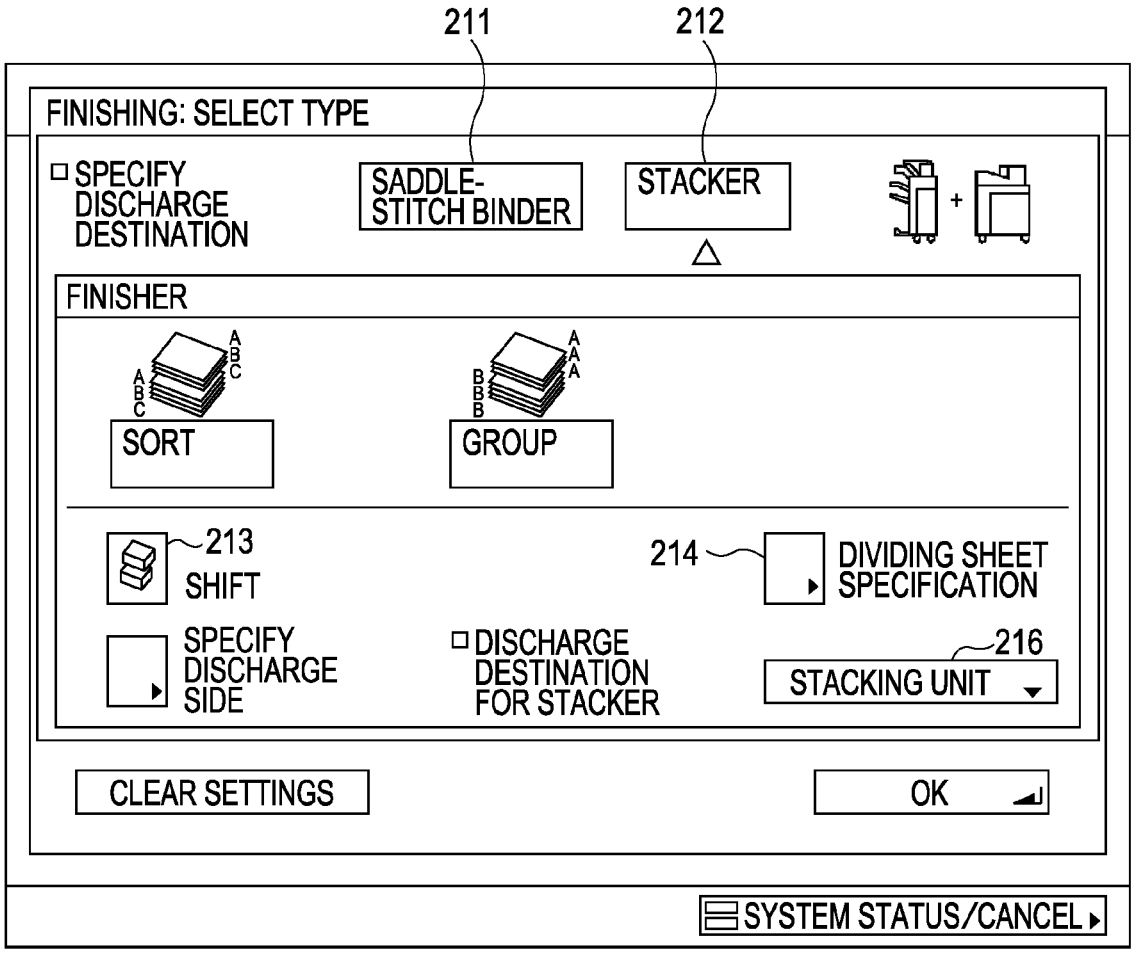
FIG. 35 is a diagram to describe a display control example as to a UI portion which is subject to control by an embodiment.

On the other hand, in the case that the stacker 212 is selected as the discharge destination from the instruction by the operator, the control unit 205 may cause the display unit 401 to perform a display such as that shown in FIG. 35 wherein the between-copy shifting button 213 is selectable. However, in this case, the control unit 205 inhibits the between-copy shifting processing depending on the situation. Thus, the stacked sheets can be prevented in advance from becoming unstable. Specifically, the controls performed by the control unit 205 will be described with reference to the flowchart FIG. 31.

Figures 31, 31A:
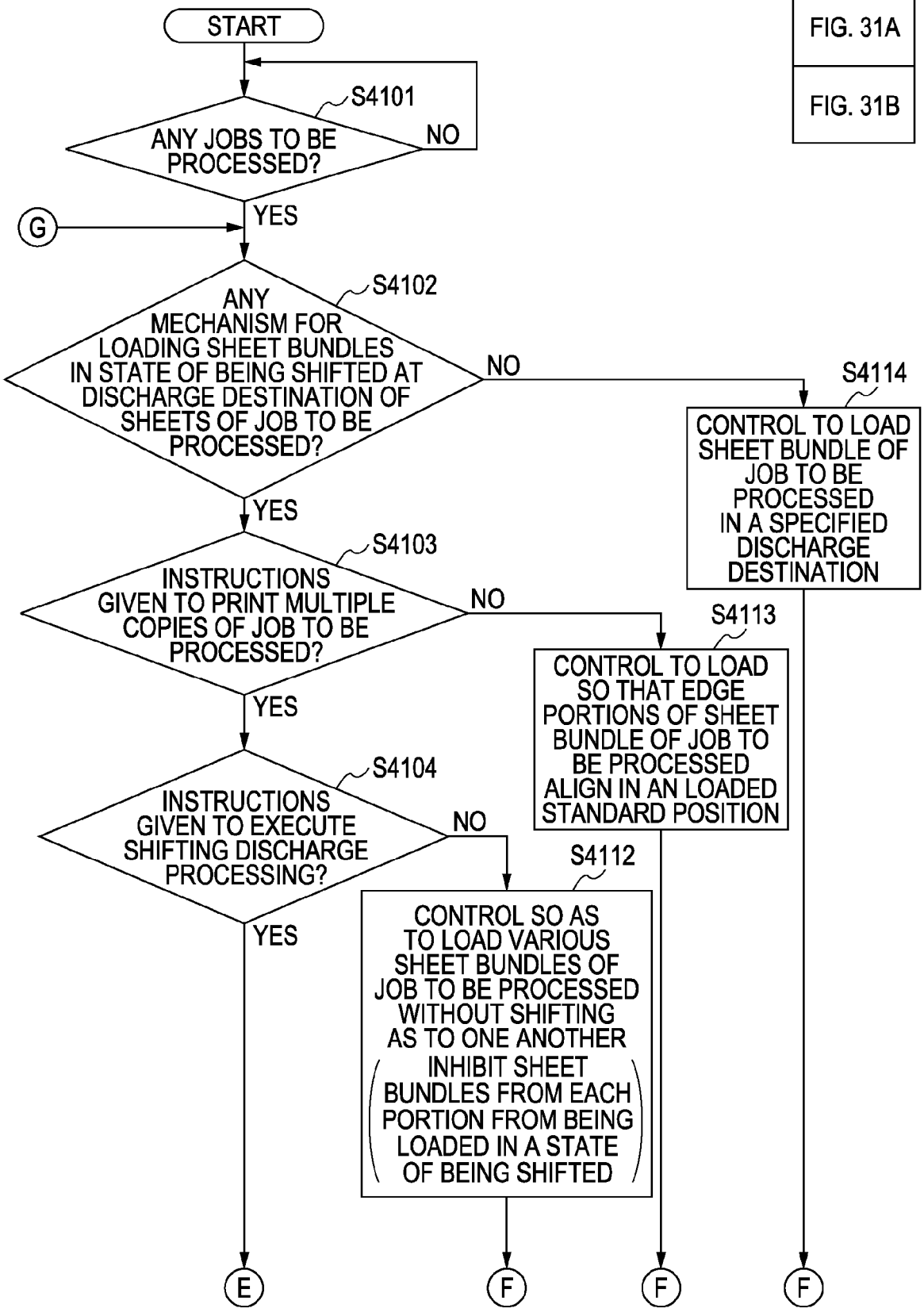
FIG. 31 is a flowchart to describe control relating to the shifting processing of an embodiment.
Figure 31B:
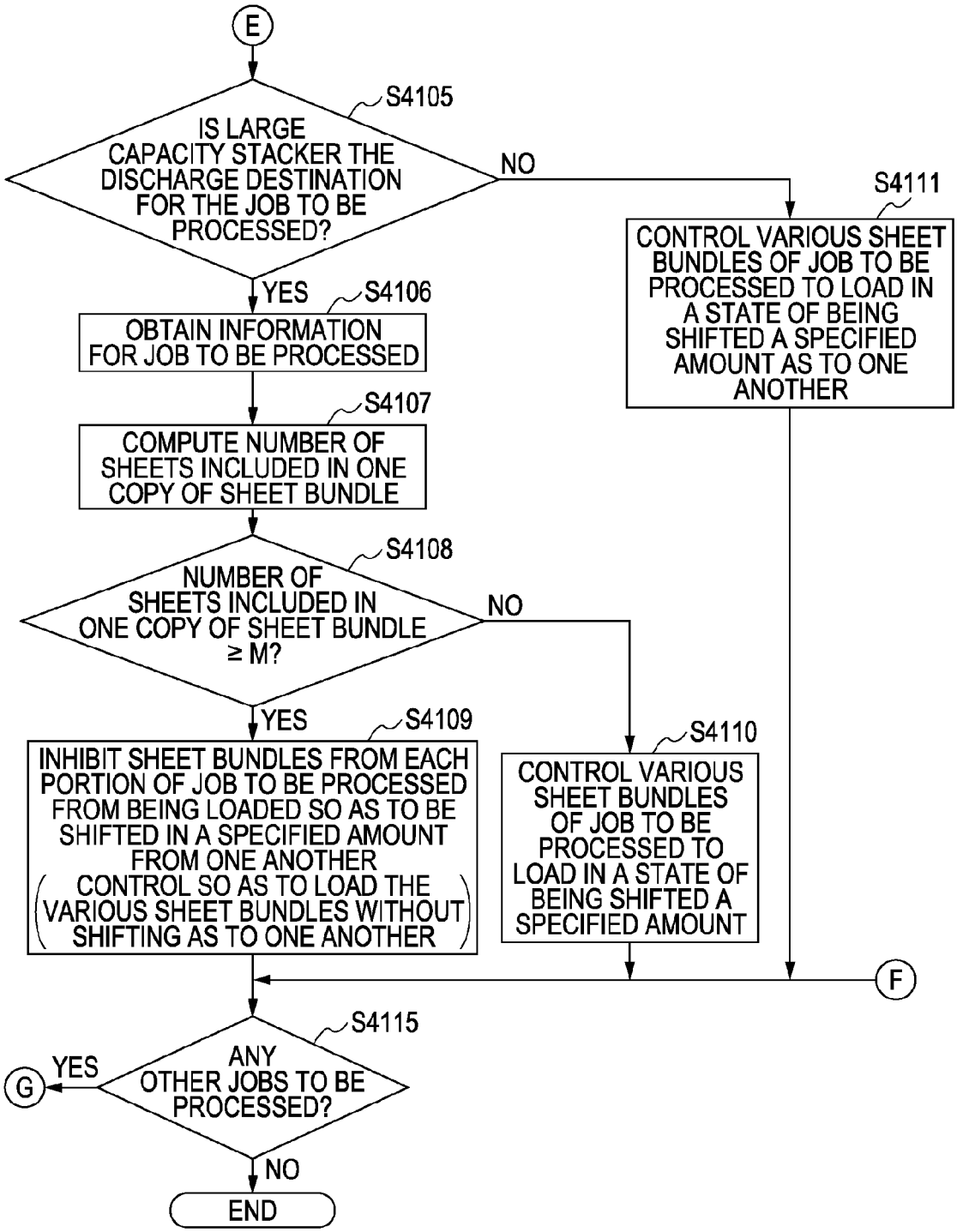

First, in step S4101 in FIG. 31, the control unit 205 determines whether or not any jobs to be processed exist. A job to be processed is a job having a printing request, and is stored within the HDD 209, awaiting execution. After turning on the power source, the control unit 205 determines whether or not any jobs having a printing request exist within the HDD 209, and if a job exists, the flow is advanced to step S4102.

On the other hand, in the case that no jobs having a printing request exist within the HDD 209, the control unit 205 determines that no jobs to be processed exist, and the processing in step S4101 is repeated. In this case, thereafter, in the case that a job having a printing execution request is accepted, the control unit 205 determines that a job to be processed exists, and the flow advances to step S4102. Specifically, in step S4101, the control unit 205 determines whether a printing execution request is accepted from a user via an operating unit 204, which is an example of a UI portion according to the present embodiment, or the operating unit of PC 103 or PC 104, based on operations by the user as to the start key 503 on the operating unit 204.

Note that the control unit 205 stores all of the printing data of the job to be processed which has a printing execution request and which is input via the scanner unit 201 or external interface unit 202 on the HDD 209, and reads this data from the HDD 209 to print with the printer unit 203.

Also, upon accepting a job, the control unit 205 also accepts the processing condition data of the job and stores this in the HDD 209 associated to the printing data. The processing condition data includes information relating to number of pages or number of copies, printing size enlarging/reduction and printing layout, types of sheets, size of sheets, single side/duplex printing settings, and so forth at the time of printing. Also, information relating to types of sheet processing for specifying what type of sheet processing is to be executed as to the sheets to be printed with the job and discharge destination information of the sheets to be printed are also included in the processing condition data. Note that the method for the control unit 205 to set the discharge destination information of the sheets to be printed is as described above.

The processing in step S4101 is repeated until a job having a printing request is accepted. In the event the printing apparatus 100 accepts a job having a printing request, the control unit 205 advances the flow from step S4101 to step S4102 in FIG. 31.

Determination is made in step S4102 as to whether or not the discharge destination of the job to be processed is the discharge destination having a mechanism for stacking the sheet bundles in a shifted state. Specifically, the control unit 205 makes determination from the processing condition data stored in the HDD 209 with reference to the discharge destination information of the job to be processed. In the case that the control unit 205 determines that the discharge destination information is for example the stacking tray of the saddle-stitch binding apparatus or the stacking tray of the large-capacity stacker, the discharge destination of the job to be processed is determined to be the discharge destination having a mechanism for stacking the sheet bundles in a shifted state.

As a result of the determination, in the case that the control unit 205 determines that the discharge destination for the job to be processed is not the discharge destination having the mechanism, the flow is advanced to step S4014, and the control unit 205 performs control to stack the sheet bundle of the job to be processed at the specified discharge destination without shifting processing.

On the other hand, in the case that the control unit 205 determines in step S4102 that the discharge destination of the job to be processed has a mechanism for stacking sheet bundles in a shifted state, the flow is advanced to step S4103.

In step S4103, the control unit 205 determines whether or not the job to be processed is a job specified to print multiple copies. For example, the control unit 205 determines whether or not the job is specified to print multiple copies, by referencing the processing condition data associated to the printing data of the job to be processed. If specification is not made to print multiple copies, the flow is advanced to step S4113, and control is performed such that the edge portion of the printed material of the jobs to be processed is to be stacked so as to align with the stacking standard position. For example, in the case that the discharge destination of the job to be processed is the stacking tray of the large-capacity stacker, the control unit 205 controls the stacking to align with the stacking standard position shown in FIG. 30 (for example, the first stacking standard position).

On the other hand, in the event the control unit 205 determines that the job to be processed is a job specified to print multiple copies, the flow is advanced to step S4104.

In step S4101, the control unit 205 determines whether or not instructions are given to execute the between-copy shifting processing with the between-copy shifting button 213 as a setting of the printing system 1000.

In the case that determination is made that instructions are not given to execute between-copy shifting processing, the flow is advanced to step S4112, and the control unit 205 controls the stacking of the sheet bundles of each copy of the job to be processed without shifting as to one another. In other words, the control unit 205 inhibits stacking the sheet bundles for each copy in a shifted state in step S4112.

On the other hand, in the case that the control unit 205 determines in step S4104 that instructions are given to execute between-copy shifting processing as a setting for the printing system 1000, the flow is advanced to step S4105.

In step S4105, the control unit 205 determines whether or not the discharge destination of the job to be processed is the large-capacity stacker.

In the case that the control unit 205 obtains the information of the discharge destination of the job from the processing condition data of the job to be processed, and determines in step S4105 that the discharge destination of the job is not the large-capacity stacker, the flow is advanced to step S4111.

In step S4111, control is performed to stack the sheet bundles of each copy of the job to be processed in a state shifted a specified amount (hereafter, the specified amount is 10 mm) from one another. On the other hand, in the case that the control unit 205 determines in step S4105 that the discharge destination of the job to be processed is the large-capacity stacker, and advances the flow to step S4106.

In step S4106, the control unit 205 obtains the information for the job to be processed. The job to be processed is stored in the HDD 209 and is in a state awaiting execution, so the information of the job to be processed can be obtained with the following method. The control unit 205 can obtain the information of the job to be processed by referencing the processing condition data stored in the HDD 209 associated with the printing data of the job to be processed.

The information which the control unit 205 can obtain with this method includes information relating to the number of pages and number of print copies, printing size enlarging/reduction and printing layout, types of sheets, size of sheets, single side/duplex printing settings, and so forth, information relating to the type of sheet processing, and information relating to the discharge destination of the sheets, and so forth.

In step S4107, the control unit 205 computes the number of sheets included in a sheet bundle of one copy of the job to be processed, from the information of the job to be processed which is obtained in step S4106.

The control unit 250 calculates the number of sheets included in a sheet bundle of one copy of the job to be processed, employing information relating to the number of pages for one copy, print layout, single/duplex printing processing and so forth from the information obtainable in step S4107.

For example, in the case the number of pages for one copy is 1000 pages and 2 in 1 printing is set, the control unit 205 calculates 1000 pages/2 (because of 2 in 1 printing) so 500 sheets for each copy of the job to be processed is discharged. Also, in the event the number of pages for one copy is 2000 pages and duplex printing is set, the control unit 205 calculates 2000 pages/2 (because of duplex printing) so 1000 sheets for each copy of the job to be processed is discharged. That is to say, by dividing the number of pages for one copy of the job by the number of pages to be printed for each sheet, the control unit 205 can obtain the number of sheets included in the sheet bundle of one copy of the job to be processed, which is discharged upon the job being executed. In step S4107, upon computing the number of sheets included in a sheet bundle of one copy of the job to be processed, the control unit 205 advances the flow to step S4108.

In step S4108, the control unit 205 determines whether or not the number of sheets included in a sheet bundle of one copy of the job to be processed is the condition value M sheets (for example, 500 sheets) or greater.

In the case determination is made that the number of sheets is M sheets or greater, the flow is advances to step S4109, and the control unit 205 inhibits the sheet bundles of each copy for the job to be processed is stacked in a state shifted by a specified amount. In this case, an arrangement may be made wherein the control unit 205 performs control to stack the sheet bundles of each copy without shifting. Also, an arrangement may be made wherein the control unit 205 displays such as that shown in FIG. 44 for example on the display unit 401, and the operator recognizes whether or not the sheet bundles are stacked in a shifted state. For example, if the control unit 205 recognizes that the "YES" button shown in FIG. 44 is pressed from a signal from the display unit 401, the sheet bundle of the following job and the sheet bundle of the advance job are stacked without being in a shifted state. In this event, a dividing point between both jobs can be clarified by inserting a dividing sheet between the sheet bundles of the advance job and the sheet bundles of the following job, even without the following job and advance job being in a shifted state.

On the other hand, if the control unit 205 recognizes that the "NO" button is pressed, the control unit 205 performs control to stack the sheet bundle of the following job and the sheet bundle of the advance job in a shifted state. For example, in the case that the transporting distance with a cart is short and the probability of the stack falling over is low, by the operator selecting the "NO" button, stacking in a state of the sheet bundles for each copy of the job to be processed in a shifted state can be performed, even if there is a possibility of the stack to fall over. With such a configuration, the printing system 1000 can perform between-copy shifting processing according to the intentions of the operator.

On the other hand, in the case of determining that the number of sheets is less than M sheets, the flow is advanced so step S4110, and control is performed to stack the sheet bundles for each copy of the job to be processed in a shifted state by a specified amount as to one another.

With such controls, within the same job, even in a case of stacking the sheets by copy in a shifted state according to instructions from the operator, the probability of the stacked sheets falling over during transporting with a cart can be decreased.

<Control by Difference in Media Type>

With the printing system 1000, the operator can set the type of sheet (media type) needed for the printing processing of the job to be printed, for example, by pressing a sheet selection key 615 shown in FIG. 4. The control unit 205 responds to the pressing of the sheet selection key 615 by the operator, and displays the sheet size or sheet type (media type) needed for the printing processing of the job to be printed on the display unit 401 as a screen enabling the user to make settings. The control unit 205 subjects the sheet of the type selected therefrom by the operator to printing, and discharges the sheets to the specified discharge destination.

However, depending on the type of sheet (for example, normal paper, coated paper, glossy paper), the frictional coefficient of the surface of the sheet differs. Therefore, in the case of stacking a sheet with a smaller friction coefficient, a problem arises wherein the stacked sheets more readily fall over as compared to the case of stacking sheets with a larger frictional coefficient.

Thus, the control unit 205 can perform controls such as described below, having considered the types of sheets. For example, the control unit 205 performs the following controls when executing the job to be processed, based on the management table shown in FIG. 32.

The control unit 205 specifies the type of sheet (media type) needed for printing the job from the processing condition data accepted simultaneously when accepting the job. The control unit 205 references the management table shown in FIG. 32 and determines whether to allow or inhibit stacking the sheet bundle of the job and the sheet bundle of the advance job, in a shifted state according to the type of the sheet specified. In other words, the control unit 205 determines whether to allow or inhibit between-job shifting processing.

For example, in the event that glossy paper with a high frictional coefficient is specified as the sheet needed for printing the job to be processed, the control unit 205 allows stacking of the sheet bundle of the job to be processed and the sheet bundle of the advance job in a shifted state. Also, for example, in the event that normal paper with a low frictional coefficient is specified as the sheet needed for printing the job to be processed, the control unit 205 inhibits stacking of the sheet bundle of the job to be processed and the sheet bundle of the advance job in a shifted state.

Note that the control unit 205 determining whether to allow or inhibit performing between-job shifting processing with consideration for the type of sheet has been described. However, this should not be limited, and the control unit 205 can also determine whether to allow or inhibit performing between-copy shifting processing with consideration for the type of sheet.

By performing such controls, the control unit 205 can control the allowing/inhibiting of executing of the between-job shifting processing or between-copy shifting processing with consideration for the type of sheets, thereby decreasing the probability of the stacked sheets falling over during transporting with a cart.

As described above, with the present embodiment, by performing shifted discharge as much as possible, the division for each predetermined unit is clarified, and while the workload of the operator is reduced, various situations have been assumed, and discharging which could facilitate the stacked sheets falling over has been avoided. Thus, further operator workload of picking up and collecting the stacked sheets having fallen over can be prevented in advance.

An example of a configuration regarding the control already described above in an embodiment will be exemplarily illustrated in order below.

First, the printing system 1000 according to the present embodiment is configured such that printed material which is printed by the printing apparatus 100 can be stacked at the output destination of the post-processing apparatus having stacking means.

The control unit 205 is configured as follows, for example with the above-mentioned configuration as a premise. The control unit 205 can stack the sheet bundle of the following job on top of the sheet bundle of the advance job in a state shifted a specified amount, onto the stacking means of the post-processing apparatus, whereupon the sheet bundle of the advance job subjected to printing by the printing apparatus is stacked.

With the above configuration as a major premise, the control unit 205 inhibits the sheet bundle of the following job from being stacked on top of the sheet bundle of the advance job in a state shifted a specified amount from the sheet bundle of the advance job, based on at least information relating to the type of post-processing apparatus. Thus, the present embodiment is configured such that the controls exemplified above are executable.

Also, the control unit 205 inhibits the sheet bundle of the following job which is to be stacked with the stacking means from being stacked on top of the sheet bundle of the advance job in a state shifted a specified amount from the sheet bundle of the advance job, based on at least the information relating to the stack amount of the sheet bundle of the following job. Thus, the present embodiment is configured such that the controls exemplified above are executable.

Note that the information relating to stack amount is information included on processing condition data, for example, which is information such as number of pages, number of printed copies, printing settings, printing layout, sheet type, sheet thickness, and so forth. The information relating to stack amount described hereafter is also similar.

Also, the stack amount may be the number of sheets included in a sheet bundle, for example, or may be the height of the sheet bundle. As an example of the stack amount, the number of sheets or height thereof is exemplified here, but should not be limited to this, and other stack amount may be used such as weight or capacity, as long as this can be compared to predetermined condition values. "Stack amount" as used in the following description should be understood accordingly.

Also, the control unit 205 performs the controls described below, based on at least information relating to the stack amount of the sheet bundle of the following job and the information relating to types of post-processing apparatuses required for stacking the sheet bundle of the following job. The control unit 205 inhibits the sheet bundle of the following job to be stacked with the stacking means from being stacked on top of the sheet bundle of the advance job in a state shifted a specified amount from the sheet bundle of the advance job, based on this information. Thus, the present embodiment is configured such that the controls exemplified above are executable.

Also, the control unit 205 inhibits the sheet bundle of the following job to be stacked with the stacking means from being stacked on top of the sheet bundle of the advance job in a state shifted a specified amount from the sheet bundle of the advance job, in the case that the stack amount of the sheet bundle of the following job is the condition value T1 (or M1) or greater. Thus, the present embodiment is configured such that the controls exemplified above are executable.

Additionally, the control unit 205 performs the following controls based on at least information relating to the stack amount of the sheet bundle of the advance job, information relating to the sheet bundle of the following job, and information relating to the type of post-processing apparatus required for stacking the sheet bundle of the following job. The control unit 205 inhibits the sheet bundle of the following job to be stacked with the stacking means from being stacked on top of the sheet bundle of the advance job in a state shifted a specified amount from the sheet bundle of the advance job. Thus, the present embodiment is configured such that the controls exemplified above are executable.

Also, the control unit 205 allows the sheet bundle of the following job to be stacked with the stacking means to be stacked on top of the sheet bundle of the advance job in a state shifted a specified amount from the sheet bundle of the advance job, in the case that the stack amount of the sheet bundle of the advance job is less than the condition value S1 (or L1). Thus, the present embodiment is configured such that the controls exemplified above are executable.

Additionally, of the in-line finishers to be discharge destinations, some are configured to have a cart attachable/detachable to/from the in-line finisher. Thus, the control unit 205 is configured to enable the sheet printed in the printing apparatus 100 to be stacked onto one of multiple in-line finishers, and enable the stacked sheets to be transported by the cart.

In this case that the in-line finisher required for stacking the sheet bundle of the following job is an in-line finisher wherein a cart performing conveying of the sheets is detachable, the control unit 205 performs the following controls. The control unit 205 inhibits the sheet bundle of the following job to be stacked with the stacking means from being stacked on top of the sheet bundle of the advance job in a state shifted a specified amount from the sheet bundle of the advance job. Thus, the present embodiment is configured such that the controls exemplified above are executable.

Additionally, in the case that the sheet bundle of the following job to be stacked on top of the sheet bundle of the advance job is stacked by the stacking means in a state shifted from the sheet bundle of the advance job, the control unit 205 performs the following controls. The control unit 250 inhibits the sheet bundle of the job to be stacked on top of the sheet bundle of the following job from being stacked onto the stacking means. Thus, the present embodiment is configured such that the controls exemplified above are executable.

Additionally, the printing system 1000 of the present embodiment has an automatic document conveying apparatus (ADF) 301 which separates the document bundle set on the stacking face of the document tray from the first page of the document, in page sequence, and conveys these to the platen glass for document scanning by the scanner 302. In the case that the sheet bundle of the following job is a sheet bundle of a copy job, for example, the control unit 205 determines whether or not the reading of the document of the copy job is performed by the ADF 301 by a signal from an unshown ADF-usage detecting sensor. In the case that the control unit 205 determines that the reading of the document of the following job is performed by the ADF 301, the control unit 205 inhibits the sheet bundle of the following job from being stacked on top of the sheet bundle of the advance job in a state shifted a specified amount from the sheet bundle of the advance job. Also, in the case that the control unit 205 determines that reading of the document of the following job is not performed by the ADF 301, the control unit 205 allows the sheet bundle of the following job to be stacked on top of the sheet bundle of the advance job in a state shifted a specified amount from the sheet bundle of the advance job. Thus, the present embodiment is configured such that the controls exemplified above are executable.

Additionally, in the case of inhibiting the sheet bundle of the following job from being stacked on top of the sheet bundle of the advance job in a state shifted a specified amount from the sheet bundle of the advance job, the control unit 205 the sheet bundle of the following job in a state not shifted from the sheet bundle of the advance job. Thus, the present embodiment is configured such that the controls exemplified above are executable.

Additionally, in the case of inhibiting shifting discharge processing, the control unit 205 performs a warning such as that shown in FIG. 24 or FIG. 25 by the display unit 401, for example. Thus, the operator can be advised to maintain stability of the stacked sheet bundles. Thus, the present embodiment is configured such that the controls exemplified above are executable.

Additionally, in the case of inhibiting shifting discharge processing, the control unit 205 inserts a dividing sheet between sheet bundle and sheet bundle, for example. Thus, the operator can readily distinguish between sheet bundle and sheet bundle and separate, even without the various sheet bundles being in a shifted state. Thus, the present embodiment is configured such that the controls exemplified above are executable.

Also, the control unit 205 controls the various copies of sheet bundles for one job specified to print multiple copies so as to be stacked in a shifted state. Thus, the present embodiment is configured such that the controls exemplified above are executable.

With the present embodiment of a system configuration having various configurations, various advantages described with the present embodiment can be achieved. However, a configuration does not need to use all of these, and arrangements may be made wherein only one advantage of a specific point of the present invention is executable, which are included in the present invention.

Also, with the present embodiment, an example of the control unit 205 stacking sheet bundle and sheet bundle in a shifted state as to one another employing matching units 2104*a* and 2104*b* which are provided at the discharge unit of each apparatus. However, if sheet bundle and sheet bundle can be stacked in a shifted state as to one another, this should not be limited to this method. For example, in the event of discharging a sheet, the control unit 205 can stack the sheet bundle and sheet bundle in a shifted state by shifting the tray for each job (or each copy) in the direction orthogonal to the discharge direction of the sheets.

Also, the primary controls disclosed by the present invention have been introduced as a configuration executed by the control unit 205 which is built in to the printing apparatus 100, but other configurations may also be used.

For example, of the two representative controls of the operating control relating to UI and the actual operation control for the system 1000, the operation control may be executed by the control unit 205, and the operating control may be realized by a UI control unit such as a display control unit or the like.

Also, displaying which the present embodiment discloses, to perform the processing which is interactive with the various types of operators of the present invention, is executed with the display unit of an external apparatus, with all of the primary controls of the present invention, or a portion thereof, by a control unit such as a PC which is an external apparatus separated at a distance from the printing apparatus 100. The external apparatus may be that which is exemplified by a server computer 103, or a client computer 104, or the like. Via the display unit of the external apparatus, similar requests can be accepted as the various operator requests disclosed by the present invention. Also, an arrangement may be made wherein the present printing system 1000 including the printing apparatus 100 is controlled with the operations according to such requests as similar requests as the operation disclosed by the present invention.

Thus, the main unit of control may be configured to be realized on the external apparatus side rather than the printing apparatus 100 side. However, it is desirable for at least the controls as exemplified in FIG. 18 to be executable.

[Other Arrangements]

The functions shown in the diagrams according to the present embodiments can be performed by a host computer (for example, the PC 103 or PC 104) by a program which is installed externally. Note that in this case, data for displaying operating screens similar to the operating screens described with the present embodiment which includes various operating screens are installed from the outside, and is configured to facilitate providing various types of user interface screens as described above on the display unit of the host computer. With the present example, the configuration with the UI screen in FIG. 17 describes this. In the case of such a configuration, the present invention can be applied even in a case wherein the information group including a program to an output apparatus is supplied from a storage medium such as a CD-ROM or flash memory or FD or the like, or from an external storage medium via a network.

Thus, the storage medium wherein the software program code is recorded which realizes the function of the above-described embodiments is supplied to a system or apparatus. Also, it goes without saying that the objects of the present invention can be achieved by reading and executing the program code stored in the storage medium by the computer (or CPU or MPU) of the system or apparatus.

In this case, the program code itself which is read from the storage medium executes a new function of the present invention, and the storage medium having stored such program code configures the present invention.

Accordingly, the program can be of any form, such as a program executed by an object code or interpreter, or a script data supplied to an OS, as long as the form has the function of a program.

The storage medium for supplying the program can be, for example, a flexible disk, hard disk, optical disk, MO, CD-ROM, CD-R, CD-RW, magnetic tape, non-volatile memory card, ROM, DVD, and so forth.

In this case, the program code itself which is read from the storage medium realizes the function of the present embodiment described above, and the storage medium storing the program code makes up the present invention.

As another program supplying method, a browser of a client computer can be employed to connect to a home page on the Internet, and the computer program itself of the present invention can be downloaded from the home page to the storage medium such as a hard disk. Alternatively, the program can be supplied by downloading a file including compressed, automatic installation functions, onto a storage medium such as a hard disk. Also, the program code making up the program of the present invention can be divided into multiple files, and the respective files can be downloaded from different home pages to execute the program. That is to say, a WWW server or ftp server or the like to download a program file for realizing the function processing of the present invention with a computer as to multiple users is also included in the scope of the present invention.

Also, the program of the present invention can be encrypted, stored in a storage medium such as a CD-ROM, and distributed to users. Also, users having cleared predetermined conditions can download key information for decrypting from a home page via the Internet, and execute the encrypted program by using the key information, thereby installing and executing the program on the computer.

Also, a case is included wherein the functions of the above-described embodiments are realized by executing the program code which is read by the computer. Further, it goes without saying that a case is included wherein, based on the instructions of the program code, a portion or all of the actual processing is performed by the OS (operating system) which is operating on the computer, whereby the functions of the above-described embodiments are realized by the processing thereof.

Further, it goes without saying that cases wherein the above-described functions are executed by the following processes are included. A CPU can write a program code, which has been read from the storage medium, into memory included in a function expansion unit connected to a computer, or a function expansion board inserted into a computer. Based on the instructions of such program code, a portion or all of the actual processing is performed by a CPU or the like which is included in the function expansion board or function expansion unit, to realize the function of the above-described embodiments.

Also, the present invention may be applied to a system made up of multiple apparatuses, or may be applied to an apparatus made up of one apparatus. Also, it goes without saying that the present invention can be applied to the case wherein a program is supplied to a system or apparatus to achieve the objects thereof. In this case, the system or apparatus thereof can take advantage of the effects of the present invention, by reading out the program described in the software for the purpose of achieving the present invention which is stored in the storage medium, to the system or apparatus.

The present invention is not limited to the above-mentioned embodiments, but various modifications may be made based on the intent of the present invention (including organic combinations of the various embodiments), which are not to be excluded from the scope of the invention. For example, with the present embodiment, the control unit 205 within the printing apparatus 100 is the main unit for various controls, but an arrangement may be made wherein an external controller which is in a separate casing from the printing apparatus 100 can execute a portion or all of the various types of controls.

The present invention has been described as various examples and embodiments, but one skilled in the art may make further modifications, wherein the scope and intent of the present invention is not limited to the specific descriptions in the present specification.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-342820 filed Dec. 20, 2006, which is hereby incorporated by reference herein in its entirety.

What is claimed is:

1. A printing system comprising:

a shift control unit configured to cause a shift unit to shift printed material which is printed by executing a print job by a predetermined amount away from other printed material which is printed by executing another print job and stacked by a stacking unit; and a stack control unit configured to cause said stacking unit to stack the printed material shifted by said shifting unit in a case where a stacking amount of the printed material is not more than a predetermined stacking amount, and cause said stacking unit to stack the printed material without causing said shift unit to shift the printed material by the predetermined amount in a case where the stacking amount of the printed material is more than the predetermined stacking amount.

2. The printing system according to claim 1, wherein said plurality of types of stacking units include a stacking unit to which a conveying unit to convey said printed material can be attached.

3. The printing system according to claim 1, wherein said shift control unit causes said shift unit to shift the printed material by an amount less than the predetermined amount and said stack control unit causes said stacking unit to stack the printed material shifted by said shift unit in a case where the stacking amount of the printed material is more than the predetermined stacking amount.

4. The printing system according to claim 1, wherein said stack control unit causes said stacking unit to stack the printed material shifted by said shift unit in a case where a stacking amount of other printed material is less than a second stacking amount, even if the stacking amount of the printed material to be printed by executing the print job more than a first stacking amount.

5. The printing system according to claim 1, wherein said stack control unit causes said stacking unit to stack the printed material such that the printed material to be printed by executing the print job is matched to the substantially same stacking position as the other printed material, in a case where the stacking amount of the other printed material is more than the predetermined stacking amount.

6. The printing system according to claim 1, further comprising:

a notification unit configured to notify a user in a case where the stacking amount of the other printed material is more than the predetermined stacking amount.

7. The printing system according to claim 5, further comprising:

an insert unit configured to insert a dividing sheet between the printed material to be printed by executing the print job and the other printed material in a case where the stacking amount of the other printed material is more than the predetermined stacking amount.

8. A method for a printing system configured to be able to use a plurality of types of stacking units, the method comprising:

executing operations to stack printed material which is printed by executing a print job by a predetermined amount away from other printed material which is printed by executing another print job and stacked by a stacking unit;

causing the stacking unit to stack the printed material shifted by the shift unit in a case where a stacking amount of the other printed material is not more than a predetermined stacking amount; and causing the stacking unit to stack the printed material without causing the shift unit to shift the printed material by the predetermined amount in a case where the stacking amount of the other printed material is more than the predetermined stacking amount.

9. The method according to claim 8, wherein said plurality of types of stacking units include a stacking unit to which a conveying unit to convey said printed material can be attached.

10. The method according to claim 8, wherein the printed material is shifted by an amount less than the predetermined amount, and the printed material shifted by the shift unit is stacked in the case where the stacking amount of the other printed material is more than the predetermined stacking amount.

11. The method according to claim 8, wherein the printed material is shifted by the shifting unit and stacked by the stacking unit in a case where a stacking amount of the other printed material is less than a second stacking amount, even if the stacking amount of the printed material which is printed executing the print job is more than the first stacking amount.

12. The method according to claim 8, wherein the printed material which is printed by executing the print job is matched to a substantially same stacking position as the other printed material, in a case where a stacking amount of the other printed material is less than a second stacking amount.

13. The method according to claim 8, further comprising:

notifying a user in a case where the stacking amount of the other printed material is more than a predetermined stacking amount.

14. The method according to claim 8, further comprising:

inserting a dividing sheet between the printed material which is printed by executing the print job and the other printed material in a case where the stacking amount of the other printed material is more.

* * * * *